US009605642B2

(12) United States Patent
Ikemori et al.

(10) Patent No.: US 9,605,642 B2
(45) Date of Patent: Mar. 28, 2017

(54) STARTER

(71) Applicant: Mitsuba Corporation, Kiryu-shi (JP)

(72) Inventors: Tomohiko Ikemori, Kiryu (JP); Masaaki Oya, Kiryu (JP); Chihiro Horikoshi, Kiryu (JP); Koki Honda, Kiryu (JP); Ken Noguchi, Kiryu (JP); Masaki Ishizeki, Kiryu (JP)

(73) Assignee: Mitsuba Corporation, Kiryu-shi (JP)

( * ) Notice: Subject to any disclaimer, the term of this patent is extended or adjusted under 35 U.S.C. 154(b) by 0 days.

(21) Appl. No.: 14/303,104

(22) Filed: Jun. 12, 2014

(65) Prior Publication Data

US 2014/0366686 A1 Dec. 18, 2014

(30) Foreign Application Priority Data

Jun. 13, 2013 (JP) ..... 2013-125048
Mar. 28, 2014 (JP) ..... 2014-070221
(Continued)

(51) Int. Cl.
*F02N 11/00* (2006.01)
*F02N 15/06* (2006.01)
*F02N 15/04* (2006.01)

(52) U.S. Cl.
CPC ..... *F02N 15/06* (2013.01); *F02N 15/046* (2013.01); *F02N 2015/061* (2013.01); *F02N 2250/08* (2013.01); *Y10T 74/137* (2015.01)

(58) Field of Classification Search
CPC ..... F02N 15/02; F02N 15/04; F02N 15/043; F02N 15/046; F02N 15/06; F02N 15/065;
(Continued)

(56) References Cited

U.S. PATENT DOCUMENTS 3,625,071 A * 12/1971 Harkness ..... F02N 15/006 74/7 R
3,772,921 A 11/1973 Carlson et al.
(Continued)

FOREIGN PATENT DOCUMENTS

CN 1143158 A 2/1997
CN 2248418 Y 2/1997
(Continued)

OTHER PUBLICATIONS

The State Intellectual Property Office of the Peoples Republic of China, Notice on the First Office Action issued in corresponding Chinese Patent Application No. 201410257921.6 and English-language translation mailed Oct. 10, 2015.
(Continued)

*Primary Examiner* — William Kelleher
*Assistant Examiner* — Leonard J Archuleta
(74) *Attorney, Agent, or Firm* — Wood Herron & Evans LLP

(57) ABSTRACT

A starter includes a motor unit, a drive shaft configured to receive a rotational force of the motor unit and rotate, a transmission pinion gear installed on the drive shaft, an idle shaft extending in a direction parallel to the drive shaft, an idle gear installed on the idle shaft and configured to mesh with the transmission pinion gear, a driving pinion gear installed on the idle shaft and configured to mesh with a ring gear of an engine, a gear cover configured to rotatably support portions of the drive shaft and the idle shaft and accommodate the transmission pinion gear and the idle gear, and a bracket section installed between the motor unit and the gear cover and configured to rotatably support a first end in an axial direction of the idle shaft.

11 Claims, 33 Drawing Sheets

(30) Foreign Application Priority Data

Mar. 28, 2014 (JP) ..... 2014-070235
Mar. 28, 2014 (JP) ..... 2014-070246
Mar. 28, 2014 (JP) ..... 2014-070379
Mar. 28, 2014 (JP) ..... 2014-070508

(58) Field of Classification Search
CPC .... F02N 15/066; F02N 15/067; F02N 15/006; F02N 15/022; F02N 2015/061; F02N 2250/08; Y10T 74/13; Y10T 74/131; Y10T 74/132; Y10T 74/137
USPC ..... 74/7 E, 7 A
See application file for complete search history.

(56) References Cited

U.S. PATENT DOCUMENTS 4,440,033 A * 4/1984 Kurihara ..... F02N 15/06 74/7 A
4,779,470 A * 10/1988 Morita ..... F02N 15/06 192/55.6
5,053,633 A * 10/1991 Sugiyama ..... F02N 15/00 290/48
5,130,586 A * 7/1992 Miyaji ..... F02N 15/043 310/83
5,353,658 A * 10/1994 Nagashima ..... F02N 15/06 74/7 A
5,528,945 A * 6/1996 Okada ..... F02N 15/023 74/7 A
5,755,137 A * 5/1998 Tomida ..... F02N 15/043 123/179.25
5,943,909 A * 8/1999 Soh ..... F02N 15/00 123/179.25
6,718,926 B2 * 4/2004 Yokochi ..... F02N 11/04 123/179.25
7,552,656 B2 * 6/2009 Miyake ..... F02N 15/043 74/6
7,647,849 B2 * 1/2010 Miyake ..... F02N 15/023 403/379.3
7,989,999 B2 * 8/2011 Ono ..... F02N 11/00 310/71
2002/0103051 A1 8/2002 Hasegawa et al.
2006/0123935 A1 6/2006 Miyake

FOREIGN PATENT DOCUMENTS

CN 1167875 A 12/1997
JP 5546055 A 3/1980
JP 5554665 A 4/1980
JP 02119675 A 5/1990
JP 04069673 U 6/1992
JP 07-012034 A 1/1995
JP 10238441 A 9/1998
JP 2002-130097 A 5/2002
JP 2002-285942 A 10/2002
JP 2006170143 A 6/2006
JP 2008-240539 A 10/2008
JP 2011-231671 A 11/2011
JP 2013-130077 A 7/2013
JP 2013-137014 A 7/2013
WO 2007-034666 A1 3/2007

OTHER PUBLICATIONS

Japanese Patent Office, Notice of Allowance issued in Japanese Patent Application No. 2013-1258048 mailed on Dec. 6, 2016, 6 pages.

* cited by examiner

STARTER

BACKGROUND OF THE INVENTION

Field of the Invention

The present invention relates to a starter.

Priority is claimed on Japanese Patent Application No. 2014-070221, filed Mar. 28, 2014, Japanese Patent Application No. 2014-070246, filed Mar. 28, 2014, Japanese Patent Application No. 2013-125048, filed Jun. 13, 2013, Japanese Patent Application No. 2014-070235, filed Mar. 28, 2014, Japanese Patent Application No. 2014-070508, filed Mar. 28, 2014, and Japanese Patent Application No. 2014-070379, filed Mar. 28, 2014, the contents of which are incorporated herein by reference.

Description of Related Art

For example, among starters used to start an engine of an automobile, there is a starter including a motor unit, a drive shaft, a pinion gear, a clutch mechanism, and an electromagnetic device, as major components (for example, see Japanese Unexamined Patent Application, First Publication No. H07-12034, and Japanese Unexamined Patent Application, First Publication No. 2008-240539).

The motor unit generates a rotational force by supplying electricity. A drive shaft is rotated by receiving a rotational force of the motor unit. The pinion gear is installed on a ring gear of the engine to be meshed with or separated from the ring gear to transmit the rotational force of the drive shaft to the ring gear. The clutch mechanism is installed between the drive shaft and the pinion gear to transmit or block the rotational force of the drive shaft to the pinion gear. The electromagnetic device generates a pressing force to the pinion gear toward the ring gear via the clutch mechanism. The drive shaft is rotatably supported by a housing. In addition, the electromagnetic device is received in the housing.

Here, the driving pinion gear may be slidably installed on the drive shaft, or may be slidably installed on an idle shaft extending in a direction parallel to the drive shaft according to circumstances such as layout or the like of the starter.

A so-called 2-shaft type starter having two shafts of the drive shaft and the idle shaft includes a transmission pinion gear installed on the drive shaft and an idle gear installed on the idle shaft and meshed with a transmission pinion gear. Accordingly, a rotational force of the drive shaft can be transmitted to the ring gear via the idle gear (for example, PCT International Publication No. WO2007/034666).

In addition, Japanese Unexamined Patent Application, First Publication No. 2002-130097 discloses a starter in which a ring gear and a pinion gear are configured of helical gears. The ring gear and the pinion gear have a skew direction (a helical skew direction) of gear teeth set such that a thrust load is generated in a direction from a position at which the pinion gear is withdrawn from the ring gear toward a position at which the pinion gear is meshed with the ring gear (hereinafter, the direction is appropriately referred to as a plunge direction) when the pinion gear is meshed with the ring gear.

According to the above-described configuration, in comparison with the starter in which the ring gear and the pinion gear are configured of spur gears, since a tooth contact ratio of the ring gear and the pinion gear is increased, noises due to meshing of the ring gear and the pinion gear upon start of the engine are reduced. In addition, once a distal end of the pinion gear is meshed with the ring gear upon start of the engine, since the pinion gear progresses to be suctioned into the ring gear by the thrust load, the pinion gear is likely to be meshed with the ring gear.

In addition, the electromagnetic device includes an exciting coil, a plunger holder, a switch plunger and a gear plunger. The plunger holder is installed on a push-out direction side of the driving pinion gear (pinion gear) on the exciting coil. The switch plunger has a cylindrical shape installed inside of the exciting coil in a radial direction, and is configured to be attracted and slid by a magnetic force generated by supplying electricity to the exciting coil. The gear plunger has a cylindrical shape installed further inside in the radial direction than the switch plunger, and includes an iron core attracted by a magnetic force generated due by supplying electricity to the exciting coil and slides in the axial direction.

Then, in the starter, when the electromagnetic device is supplied with electricity, the switch plunger slides in the push-out direction of the driving pinion gear by the exciting coil. Along with this, the gear plunger slides in the push-out direction of the driving pinion gear. Then, as the gear plunger slides in the push-out direction, the driving pinion gear is pushed out via the clutch mechanism. In addition, as the switch plunger slides, the motor unit is supplied with electricity, and the motor unit rotates. When the motor unit rotates, the drive shaft is rotated, and inertia is applied by further rotation of the drive shaft, and the driving pinion gear is further pushed out to be meshed with the ring gear.

When the driving pinion gear is pushed out until it meshes with the ring gear, the switch plunger and the gear plunger also slides in the push-out direction to follow the driving pinion gear. Then, positions of the switch plunger and the gear plunger are held by a magnetic attractive force of the exciting coil. Accordingly, the meshing of the ring gear and the driving pinion gear is also maintained (for example, see Japanese Unexamined Patent Application, First Publication No. 2013-130077).

In addition, for the convenience of the layout of the ring gearbased on the structure of the engine side, there may be a case in which the drive shaft of the starter attached to the engine protrudes outward from the housing in the axial direction, the driving pinion gear is installed on an end section of the protruding drive shaft, or the driving pinion gear is installed on the idle shaft extending in a direction parallel to the drive shaft and configured to receive the rotational force of the drive shaft to be rotated.

Further, when the idle shaft is installed, there may be a case in which the idle shaft protrudes outside from the housing of the starter in the axial direction, and the driving pinion gear is installed on the end section of the protruding idle shaft.

In this way, a seal member such as an oil seal or the like is installed on a hole of the housing through which the shaft is inserted, such that foreign substances such as water or the like do not intrude into the housing from the hole of the housing through which the shaft passes when the drive shaft or the idle shaft protrudes outside from the housing of the starter in the axial direction and the driving pinion gear is installed on the end section of the protruding shaft. Hereinafter, an example of the case in which the seal member is installed will be described in detail.

FIG. 42 is a view showing a seal member installed in a housing of a starter of the related art (for example, see Japanese Unexamined Patent Application, First Publication No. 2011-231671).

As shown in FIG. 42, a starter 500 includes a housing 501. An electric motor (not shown) is attached to the housing 501. In addition, in the starter 500, a drive shaft (a shaft) 502 rotated by receiving a rotational force of the electric motor (not shown) is installed. The drive shaft 502 is rotatably supported by the housing 501.

A through-hole 503 through which the drive shaft 502 is inserted is formed in the housing 501. Then, a driving gear 504 is attached to an end section 502*a* of the drive shaft 502 protruding outside from the housing 501 in the axial direction (a right side of FIG. 42). The driving gear 504 is meshed with or separated from a ring gear 508 as the drive shaft 502 slides.

In addition, a bearing mounting section 503*a* and a seal mounting section 503*b* disposed further outside in the axial direction than the bearing mounting section 503*a* and having a diameter reduced by a step difference are formed on an inner circumferential surface of the through-hole 503 of the housing 501. Then, a bearing 505 configured to rotatably support the drive shaft 502 is mounted on the bearing mounting section 503*a*. In addition, an oil seal 506 configured to prevent foreign substances such as water or the like from intruding into the housing 501 is mounted on the seal mounting section 503*b*.

Further, an inner flange section 507 is formed on an inner circumferential surface of the through-hole 503 of the housing 501 further outside than the seal mounting section 503*b* (the right side of FIG. 42). The inner flange section 507, which suppress the oil seal 506 from being directly covered by water, functions as a retainer configured to prevent the oil seal 506 from falling from the housing 501.

In addition, in order to improve the meshing of the ring gear and the pinion gear, a structure that helically meshes the gears with each other may be employed. In this case, a direction of the thrust load applied to the pinion gear, which is associated with a variation in rotational speed of the ring gear due to behavior of the engine upon start of the engine, is varied based on a rotational speed difference between the pinion gear and the ring gear.

Specifically, when the rotational speed of the ring gear is lower than that of the pinion gear, a thrust load toward the ring gear is applied to the pinion gear, and the pinion gear is displaced toward the ring gear. Meanwhile, when the rotational speed of the ring gear is higher than that of the pinion gear, a thrust load toward an opposite side of the ring gear is applied to the pinion gear, and the pinion gear is displaced toward the opposite side of the ring gear.

When the rotational speed of the ring gear becomes lower than that of the pinion gear and the pinion gear is rotated by the rotational force of the motor unit, if there is a backlash between the gear plunger and the clutch mechanism, the clutch mechanism is displaced in the axial direction to an extent of the backlash. For this reason, transmission of the rotational force of the motor unit to the pinion gear is delayed slightly to that extent.

Further, since a load applied to rotation of the motor unit is also reduced while the clutch mechanism is moved to the extent of the backlash, the rotation of the motor unit is acceralating. However, when the backlash is blocked, the load is applied to the rotation of the motor unit so that the motor is shifted from accelerating to maintaining a constant speed. abnormal noiseRotational irregularities of the motor unit may occur due to variation in the rotational speed of the motors and abnormal noises may be generated due to the rotational irregularities.

Especially in an automobile having an idle stop function, since the starting of the conventional engine is performed by manipulating a key cylinder depending on a user's intention, an engine starting sound (a starter operating sound) is not particularly a problem because it performs an important function of audibly signalling that the engine is being started. However, since restarting a stopped engine is performed regardless of the user's intention upon re-departure or the like after temporary stoppage of a vehicle, the need for silence of the engine starting sound (the starter operating sound) is increased. In this way, in the vehicle having the idle stop function, since stop/start of the engine is frequently performed and the use frequency of the starter is larger than that of the conventional starter, remedial measures for the above-described problems are required.

For this reason, a technology which prevents generation of an aperture between a point of action of the electromagnetic device and the clutch mechanism and the backlash of the clutch mechanism to prevent generation of noises is proposed. For example, a starter in which a gear plunger of an electromagnetic device is configured of an inner plunger, an outer plunger and a plunger spring is proposed.

The inner plunger is fitted onto the drive shaft and is configured to be slidable along the drive shaft. The outer plunger is installed outside in the radial direction of the inner plunger and concentrically with the inner plunger, and interlocked with the inner plunger so as to be slidable along the drive shaft. The plunger spring is installed between the inner plunger and the outer plunger.

According to the above-described starter, the outer plunger slides by supplying electricity to the exciting coil, and thus the inner plunger slides. Accordingly, the plunger spring may function as a backlash absorption mechanism configured to prevent backlash (for example, see Japanese Unexamined Patent Application, First Publication No. 2013-137014).

In the above-described 2-shaft type starter, the drive shaft and the idle shaft are disposed in parallel. For this reason, when the starter is assembled, two shafts should be assembled, the drive shaft of a first side is supported by the base plate and the gear cover and the idle shaft of a second side are supported by the gear cover at both ends sides thereof. For this reason, after the drive shaft and the pinion are installed on the gear cover, the idle shaft should be installed on the gear cover such that the idle gear is held while meshed with the pinion, and thus the time need to fabricate the starter may increase.

Here, while the structure in which the gear cover is divided into two members in the axial direction of the drive shaft has been proposed, when the two shafts are sandwiched between the two members, respective parts are assembled in the gear cover such that a worker cannot see the parts from the outside. For this reason, the work of positioning the shafts and meshing the gears may become difficult.

In addition, since the driving pinion gear and the ring gear are helically meshed, upon start the engine, the direction of the thrust load generated from the driving pinion gear varies based on the rotational speed difference between the driving pinion gear and the ring gear. Specifically, it varies such that the starting is started and the ring gear is driven by the driving pinion gear of the starter side, the rotational speed of the ring gear is lower than that of the driving pinion gear, and, as described above, the thrust load to the ring gear in the plunge direction is generated from the driving pinion gear.

On the other hand, when the engine is started by the starter, the rotational speed of the ring gear is increased depending on an increase in rotating speed of the engine. As a result, when the rotational speed of the ring gear is higher than that of the driving pinion gear, a thrust load is applied to the driving pinion gear in a direction separated from the ring gear (an opposite direction of the plunge direction).

Here, when the weight of the driving pinion gear is large, the generated thrust load may be equal to or larger than a holding force (an attractive force) by an electromagnet of an electromagnetic switch. Then, the driving pinion gear cannot be held at a position meshing with the ring gear, and the driving pinion gear may be separated from the ring gear before the engine is completely started.

In addition, before and after the piston of the engine passes through a top dead point and a bottom dead point, the rotational speed of a crankshaft of the engine is varied by a compressive force of a fuel-air mixture and an explosive force of fuel in a combustion chamber. Since the ring gear is integrally formed with the crankshaft, the rotational speed of the ring gear varies along with the crankshaft. Accordingly, the thrust load generated in the driving pinion gear is temporarily equal to or larger than the holding force by the electromagnetic switch, and the driving pinion gear may also be separated from the ring gear before the engine is completely started.

Further, the driving pinion gear may also be separated from the ring gear, and the member such as the shaft integrally installed on the driving pinion gear or the driving pinion gear may collide with the stopper or the like configured to restrict a movement thereof, generating abnormal noises.

In order to cope with the above-described phenomenon, the electromagnetic force of the electromagnetic switch may be increased, but it is not preferable because the weight, the size, and so on, of the coil of the electromagnetic switch are increased.

In addition, since the driving pinion gear separated from the ring gear plunges into the ring gear again while the starter is driven, an abutting sound may be generated between the ring gear and the driving pinion gear each time and cause abnormal noises.

Here, as the magnetic holding force of the gear plunger is increased, simply increasing the magnetic force of the electromagnetic device to increase the holding force of the gear plunger by the exciting coil in order to retain a separating force applied to the driving pinion gear from the ring gear may be considered.

However, when the magnetic force of the electromagnetic device is simply increased, the electromagnetic device may also be increased in size and thus the starter may also be increased in size, exerting an influence on a vehicle mounting property of the starter.

In addition, in the above-described related art, in the assembly state of the oil seal 506, as shown in FIG. 42, a gap S100 is generated between the oil seal 506 and the inner flange section 507. Then, a foreign substance such as water or the like may remain in the gap S100. When the foreign substance is moisture, the water may corrode the shaft 502, or may freeze and cause poor sliding between the shaft 502 and the oil seal 506.

In addition, as described above, before electricity supplied to the electromagnetic device is cut, the pinion gear may fall out of the ring gear due to the thrust load applied to the pinion gear toward the opposite side of the ring gear. In this case, since the electromagnetic device is still supplied with electricity, the pinion gear plunges into the ring gear again, ultimately causing abnormal noises.

SUMMARY OF THE INVENTION

The present invention provides a starter which can be easily assembled.

In addition, the present invention provides a starter capable of preventing unintentional separation of a driving gear from a ring gear.

In addition, the present invention provides a compact starter capable of preventing separation of a driving pinion gear from a ring gear upon start of an engine.

Further, the present invention provides a power transmission mechanism and a starter, in which a drive shaft protrudes to the outside of a housing and a gear section is installed on an end section of the protruding drive shaft, that are capable of effectively preventing foreign substances such as water or the like from intruding into a housing, and preventing corrosion of the drive shaft or inferior sliding of a seal member.

In addition, the present invention provides a starter capable of suppressing generation of abnormal noises.

According to a first aspect of the present invention, a starter includes a motor unit configured to generate a rotational force by supplying electricity; a drive shaft configured to receive a rotational force of the motor unit and rotate; a transmission gear slidably installed on the drive shaft; an idle shaft extending in a direction parallel to the drive shaft, rotatable around a central axis of the idle shaft, and configured to be slidable in the central axial direction interlocking with the transmission gear; an idle gear installed on a first end side in the axial direction of the idle shaft and configured to mesh with the transmission gear; a driving gear installed on the second end side in the axial direction of the idle shaft and configured to mesh with a ring gear of an engine; a gear cover section configured to rotatably support portions of the drive shaft and the idle shaft and accommodate the transmission gear and the idle gear; and a bracket section installed between the motor unit and the gear cover section and configured to rotatably support a first end in the axial direction of the idle shaft.

In this way, a member configured to rotatably support the drive shaft and the idle shaft is divided into the gear cover configured to rotatably support the portions of the drive shaft and the idle shaft and the bracket section configured to rotatably support a first end in the axial direction of the idle shaft, and further, the motor unit is installed separately from the gear cover and the bracket section. For this reason, positioning of the drive shaft and the idle shaft can be easily performed, and an assembly operation of the starter can be easily performed.

In addition, as the gear ratio between the transmission gear and the idle gear varies, a starter capable of torque-oriented or rotation-oriented adjustment can be provided.

According to a second aspect of the present invention, in the starter, the second end side in the axial direction of the idle shaft protrudes outside from the gear cover section in the axial direction, and the driving gear is installed on the protruding portion.

According to the above-described configuration, a gear other than the driving gear can be sealed by the gear cover, the bracket section and the motor unit. For this reason, inferior meshing of the gears or damage to the bearing or the like due to dust or the like can be prevented.

According to a third aspect of the present invention, in the starter, the idle shaft and the idle gear are integrally formed with each other.

According to the above-described configuration, the number of parts can be reduced. For this reason, an assembly operation of the starter can be further simplified.

According to a fourth aspect of the present invention, the starter further includes a clutch mechanism installed between the transmission gear and the motor unit and configured to transmit or block a rotational force of the drive shaft to the transmission gear; and an electromagnetic device installed in the bracket section and configured to perform or stop supplying electricity to the motor unit, and generate a pressing force at the driving gear toward the ring gear via the clutch mechanism.

According to the above-described configuration, an extra load that generates a reversal force to the motor unit when the drive shaft rotates more rapidly than the motor unit can be prevented from being applied to the motor unit. In addition, meshing of the driving gear with the ring gear using the electromagnetic device can be performed.

For this reason, a starter having high operation reliability can be provided.

According to a fifth aspect of the present invention, the electromagnetic device of the starter includes an exciting coil; and a gear plunger slidable along the drive shaft by supplying electricity to the exciting coil and configured to generate a pressing force at the clutch mechanism. The electromagnetic device is installed concentrically with the drive shaft.

According to the above-described configuration, a structure of the electromagnetic device can be simplified and reduced in size, and the disposition space of the electromagnetic device can be reduced.

According to a sixth aspect of the present invention, in the starter, the bracket section forms a sub-unit in which the electromagnetic device and the motor unit are assembled, and the bracket section includes a retainer section configured to prevent the electromagnetic device from slipping off from the bracket section toward the gear cover section.

According to the above-described configuration, the sub-unit in which the motor unit and the electromagnetic device are previously assembled so that the electromagnetic device is not separated from the sub-unit can be provided, and the gear cover, the drive shaft and the idle shaft can be assembled as the sub-unit. In this way, since they can be separately assembled, an assembly of the starter can be further simplified.

According to a seventh aspect of the present invention, in the starter, a draining-off section is formed on the abutting surface of the gear cover section which abut the bracket section.

According to the above-described configuration, even when the draining-off section having a complex shape such as a labyrinth structure, the draining-off section can be easily configured, and the water intruding into the gear cover section or the bracket section can be rapidly discharged to the outside. For this reason, the starter having higher operation reliability can be provided.

According to an eighth aspect of the present invention, in the starter, a draining-off groove is formed on the abutting surface of the bracket section, and the draining-off section is configured of the draining-off groove and the abutting surface of the gear cover section.

According to the above-described configuration, even when the gear cover section is varied due to modification of specifications, the draining-off section can be easily formed on the abutting surface of the gear cover section and the bracket section. For this reason, the manufacturing cost of the starter having high operation reliability can be reduced.

According to a ninth aspect of the present invention, an assembly method of the starter has a pre-assembly process of previously assembling the drive shaft, the transmission gear, the idle gear and the idle shaft to the gear cover section, and a bracket section assembly process of assembling the bracket section to the gear cover section after the pre-assembly process.

According to the above-described method, since the drive shaft and the idle shaft can be previously fixed to the gear cover section, positioning of the two shafts can be easily performed. For this reason, an assembly of the starter can be simplified.

According to a tenth aspect of the present invention, the assembly method of the starter has an electromagnetic device assembly process of assembling an electromagnetic device configured to generate a pressing force at the driving gear toward the ring gear and attached to the bracket section before the bracket section assembly process. The bracket section assembly process is performed after the electromagnetic device is attached to the bracket section by the electromagnetic device assembly process.

According to the above-described method, an assembly of the starter can be further simplified.

According to an eleventh aspect of the present invention, the gear cover section has an accommodating concave section configured to accommodate the idle gear, and a positioning unit installed on at least one of an abutting surface of the gear cover section configured to abut the bracket section and an abutting surface of the bracket section configured to abut the gear cover section and configured to position with the other of the abutting surface of the gear cover section configured to abut the bracket section and the abutting surface of the bracket section configured to abut the gear cover section.

In this way, since the positioning unit installed on at least one of an abutting surface of the gear cover section configured to abut the bracket section and an abutting surface of the bracket section configured to abut the gear cover section and configured to position with the other of the abutting surface of the gear cover section configured to abut the bracket section and the abutting surface of the bracket section configured to abut the gear cover section is provided, centering with respect to the drive shaft and centering with respect to the idle shaft between the gear cover section and the bracket section can be easily performed by the positioning unit. For this reason, positioning of the drive shaft and the idle shaft or meshing of the gears can be easily performed, and an assembly of the starter can be simplified.

According to a twelfth aspect of the present invention, the positioning unit of the starter is configured of a spigot joint section formed on a circumferential edge of an opening section of the accommodating concave section; and an opening section formed on the bracket section and capable of being fitted into the spigot joint section.

According to a thirteenth aspect of the present invention, the positioning unit may be configured of a positioning pin protruding from any one of the abutting surface of the gear cover section configured to abut the bracket section and the abutting surface of the bracket section configured to abut the gear cover section; and a pin insertion hole formed on the other of the abutting surface of the gear cover section configured to abut the bracket section and the abutting surface of the bracket section configured to abut the gear cover section and through which the positioning pin is capable of being inserted.

According to the above-described configuration, positioning of the gear cover section and the bracket section can be easily performed with a simple structure.

According to a fourteenth aspect of the present invention, the positioning unit of the starter has a first positioning unit and a second positioning unit. The first positioning unit is configured of a spigot joint section formed on a circumferential edge of an opening section of the accommodating concave section; and an opening section formed on the bracket section and capable of being fitted into the spigot joint section. The second positioning unit is configured of a positioning pin protruding from any one of the abutting surface of the gear cover section configured to abut the bracket section and the abutting surface of the bracket section configured to abut the gear cover section; and a pin insertion hole formed on the other of the abutting surface of the gear cover section configured to abut the bracket section and the abutting surface of the bracket section configured to abut the gear cover section and through which the positioning pin is capable of being inserted.

According to the above-described configuration, the positioning unit can be configured with a simple structure, workability can be improved, and the manufacturing cost can be reduced. In addition, positioning of the gear cover section and the bracket section can be more precisely performed.

According to a fifteenth aspect of the present invention, the first positioning unit of the starter is installed on a position of the accommodating concave section corresponding to a place where the transmission gear is accommodated. The second positioning unit is installed on an opposite side of a place where the first positioning unit is installed, with the idle shaft sandwiched between the first positioning unit and the second positioning unit.

According to the above-described configuration, the first positioning unit and the second positioning unit can be disposed so as to be spaced as far from each other as possible. For this reason, deviation of a relative position in the rotational direction of the drive shaft between the gear cover section and the bracket section can be prevented as much as possible. Accordingly, positioning of the gear cover section and the bracket section can be more precisely performed.

According to a sixteenth aspect of the present invention, the motor unit and the drive shaft of the starter are fitted not to be able to be relatively rotated and to be detachable from each other via a speed reduction mechanism. A fitting area between the output section of the speed reduction mechanism and the drive shaft is set to be smaller than an insertion area of a first end in the axial direction of the idle shaft with respect to the bracket section, and set to be smaller than an insertion area of the positioning pin with respect to the pin insertion hole.

According to the above-described configuration, when the starter is assembled, before the output section of the speed reduction mechanism is connected to the drive shaft, the idle shaft can be inserted with respect to the bracket section, and the positioning pin can be inserted into the pin insertion hole. For this reason, centering between the output section of the speed reduction mechanism and the drive shaft can be easily performed, and the output section of the speed reduction mechanism and the drive shaft can be easily connected. For this reason, an assembly of the starter can be simplified.

According to a seventeenth aspect of the present invention, in the starter, a gap capable of absorbing manufacturing errors of the gear cover section and the bracket section is set between the first end in the axial direction of the idle shaft and a bearing section of the bracket section configured to rotatably support the first end in the axial direction.

According to the above-described configuration, even when the gear cover section and the bracket section are rigidly positioned by the positioning unit, application of an excessive scooping force to the bearing section of the bracket section and the first end in the axial direction of the idle shaft can be prevented.

According to the eighteenth aspect of the present invention, an assembly method of the starter has a pre-assembly process of previously assembling the drive shaft, the transmission gear, the idle gear and the idle shaft to the gear cover section, and a bracket section assembly process of assembling the bracket section to the gear cover section after the pre-assembly process.

According to the above-described method, since the drive shaft and the idle shaft are previously fixed to the gear cover section, positioning of the two shafts can be easily performed. For this reason, an assembly of the starter can be simplified.

According to a nineteenth aspect of the present invention, the idle gear is configured to be helically meshed with the transmission gear. The driving gear is configured to be helically meshed with the ring gear. A helical skew direction of the driving gear and a helical skew direction of the idle gear are set to the same direction.

According to the above-described configuration, when the drive shaft is rotated by the motor unit, the transmission gear is rotated with the drive shaft. Rotation of the transmission gear is transmitted to the idle shaft via the idle gear, and thus the driving gear is rotated. Accordingly, the ring gear of the engine can be rotated by the driving gear to start the engine.

Here, when the rotating speed of the ring gear of the engine side is larger than that of the driving gear, the thrust load received by the driving gear helically meshed with the ring gear is opposite to the thrust load received by the idle gear helically meshed with the transmission gear. Accordingly, the thrust load received by the driving gear can be offset.

According to a twentieth aspect of the present invention, a helical skew direction of the idle gear helically meshed with the transmission gear may be set to generate a thrust load in a direction of moving the driving gear toward the ring gear when the engine is started and the rotating speed of the ring gear is larger than that of the driving gear.

According to the above-described configuration, when the rotating speed of the ring gear is larger than that of the driving gear, even though the thrust load in the direction in which the driving gear is separated from the ring gear occurs, the thrust load in the direction opposite to the thrust load from the idle gear side is generated. Accordingly, unintentional separation of the driving gear from the ring gear can be prevented.

According to a twenty-first aspect of the present invention, a gear pitch diameter of the driving gear may be smaller than that of the idle gear.

According to the above-described configuration, a torque generated by the idle gear driven by the drive shaft rotated by the motor unit is efficiently transmitted to the driving gear.

According to a twenty-second aspect of the present invention, the starter further includes a housing configured to accommodate the motor unit, the drive shaft, the transmission gear and the idle gear. The second end side in the axial direction of the idle shaft protrudes outside from the housing, and the driving gear is disposed at the outside of the housing.

According to the above-described configuration, the present invention can also be applied to a starter of a type in which the driving gear is completely exposed to the outside of the housing (overhung).

According to a twenty-third aspect of the present invention, the starter further includes a clutch mechanism installed between the transmission gear and the motor unit in the housing and configured to transmit and block the rotational force of the drive shaft to the gear section, and an electromagnetic device configured to perform or stop supplying electricity to the motor unit and generate a pressing force toward the ring gear via the clutch mechanism at the driving gear.

According to a twenty-fourth aspect of the present invention, the electromagnetic device includes an exciting coil, and a gear plunger configured to slide along the drive shaft by supplying electricity to the exciting coil and generate a pressing force at the clutch mechanism, and the electromagnetic device is installed concentrically with the drive shaft.

The above-described configuration may be appropriately employed in the starter in which the electromagnetic device and the drive shaft are concentrically installed.

According to a twenty-fifth aspect of the present invention, the idle shaft is supported by the housing via the bearing to be movable in the central axial direction of the idle shaft and rotatable about the central axis.

According to a twenty-sixth aspect of the present invention, the idle shaft has a bottomed hole continued in the axial direction. As the support shaft having a first end fixed to the housing is inserted into the hole, the support shaft is supported to be movable in the central axial direction of the idle shaft and rotatable about the central axis.

According to a twenty-seventh aspect of the present invention, an air passage in communication with a space between a distal end section of the support shaft and the hole is formed in at least one of the idle shaft and the support shaft.

According to the above-described configuration, when the idle shaft is moved in the central axial direction, air in the space between the hole formed in the idle shaft and the distal end section of the support shaft can pass through the air passage, and the idle shaft can be smoothly moved.

According to a twenty-eighth aspect of the present invention, a starter includes a motor unit configured to generate a rotational force by supplying electricity, a drive shaft configured to receive the rotational force of the motor unit and rotate, a driving gear installed so as to be slidable in the axial direction of the drive shaft, installed so as to be meshed with a ring gear of an engine and configured to transmit rotation of the drive shaft to the ring gear, and an electromagnetic device configured to perform or stop supplying electricity to the motor, generate a pressing force toward the ring gear at the driving gear and push out the driving gear with the pressing force. The electromagnetic device includes an exciting coil formed in a cylindrical shape having an axial direction is aligned to the axial direction of the drive shaft, a plunger holder installed on a push-out direction side of the driving gear in the exciting coil, a cylindrical switch plunger attracted by a magnetic force generated by electricity supplied to the exciting coil and configured to slide in the exciting coil in the axial direction of the exciting coil, and a cylindrical gear plunger installed further inside in the radial direction than the switch plunger, having an iron core attracted with the magnetic force generated by the electrical connection to the exciting coil and configured to slide in the exciting coil in the axial direction of the exciting coil, and configured to generate the pressing force at the driving gear. The plunger holder includes a holder main body formed to cover a side surface of the exciting coil at the push-out direction side of the driving gear, and a plunger-holder-side cylindrical section that is bent and extends from the inside in the radial direction of the holder main body to face the inside in the radial direction of the exciting coil. A cutout section configured to increase an interval between the switch plunger and the plunger-holder-side cylindrical section is formed on the switch plunger at a place wrapped with the plunger-holder-side cylindrical section in the radial direction such that the switch plunger slides in the push-out direction and at a place at which a magnetic path is formed by the exciting coil by the switch plunger and the plunger-holder-side cylindrical section.

According to the above-described configuration, direct formation of the magnetic path from the plunger-holder-side cylindrical section to the switch plunger can be suppressed. For this reason, leakage of the magnetic flux from the plunger holder to the switch plunger can be prevented. The magnetic attractive force of the plunger holder and the switch plunger with respect to the gear plunger can be increased to that extent, and the electromagnetic device can be reduced in size. Accordingly, separation of the driving pinion gear from the ring gear upon start of the engine can be suppressed and the starter can be reduced in size.

According to a twenty-ninth aspect of the present invention, the cutout section of the starter is formed throughout the entire circumference of the switch plunger.

According to the above-described configuration, leakage of the magnetic flux from the plunger holder to the switch plunger can be suppressed.

According to a thirtieth aspect of the present invention, in the starter, a convex section configured to reduce an interval between the iron core and the switch plunger is formed on the switch plunger at a position corresponding to the iron core such that the gear plunger slides in the push-out direction.

According to the above-described configuration, in the convex section of the switch plunger, an interval between the gear plunger and the convex section is reduced. For this reason, a magnetic attractive force of the switch plunger with respect to the gear plunger can be further increased to that extent.

According to a thirty-first aspect of the present invention, the plunger-holder-side cylindrical section of the starter is disposed further inside in the radial direction than the switch plunger and installed so as to abut the iron core to restrict movement of the gear plunger toward the push-out direction, and the cutout section and the convex section of the switch plunger are continuously formed.

In this way, as the cutout section and the convex section are continuously formed, the cutout section and the convex section can be formed at the same time. For this reason, the manufacturing cost of the starter can be reduced.

According to a thirty-second aspect of the present invention, the ring gear and the driving gear of the starter are configured of helical gears, and are helically meshed with each other.

Here, as the ring gear and the driving gear are configured to be helically meshed, a meshing force of the driving gear with respect to the ring gear can be increased. However, a force in a direction away from the ring gear is applied to the driving gear by a rotational speed difference between the ring gear and the driving gear. In particular, the electromagnetic device can be appropriately used in the starter having the above-described configuration.

According to a thirty-third aspect of the present invention, the starter includes a transmission gear slidably installed on the drive shaft, an idle shaft extending in a direction parallel to the drive shaft, rotatable about the central axis, configured to be slidable in the central axial direction interlocking with the transmission gear, and an idle gear integrally formed with the idle shaft at a first end side in the axial direction of the idle shaft and meshed with the transmission gear. The driving gear is installed on the second end side in the axial direction of the idle shaft.

In this way, in the starter including the idle gear and the idle shaft, which are integrated, when an inertial force applied to the idle shaft is increased and a force directed in a direction away from the ring gear is applied to the driving gear, a load applied to the gear plunger is also increased. In particular, the electromagnetic device can be appropriately used in the starter having the above-described configuration.

According to a thirty-fourth aspect of the present invention, in the starter, the drive shaft and the electromagnetic device are concentrically disposed.

According to the above-described configuration, a structure of the electromagnetic device can be simplified and reduced in size, and a disposition space of the electromagnetic device can be reduced. For this reason, it is possible to provide a compact starter capable of suppressing separation of the driving pinion gear from the ring gear upon start of the engine.

According to a thirty-fifth aspect of the present invention, the starter (the power transmission mechanism) includes a housing configured to rotatably support the drive shaft while protruding to the outside via a bearing attached to a through-hole formed on one side of the housing, and a seal member disposed between one side of the housing and the bearing, formed to surround a periphery of the drive shaft and prevent foreign substances from intruding into the housing. A draining-off hole configured to discharge water remaining between one side of the housing and the seal member to the outside of the housing is formed in one side of the housing.

According to the above-described configuration, even when the foreign substance such as water remains between the a first surface of the housing and the seal member in the assembled state of the seal member, the remaining foreign substance can be rapidly discharged to the outside via the draining-off hole. For this reason, intrusion of the foreign substance such as water or the like into the housing can be effectively prevented, and corrosion of the drive shaft or inferior sliding of the seal member can be prevented.

According to a thirty-sixth aspect of the present invention, the draining-off hole in the starter is formed in a lower portion in a gravity direction of one side of the housing such that the housing is attached to an attachment member.

According to the above-described configuration, the foreign substance such as water or the like can be discharged from the draining-off hole using the force of gravity.

According to a thirty-seventh aspect of the present invention, the housing of the starter is formed using a mold by casting, and the draining-off hole can be formed by casting and extraction.

According to the above-described configuration, the housing and the draining-off hole can be easily formed. For this reason, the manufacturing cost of the housing can be reduced.

According to a thirty-eighth aspect of the present invention, the seal member of the starter has an outer circumferential wall in contact with an inner circumferential surface of the through-hole of the housing, an inner circumferential wall disposed concentrically with the outer circumferential wall and in contact with the drive shaft, and a bottom wall configured to connect the outer circumferential wall and the inner circumferential wall, which are integrally formed with each other. A size of the draining-off hole is set to a size in which the draining-off hole cannot be closed by the outer circumferential wall.

According to the above-described configuration, the seal member is assembled such that, even when the seal member and the one side of the housing abut each other, the outer circumferential wall of the seal member can be prevented from closing the draining-off hole. For this reason, the foreign substance such as water or the like intruding into the housing can be discharged via the draining-off hole.

According to a thirty-ninth aspect of the present invention, in the starter, an annular waterproof wall is vertically installed on the outside of one side of the housing to surround the periphery of the through-hole, and the draining-off hole is formed along the waterproof wall.

In this way, as the waterproof wall is installed, the water can be prevented from being directly poured into the draining-off hole from the outside of the housing. For this reason, the waterproof property in the housing can be increased.

In addition, since the draining-off hole is formed along the waterproof wall, the foreign substance such as water or the like discharged from the draining-off hole is discharged along the waterproof wall.

According to a fortieth aspect of the present invention, the waterproof wall of the starter is formed to two folds concentrically, and the draining-off hole is formed between the two folds of the waterproof wall.

According to the above-described configuration, the water from the outside of the housing can be prevented from being directly poured onto the drive shaft as well as into the draining-off hole. For this reason, corrosion of the drive shaft or inferior sliding of the seal member can be further prevented.

According to a forty-first aspect of the present invention, in the starter, a drainage gradient is formed on an inner circumferential edge of the draining-off hole so as to be gradually lowered toward the outside of the housing.

According to the above-described configuration, a foreign substance such as water or the like remaining between one side of the housing and the seal member can be rapidly discharged via the drainage gradient.

According to a forty-second aspect of the present invention, in the starter including the above-described power transmission mechanism, the starter includes a drive shaft configured to receive a rotational force of the electric motor and rotate, a transmission gear slidably installed on the drive shaft, an idle shaft extending in a direction parallel to the drive shaft, rotatable about a central axis, and configured to be slidable in the central axial direction interlocking with the transmission gear, an idle gear installed on a first end side in the axial direction of the idle shaft and configured to mesh with the transmission gear, and a driving gear installed on the second end side in the axial direction of the idle shaft and configured to mesh with a ring gear of an engine. The drive shaft is configured as the idle shaft, and the gear section is configured as the driving gear.

In this way, even in a so-called 2-shaft type starter having two shafts of the drive shaft and the idle shaft, it is possible to provide a starter capable of effectively preventing intrusion of a foreign substance such as water or the like into the housing, and preventing corrosion of the drive shaft or inferior sliding of the seal member.

According to a forty-third aspect of the present invention, a starter includes a motor unit configured to generate a rotational force by supplying electricity, a drive shaft configured to receive the rotational force of the motor unit and rotate, a pinion gear slidably installed on the drive shaft and configured to mesh with a ring gear of an engine, and an electromagnetic device configured to perform or stop supplying electricity to the motor, and configured to bias a pressing force toward the ring gear at the pinion gear. The electromagnetic device has an exciting coil having a cylindrical shape, a cylindrical outer plunger disposed concentrically with the exciting coil at the inside in the radial direction of the exciting coil and slidable toward the ring gear based on the electrical connection to the exciting coil, a cylindrical inner plunger disposed concentrically with the outer plunger at the inside in the radial direction of the outer plunger, configured to slide interlocking with the outer plunger, and relatively movable with respect to the outer plunger by a predetermined distance, and an elastic member installed between the outer plunger and the inner plunger and configured to bias the outer plunger and the inner plunger in directions away from each other. An end section of the inner plunger near the pinion gear is set as a point of action configured to bias the pressing force, and the predetermined distance is set to be smaller than a minimum guaranteed length of meshing between the ring gear and the pinion gear.

According to the above-described configuration, since slide movement of the inner plunger is restricted before the pinion gear is separated from the ring gear, separation of the pinion gear from the ring gear can be prevented before electricity supplied to the electromagnetic device is blocked. For this reason, generation of abnormal noises of the starter upon start of the engine can be suppressed.

According to a forty-fourth aspect of the present invention, in the starter, a movement restriction unit configured to restrict a length of slide movement of one of the outer plunger and the inner plunger is installed on the other of the outer plunger and the inner plunger.

According to the above-described configuration, there is no need to install a structure configured to restrict movement of an inner plunger with respect to an outer plunger at a part around the outer plunger and the inner plunger. For this reason, movement of the inner plunger with respect to the outer plunger can be restricted with a simple structure.

According to forty-fifth aspect of the present invention, in the starter, a convex section is formed on an inner circumferential surface of the outer plunger, a groove section configured to receive the convex section is formed on an outer circumferential surface of the inner plunger, and the convex section and the groove section are configured as the movement restriction unit.

According to the above-described configuration, movement of the inner plunger with respect to the outer plunger can be restricted with a simpler structure and without increasing an occupying area of the outer plunger and the inner plunger.

According to a forty-sixth aspect of the present invention, a chamfered section is formed on at least one of a rear side in the rotational direction of a tooth section of the pinion gear, an edge section of the ring gear side, and an edge section of a tooth section of the ring gear in which the tooth section of the pinion gear is received.

According to the above-described configuration, when the pinion plunges into the ring gear, the pinion and the ring gear smoothly abut each other. For this reason, collision noises when the pinion plunges into the ring gear can be reduced, and generation of abnormal noises of the starter upon start of the engine can be further suppressed.

According to a forty-seventh aspect of the present invention, the starter includes a drive shaft configured to receive a rotational force of the motor unit and rotate, a transmission gear slidably installed on the drive shaft, an idle shaft extending in a direction parallel to the drive shaft, movable about a central axis, and configured to be slidable in the central axial direction interlocking with the trans mission gear, and an idle gear installed on a first end side in the axial direction of the idle shaft and configured to mesh with the transmission gear. The drive shaft is configured as the idle shaft, the pinion gear is installed on the second end side in the axial direction of the idle shaft, and the electromagnetic device is installed concentrically with the drive shaft.

In this way, in the so-called 2-shaft type starter having two shafts of the drive shaft and the idle shaft, for example, a thrust load applied to the pinion gear at an opposite side of the ring gear is applied to the idle shaft when the ring gear and the pinion gear are helically meshed. Then, inertia of the idle shaft and the idle gear integrated with the idle shaft is applied to the inner plunger. The present invention can be appropriately used in the above-described structure.

In the above-described starter, a member configured to rotatably support the drive shaft and the idle shaft is divided into a gear cover configured to rotatably support portions of the drive shaft and the idle shaft and a bracket section configured to rotatably support a first end in the axial direction of the idle shaft, and further, the motor unit is separately installed from the gear cover and the bracket section. For this reason, positioning of the drive shaft and the idle shaft can be easily performed, and an assembly of the starter can be simplified.

In addition, in the above-described starter, the member configured to rotatably support the drive shaft and the idle shaft is divided into the gear cover configured to rotatably support portions of the drive shaft and the idle shaft and the bracket section configured to rotatably support a first end in the axial direction of the idle shaft, and further, the motor unit is separately installed from the gear cover and the bracket section. In addition, since a positioning unit is installed on at least one of an abutting surface of the gear cover section configured to abut the bracket section and an abutting surface of the bracket section configured to abut the gear cover section and is configured to position with the other of the abutting surface of the gear cover section configured to abut the bracket section and the abutting surface of the bracket section configured to abut the gear cover section, centering between the gear cover section and the bracket section with respect to the drive shaft and centering with respect to the idle shaft can be easily performed by the positioning unit of this reason, positioning between the drive shaft and the idle shaft or meshing of the gears can be easily performed, and an assembly of the starter can be simplified.

Further, in the above-described starter, unintentional separation of the pinion gear from the ring gear can be suppressed.

In addition, in the above-described starter, formation of a magnetic path between the plunger-holder-side cylindrical section and the switch plunger can be prevented. For this reason, leakage of a magnetic flux from the plunger holder to the switch plunger can be prevented. A magnetic attractive force of the plunger holder and the switch plunger with respect to the gear plunger can be increased to that extent without increasing the size of the electromagnetic device. Accordingly, separation of the driving pinion gear from the ring gear upon start of the engine can be suppressed, and the starter can be reduced in size.

Further, in the above-described starter, even when water remains between one side of the housing and the seal member in the assembled state of the seal member, the remaining water can be rapidly discharged to the outside via the draining-off hole. For this reason, intrusion of foreign substances such as water or the like into the housing can be effectively prevented, and corrosion of the drive shaft or inferior sliding of the seal member can be prevented.

In addition, in the above-described starter, since slide movement of the inner plunger is restricted before the pinion gear is separated from the ring gear, separation of the pinion gear from the ring gear can be prevented before electricity supplied to the electromagnetic device is blocked. For this reason, generation of abnormal noises of the starter upon start of the engine can be suppressed.

DETAILED DESCRIPTION OF THE INVENTION

First Embodiment

Starter

Hereinafter, a first embodiment of the present invention will be described with reference to the accompanying drawings.

Figure 1:
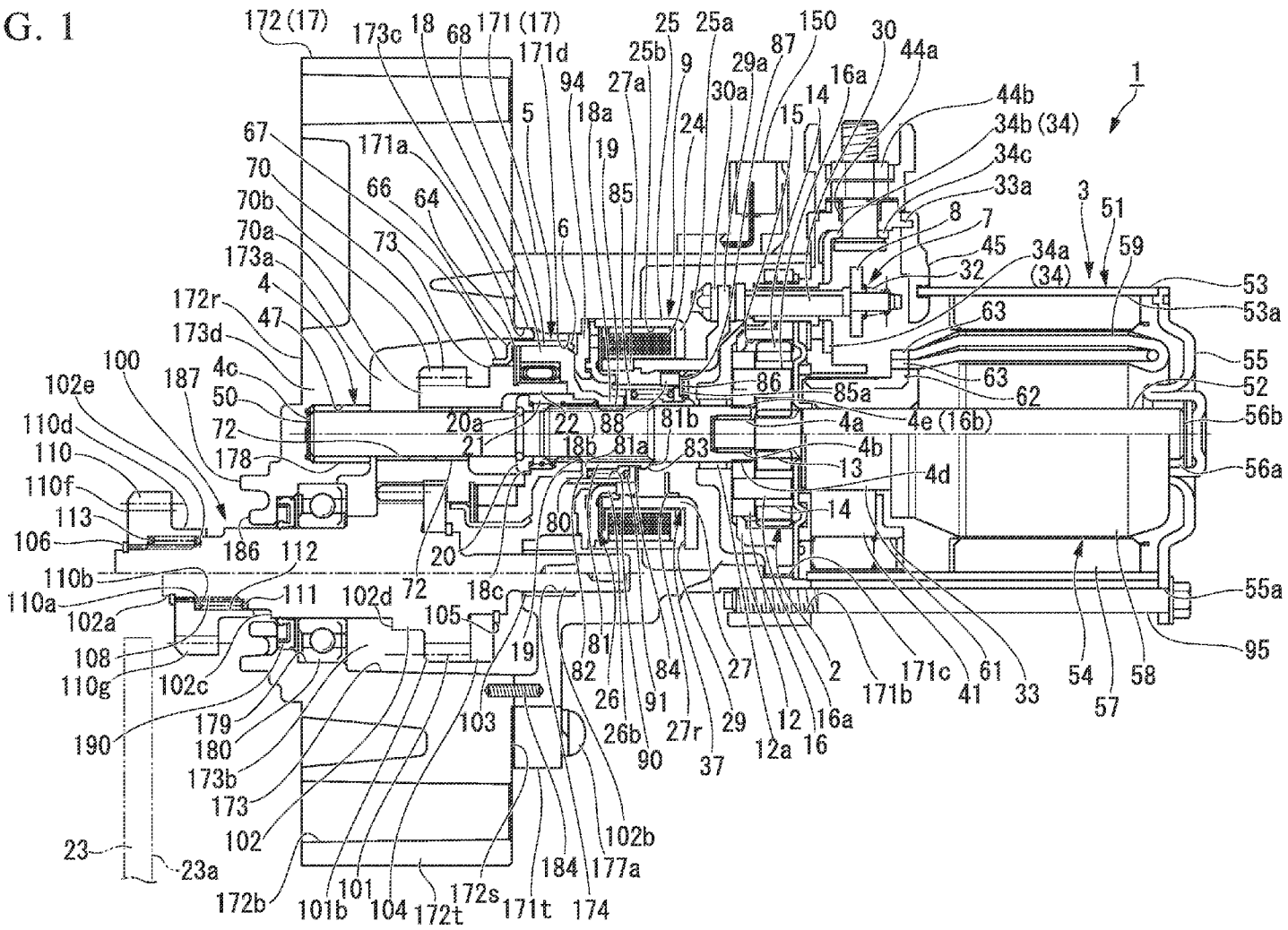
FIG. 1 is a cross-sectional view of a starter according to a first embodiment and a second embodiment of the present invention.
Figure 2:
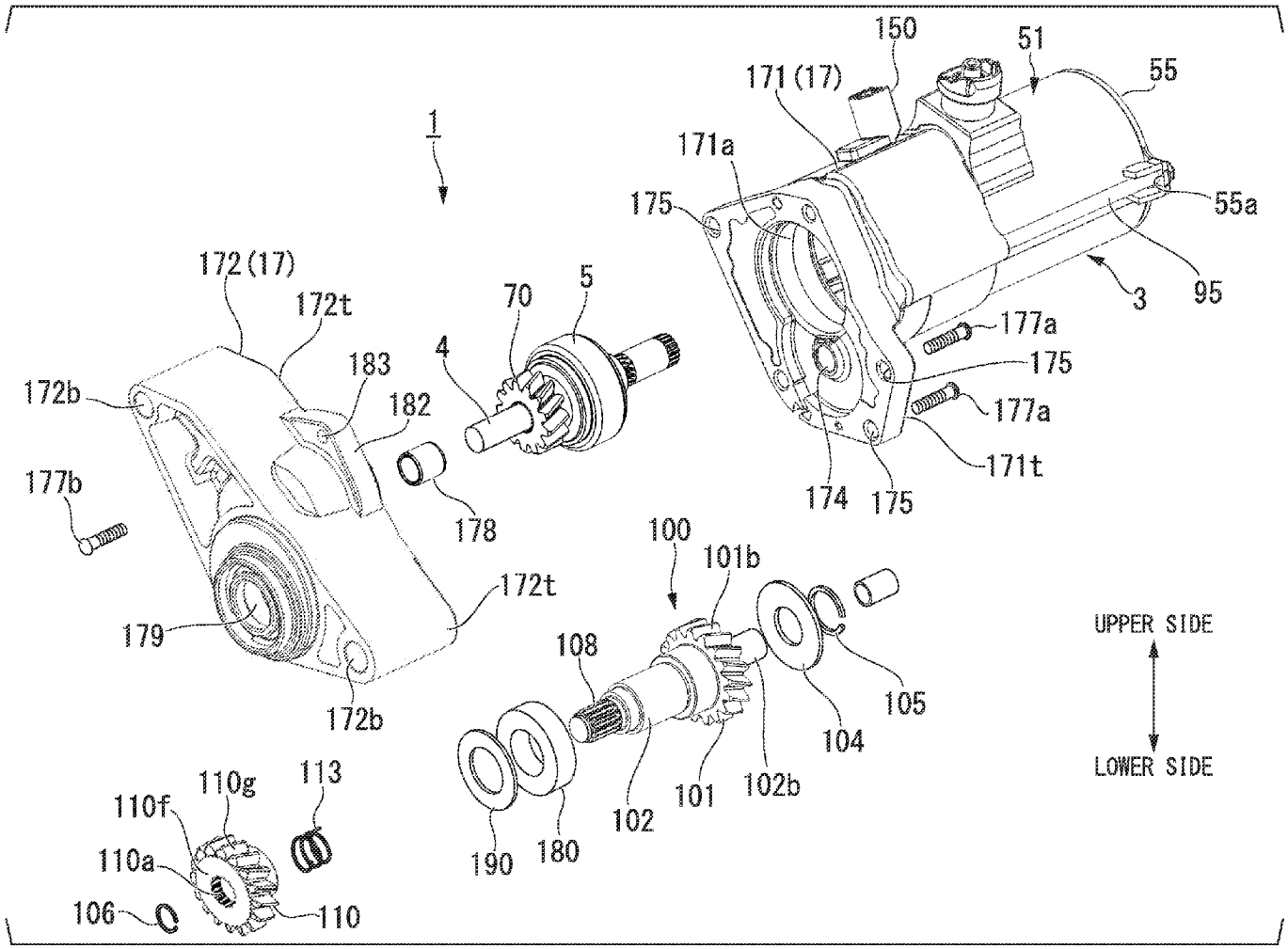
FIG. 2 is an exploded perspective view showing a schematic configuration of the starter according to the first embodiment and the second embodiment of the present invention.

FIG. 1 is a cross-sectional view of a starter, and FIG. 2 is an exploded perspective view showing a schematic configuration of the starter. In the embodiment, the left side of FIG. 1 is referred to as the first side, and the right side is referred to as a second side.

A starter 1 generates a rotational force needed to start an engine (not shown). As shown in FIGS. 1 and 2, the starter 1 has a motor unit 3, a drive shaft 4 connected to a first side (the left side of FIG. 1) of the motor unit 3, a clutch mechanism 5 slidably installed on the drive shaft 4, an idle gear unit 100 configured to transmit a rotational force of the drive shaft 4 to a ring gear 23 of the engine (not shown), a switch unit 7 configured to open and close a power supply path with respect to the motor unit 3, and an electromagnetic device 9 configured to move a movable contact plate 8 of the switch unit 7 in an axial direction thereof.

(Motor Unit)

The motor unit 3 is configured of a brushed direct current motor 51, and a planetary gear mechanism 2 connected to a rotary shaft 52 of the brushed direct current motor 51 and configured to function as a speed reduction mechanism used to transmit a rotational force of the rotary shaft 52 to the drive shaft 4.

The brushed direct current motor 51 has a motor yoke 53 having a substantially cylindrical shape, and an armature 54 disposed inside in a radial direction of the motor yoke 53 and rotatably installed with respect to the motor yoke 53. A plurality of (for example, in this embodiment, six) permanent magnets 57 are installed on an inner circumferential surface of the motor yoke 53 such that magnetic poles are alternately disposed in a circumferential direction.

An end plate 55 configured to close an opening section 53*a* of the motor yoke 53 is installed on an end section of a second side (the right side of FIG. 1) of the motor yoke 53. A slide bearing 56*a* and a thrust bearing 56*b* configured to rotatably support a second side end of the rotary shaft 52 are installed in a center in the radial direction of the end plate 55.

The armature 54 is configured of the rotary shaft 52, an armature core 58 fitted onto the rotary shaft 52 at a position corresponding to the permanent magnet 57, and a commutator 61 fitted onto the rotary shaft 52 at a side thereof (the left side of FIG. 1) closer to the planetary gear mechanism 2 than the armature core 58.

The armature core 58 includes a plurality of radially formed teeth (not shown), and a plurality of slots (not shown) formed between the neighboring teeth in the circumferential direction. A coil 59 is wound by, for example, wave winding, between the slots disposed at predetermined intervals in the circumferential direction.

A terminal section of the coil 59 is drawn toward the commutator 61.

A plurality of (for example, in this embodiment, 26) segments 62 are installed on the commutator 61 along the circumferential direction at predetermined intervals to be electrically insulated from each other.

Risers 63 that are bent to be folded back are formed at ends of the segments 62 near the armature core 58. A terminal section of the coil 59 wound on the armature core 58 is connected to the riser 63.

A top plate 12 having a bottomed cylindrical shape is installed on a side of the motor yoke 53 opposite to the end plate 55. The planetary gear mechanism 2 is installed on an inner surface of the top plate 12 near the armature core 58.

The planetary gear mechanism 2 is configured of a sun gear 13 integrally formed with the rotary shaft 52, a plurality of planetary gears 14 that are meshed with the sun gear 13 and revolving about the sun gear 13, and an annular internal tooth ring gear 15 installed on outer circumferential sides of the planetary gears 14.

The plurality of planetary gears 14 are connected by a carrier plate 16 serving as an output section. A plurality of support shafts 16*a* are vertically installed on the carrier plate 16 at positions corresponding to the planetary gears 14, and the planetary gears 14 are rotatably supported by the support shafts 16*a*. In addition, an engaging hole 16*b* having serration is formed in a center in the radial direction of the carrier plate 16, and a serration section 4*e* of a second side end section 4*d* of the drive shaft 4 is meshed with the engaging hole 16*b* through serration engagement.

An internal tooth ring gear 15 is integrally formed with an inner surface of the top plate 12 near the armature core 58. A slide bearing 12*a* is installed in a center in the radial direction of the inner circumferential surface of the top plate 12. The slide bearing 12*a* rotatably supports the second side end section 4*d* of the drive shaft 4 concentrically disposed on the rotary shaft 52.

(Housing)

In this way, the top plate 12 on which the planetary gear mechanism 2 is installed is received and fixed into a housing 17. The housing 17 has a function of fixing the starter 1 to the engine (not shown) and a function of receiving the top plate 12 (the planetary gear mechanism 2), the electromagnetic device 9, the clutch mechanism 5, the idle gear unit 100, and so on.

The housing 17 is divided into a bracket section 171 having opening sections 171*a* and 171*c* formed on the first side (the left side of FIG. 1) and the second side (the right side of FIG. 1), and a gear cover 172 mounted on the first side (the left side of FIG. 1) of the bracket section 171.

The bracket section 171 and the gear cover 172 are formed of aluminum through die casting. Then, the top plate 12 is installed so as to to close the opening section 171*c* of the second side of the bracket section 171.

In addition, a female screw section 171*b* is formed on an outer circumferential surface of the bracket section 171 near the opening section 171*c* of the second side along the axial direction. Further, a bolt hole 55*a* is formed in the end plate 55 disposed at the second side (the right end side of FIG. 1) of the motor yoke 53 at a position corresponding to the female screw section 171*b*. As a bolt 95 is inserted into the bolt hole 55*a* and the bolt 95 is screwed into the female screw section 171*b*, the motor unit 3 is integrated with the bracket section 171.

In addition, a ring-shaped stopper 94 configured to restrict displacement of an outer clutch 18 (to be described below) toward the motor unit 3 is formed on an inner wall of the bracket section 171. The stopper 94 is formed of a resin, rubber, or the like, so that a shock when the outer clutch 18 abuts the stopper 94 can be attenuated.

Further, a shrinkage diameter section (retainer section) 171*d* having a diameter reduced by a step difference is formed on an inner wall of the bracket section 171 closer to the first opening section 171*a* than the stopper 94. A step difference surface of the shrinkage diameter section (retainer section) 171*d* functions as a retainer section 171*d* configured to prevent the electromagnetic device 9 from slipping off from the first opening section 171*a* of the bracket section 171.

Figure 3:
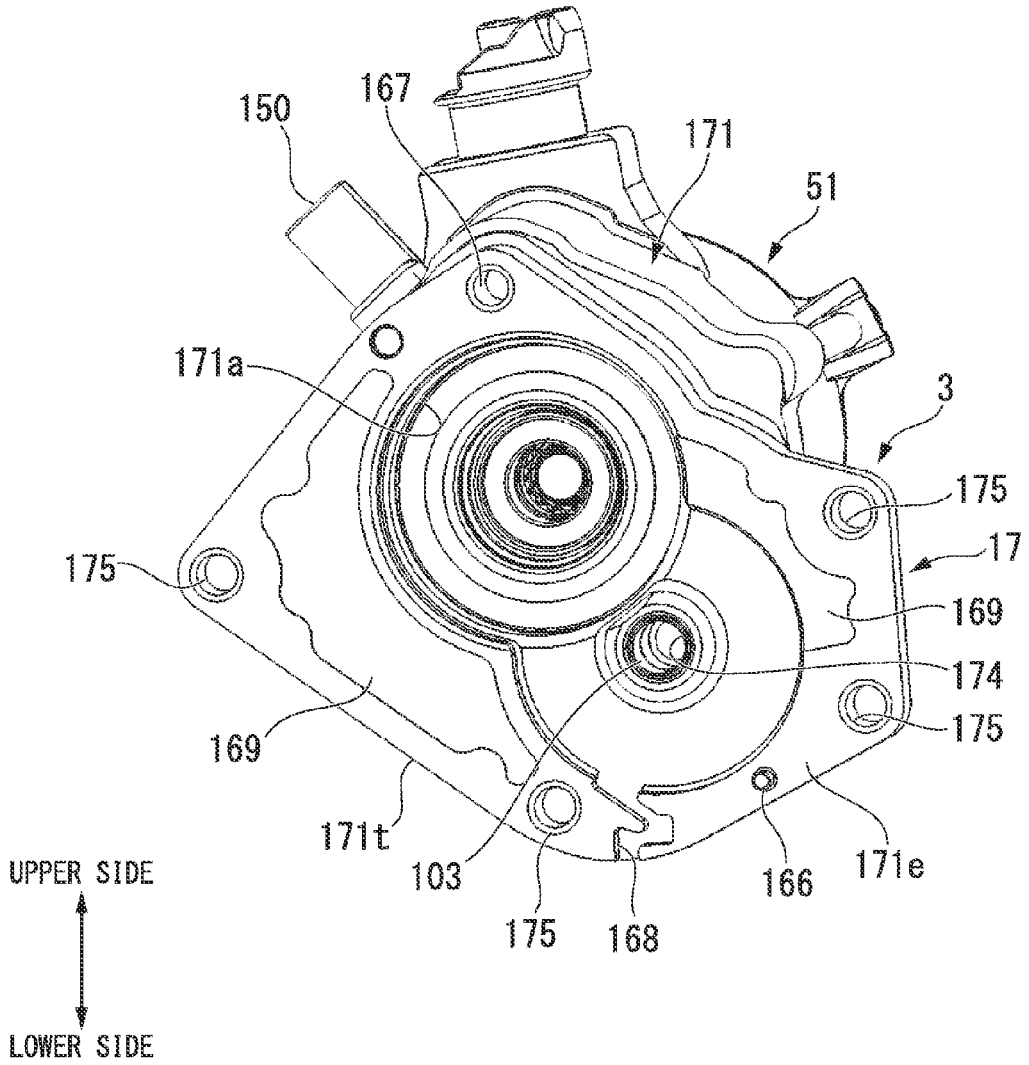
FIG. 3 is a perspective view of a bracket section according to the first embodiment and the second embodiment of the present invention when seen from a gear cover side.

FIG. 3 is a perspective view of the bracket section when seen from the gear cover side.

As shown in FIGS. 1 to 3, a shaft hole 174 is formed on a side (a front side of the drawing of FIG. 3) of the bracket section 171 near the first opening section 171*a* outside in the radial direction of the opening section 171*a*. The shaft hole 174 rotatably supports the vicinity of an end section 102*a* of a first side of an idle shaft 102 (to be described below) (an end section of the left side of FIG. 1).

In addition, an outer flange section 171*t* overhanging to the outer circumferential side is integrally formed with a side of the bracket section 171 near the first opening section 171*a*. A surface of the outer flange section 171*t* opposite to the gear cover 172 becomes an abutting surface (a mating surface) 171*e* with respect to the gear cover 172. A concave section 169 is formed on the abutting surface 171*e* except for the outer circumferential section. As the concave section 169 is formed, the bracket section 171 can be reduced in weight, the processing area of the abutting surface 171*e* can be reduced, and the manufacturing cost can be reduced.

When the starter 1 is attached to the engine (not shown), the upper side of FIG. 3 is an upper side in a vertical direction of the starter 1, and the lower side of FIG. 3 is a lower side in the vertical direction of the starter 1. Further, in the following description, the lower side in the vertical direction (the lower side of FIG. 3) in a state in which the starter 1 is attached to the engine (not shown) may be simply referred to as the lower side, and the upper side in the vertical direction (the upper side of FIG. 3) may be simply referred to as the upper side.

A draining-off groove 168 is formed in the abutting surface 171*e* of the outer flange section 171*t* on a side that becomes the lower side. The draining-off groove 168 discharges waterdrops generated due to intrusion into the housing 17 or condensation to the outside. The draining-off groove 168 has a labyrinth structure curved with respect to the vertical direction. Since the draining-off groove 168 has a labyrinth structure, waterdrops can be discharged to the outside of the housing 17, and water can be prevented from intruding into the housing 17 from the outside.

In addition, a plurality of bolt insertion holes 175 are formed in the outer circumferential section of the outer flange section 171*t* at intervals in the circumferential direction. Further, a female screw section 167 is formed on the upper side of the outer flange section 171*t* at a position corresponding to a bolt insertion hole 183 (to be described below) of the gear cover 172. The bolt insertion hole 175 and the female screw section 167 are disposed in the circumferential direction at substantially equal intervals.

Further, a pin insertion hole 166 through which a positioning pin 184 (to be described below) of the gear cover 172 can be inserted is formed in the lower side of the outer flange section 171*t* between the draining-off groove 168 and the bolt insertion hole 175. The bolt insertion hole 175 of the bracket section 171, the female screw section 167 and the pin insertion hole 166 are used to fix the bracket section 171 and the gear cover 172.

Figure 4:
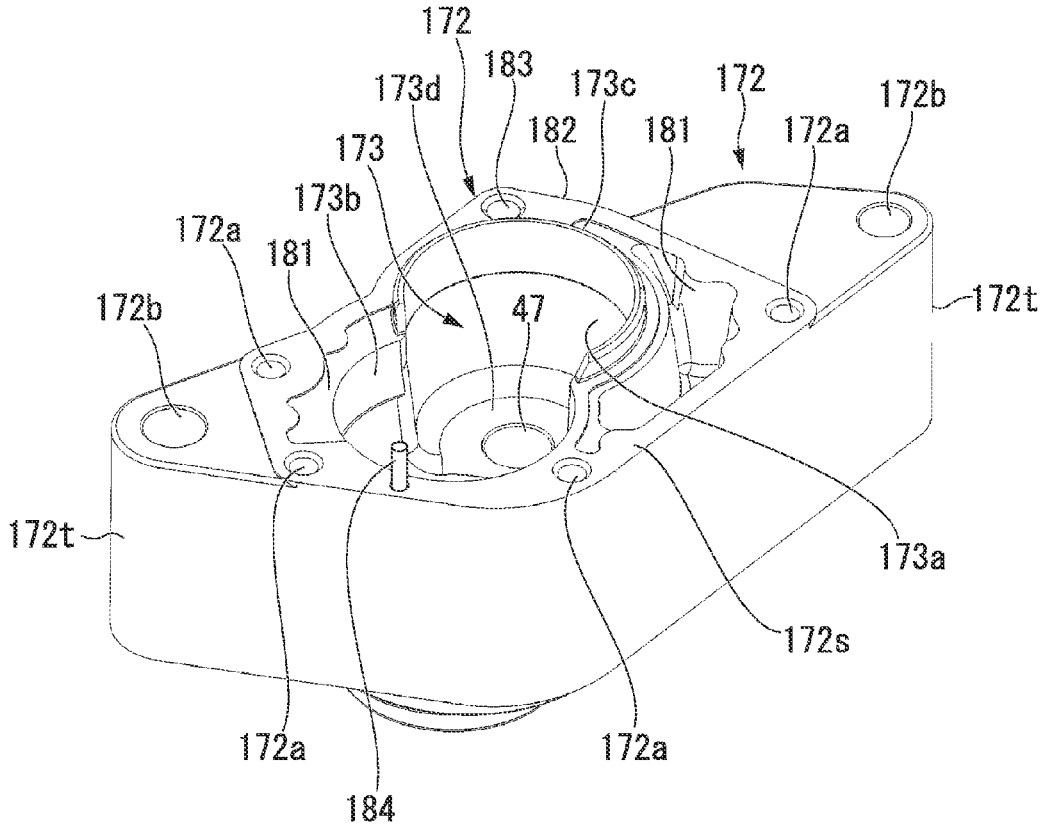
FIG. 4 is a perspective view of the gear cover according to the first embodiment and the second embodiment of the present invention when seen from the bracket section side.
Figure 5:
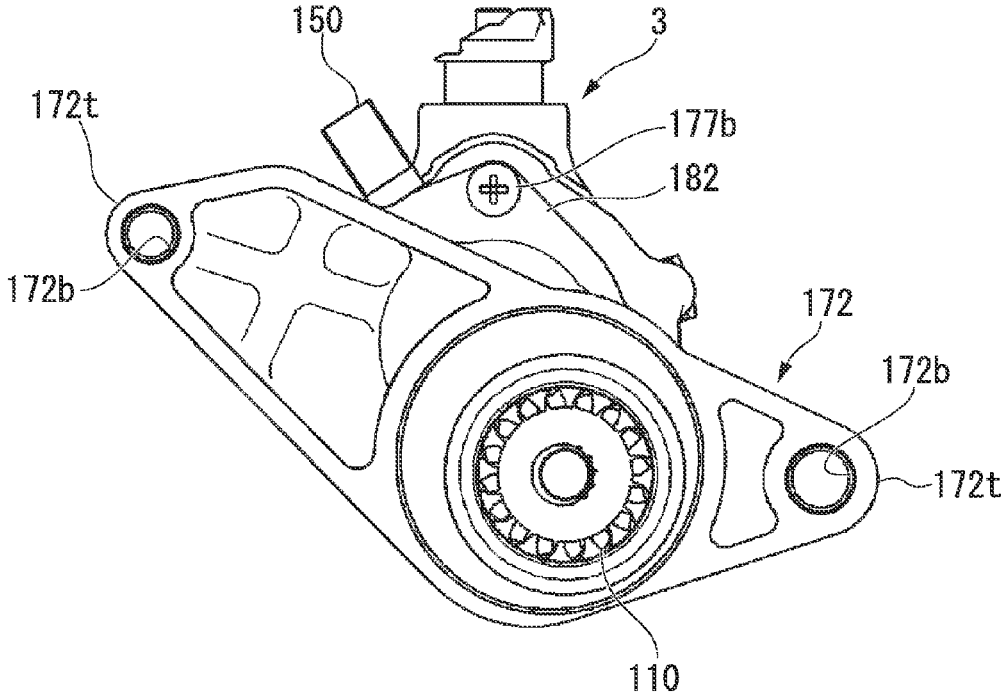
FIG. 5 is a plan view from the gear cover side in which the gear cover, the bracket section and a motor unit according to the first embodiment and second embodiment of the present invention are assembled.
Figure 6:
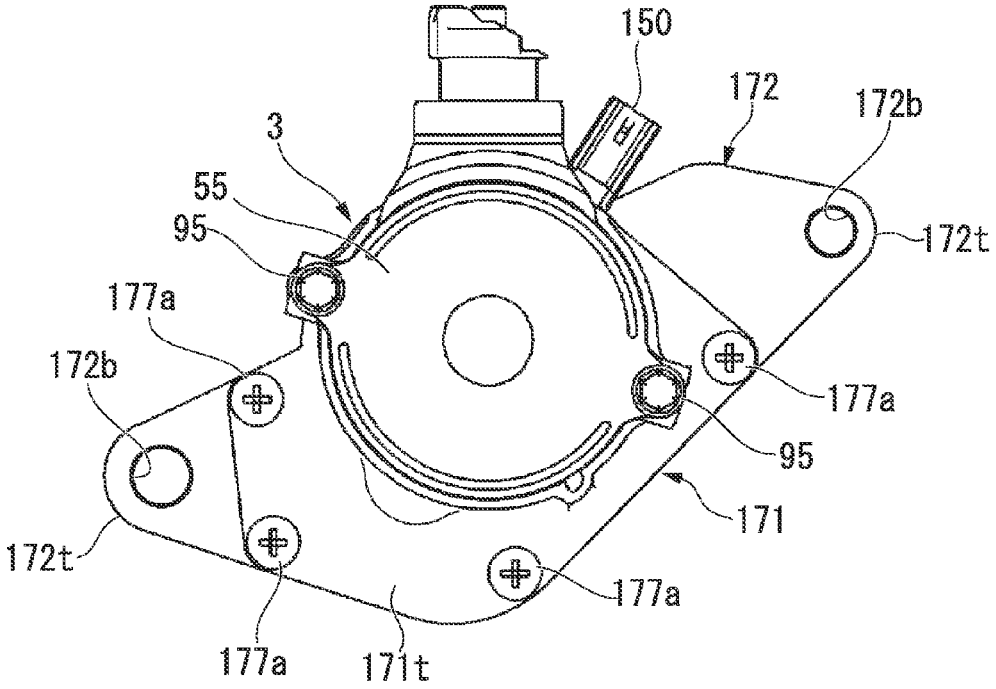
FIG. 6 is a plan view from the motor unit side in which the gear cover, the bracket section and the motor unit according to the first embodiment and second embodiment of the present invention are assembled.

FIG. 4 is a perspective view of the gear cover when seen from the bracket section side, FIG. 5 is a plan view from the gear cover side in which the gear cover, the bracket section and the motor unit are assembled, and FIG. 6 is a plan view from the motor unit side in which the gear cover, the bracket section and the motor unit are assembled.

As shown in FIGS. 1, 2, and 4 to 6, the gear cover 172 has an abutting surface (a mating surface) 172*s* formed on a position opposite to the bracket section 171 and abutting the outer flange section 171*t* of the bracket section 171. A concave section 181 is formed on the abutting surface 172*s* at a position except for the outer circumferential section, in other words, at a position corresponding to the concave section 169 of the bracket section 171. As the concave section 181 is formed, the gear cover 172 can be reduced in weight, a processing area of the abutting surface 172*s* can be reduced, and the manufacturing cost can be reduced.

In addition, a female screw section 172*a* is formed on the outer circumferential section of the abutting surface 172*s* at a position corresponding to the bolt insertion hole 175 of the bracket section 171. Further, a flange section 182 overhanging to the outer circumferential side is integrally formed on the outer circumferential section of the abutting surface 172*s* at a position corresponding to the female screw section 167 of the bracket section 171, and the bolt insertion hole 183 is formed in the flange section 182. In addition, the positioning pin 184 is press-fitted and fixed into the outer circumferential section of the abutting surface 172*s* at a position corresponding to the pin insertion hole 166 of the bracket section 171.

In the above-described configuration, when the bracket section 171 and the gear cover 172 are assembled, the positioning pin 184 of the gear cover 172 is inserted into the pin insertion hole 166 of the bracket section 171 to overlap the abutting surface 171*e* of the bracket section 171 and the abutting surface 172*s* of the gear cover 172.

Then, as shown in FIGS. 2, 5 and 6, four bolts 177*a* are inserted into the bolt insertion hole 175 of the bracket section 171 from the motor unit 3 side, and the bolts 177*a* are screwed into the female screw section 172*a* of the gear cover 172. In addition, a bolt 177*b* is inserted into the bolt insertion hole 183 of the gear cover 172 from an opposite side of the motor unit 3, and the bolt 177*b* is screwed into the female screw section 167 of the bracket section 171. In this way, the bolts 177*a* and 177*b* are fastened from both sides while sandwiching the abutting surface 171*e* of the bracket section 171 and the abutting surface 172*s* of the gear cover 172, integrating the bracket section 171 and the gear cover 172.

Here, the bolt insertion hole 175, the female screw section 167, the female screw section 172*a* and the bolt insertion hole 183 configured to fasten and fix the bracket section 171 and the gear cover 172 are disposed in the circumferential direction at substantially equal intervals. For this reason, a fastening and fixing force is applied to the bracket section 171 and the gear cover 172 in the circumferential direction in a well-balanced manner to fix the bracket section 171 and the gear cover 172.

In addition, as the bolts 177*a* and 177*b* are fastened from both sides while sandwiching the abutting surface 171*e* of the bracket section 171 and the abutting surface 172*s* of the gear cover 172, the starter 1 cannot be easily disassembled when the starter 1 is attached to the engine (not shown).

Figure 7:
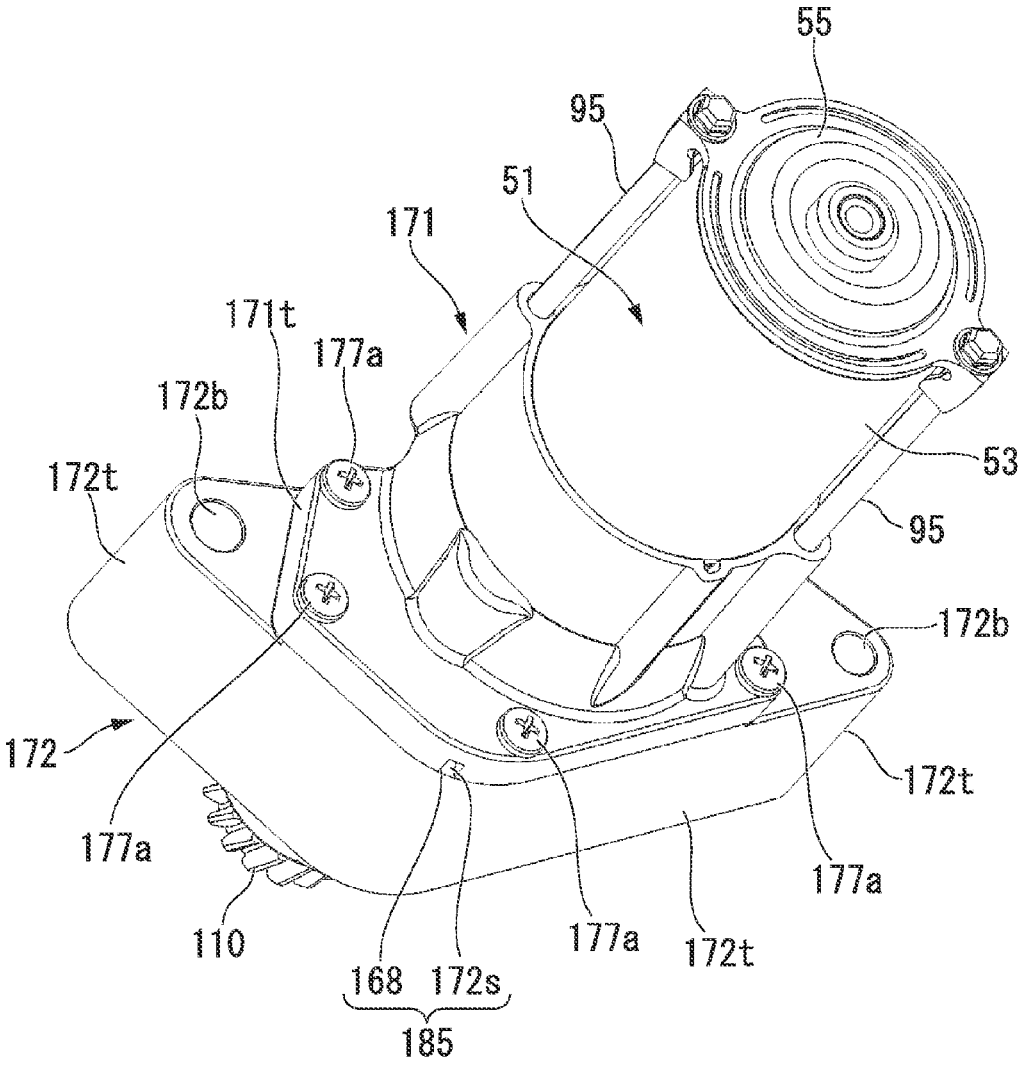
FIG. 7 is a perspective view from a diagonal lower side in which the gear cover, the bracket section and the motor unit according to the first embodiment and second embodiment of the present invention are assembled.

FIG. 7 is a perspective view from a diagonal lower side in which the gear cover, the bracket section and the motor unit are assembled.

As shown in FIG. 7, since the draining-off groove 168 is formed in the lower side of the abutting surface 171*e* of the outer flange section 171*t* of the bracket section 171, when the bracket section 171 and the gear cover 172 are integrated, a draining-off section (a draining-off hole) 185 is formed by the draining-off groove 168 and the abutting surface 172*s* of the gear cover 172.

In this way, since the draining-off section 185 is formed between the outer flange section 171*t* of the bracket section 171 and the gear cover 172, waterdrops generated due to intrusion or condensation in the bracket section 171 or the gear cover 172 can be rapidly discharged.

In addition, by forming the draining-off groove 168 in the bracket section 171, even when specifications of the gear cover 172 are changed as a shape of the gear cover 172 is varied or a position of a bolt insertion hole 172*b* to be fixed to a frame (to be described below) is varied, the draining-off section 185 can be easily configured by using the bracket section 171 as a common part.

In addition, as shown in FIGS. 1, 2 and 4, the gear cover 172 has an accommodating concave section 173 opened toward a side thereof opposite to the bracket section 171 and configured to accommodate the clutch mechanism 5, a transmission pinion gear (a transmission gear) 70, and an idle gear 101 (to be described below).

The accommodating concave section 173 is configured of a pinion gear accommodating concave section 173*a* in which the transmission pinion gear 70 is accommodated, and an idle gear accommodating concave section 173*b* in which the idle gear 101 is accommodated, and is configured to bring the accommodating concave sections 173*a* and 173*b* in communication with each other.

In addition, a spigot joint section 173*c* fitted into the first opening section 171*a* of the bracket section 171 by a spigot joint when the gear cover 172 overlaps the bracket section 171 is formed to protrude from an opening section circumferential edge of the pinion gear accommodating concave section 173*a* of the accommodating concave section 173.

The spigot joint section 173*c* is formed in substantially a C shape corresponding to a shape of the opening section circumferential edge of the pinion gear accommodating concave section 173*a* such that the idle gear accommodating concave section 173*b* side is opened in a plan view when seen in the axial direction.

In addition, a bottomed bearing concave section 47 is formed in a bottom section 173*d* of the accommodating concave section 173 to be concentric with the drive shaft 4. Further, a shaft through-hole 179 through which the idle shaft 102 (to be described below) passes is formed in the bottom section 173*d* of the accommodating concave section 173 at a side of the bearing concave section 47.

The bearing concave section 47 is formed to have an inner diameter larger than an outer diameter of the drive shaft 4. A slide bearing 178 configured to rotatably support a first side end (a left side end of FIG. 1) of the drive shaft 4 is press-fitted and fixed into the bearing concave section 47. A lubricant formed of desired base oil is impregnated in the slide bearing 178, and thus the drive shaft 4 can smoothly come in sliding contact therewith.

In addition, a load receiving member 50 is disposed between a bottom section of the bearing concave section 47 and a first side end surface 4*c* of the drive shaft 4.

The load receiving member 50 is a plate-shaped metal member, and for example, a ring-shaped washer formed by pressing is employed. The load receiving member 50 is formed of a material having hardness greater than that of the drive shaft 4 and good wear and abrasion resistance. Carbon tool steel such as SK85 or the like may be appropriately used as a material of the load receiving member 50.

As the load receiving member 50 is disposed, even when a thrust load applied to the drive shaft 4 toward the first side (the left side of FIG. 1) is generated, the thrust load to the drive shaft 4 can be received while restricting movement of the drive shaft 4 by the load receiving member 50 installed on the gear cover 172. In addition, upon rotation of the drive shaft 4, since the first side end surface 4*c* of the drive shaft 4 comes in sliding contact with the load receiving member 50, direct sliding contact between the first side end surface 4*c* of the drive shaft 4 and the gear cover 172 can be prevented. Accordingly, abrasion of the gear cover 172 can be prevented to provide the starter 1 with good durability.

Further, while grease used to reduce friction upon sliding contact with the first side end surface 4*c* of the drive shaft 4 is applied to a periphery of the load receiving member 50, since grease containing the same base oil as the lubricant impregnated in the slide bearing 178 is employed as the grease, the lubricant of the slide bearing 178 can be held for a long time.

A concave section 4*a* into which the first side end (the left side end of FIG. 1) of the rotary shaft 52 can be inserted and fitted is formed in the second side end section 4*d* of the drive shaft 4. A slide bearing 4*b* is press-fitted into an inner circumferential surface of the concave section 4*a*, and the drive shaft 4 and the rotary shaft 52 are relatively rotatably connected to each other.

In addition, an oil seal 190 and a ball bearing 180 are installed in the shaft through-hole 179 of the gear cover 172 in sequence from a first side end surface 172*r* opposite to the abutting surface 172*s*. The oil seal 190 prevents dust or water from intruding into the gear cover 172 from the outside via the shaft through-hole 179. The ball bearing 180 rotatably supports the idle shaft 102 (to be described below).

Further, an inner cylindrical section 186 and an outer cylindrical section 187 concentrically protruding to surround the shaft through-hole 179 are formed on the first side end surface 172*r* of the gear cover 172. The inner cylindrical section 186 and the outer cylindrical section 187 also prevent dust or water from intruding into the gear cover 172 from the outside via the shaft through-hole 179.

In addition, a pair of attachment bracket sections 172*t* overhanging to the outer circumferential side with respect to the abutting surface 172*s* are integrally formed with both sides of the gear cover 172 while sandwiching the accommodating concave section 173. The attachment bracket section 172*t* is formed to be tapered to be spaced apart from the accommodating concave section 173, and the bolt insertion hole 172*b* is formed in a peak section thereof. As a bolt (not shown) is inserted into the bolt insertion hole 172*b*, the gear cover 172 can be fixed to a frame (not shown) (the engine, a vehicle body chassis, or the like).

(Clutch Mechanism)

As shown in FIG. 1, a helical spline 19 is formed in substantially a center in the axial direction of the drive shaft 4. The clutch mechanism 5 is helically meshed with the helical spline 19.

The clutch mechanism 5 has the outer clutch 18 having a substantially cylindrical shape, an inner clutch 22 concentrically formed with the outer clutch 18, and a clutch cover 6 configured to integrally fix the outer clutch 18 and the inner clutch 22.

A so-called known one-way clutch function configured to transmit a rotational force from the outer clutch 18 side to the inner clutch 22 but not transmit a rotational force from the inner clutch 22 side to the outer clutch 18 is installed on the clutch mechanism 5. Accordingly, the one-way clutch is configured to block the rotational force from the ring gear 23 side of the engine when it becomes overrun by the rotational speed of the inner clutch 22 becoming higher than that of the outer clutch 18 upon start the engine. In addition, when a torque difference and a rotational speed difference generated between the outer clutch 18 and the inner clutch 22 are a predetermined value or less, the clutch mechanism 5 transmits the rotational force between them. Meanwhile, when the torque difference and the rotational speed difference are larger than the predetermined value, transmission of the rotational force is blocked. That is, the clutch mechanism 5 also includes a so-called torque limiter function.

A sleeve 18*a* having a reduced diameter is formed integrally with the second side (the right side of FIG. 1) of the outer clutch 18. A helical spline 18*b* meshed with the helical spline 19 of the drive shaft 4 is formed on the inner circumferential surface of the sleeve 18*a*. Accordingly, the clutch mechanism 5 is slidably installed with respect to the drive shaft 4 in the axial direction.

A step section 18*c* is formed on the first side of the sleeve 18*a* in the inner circumferential surface of the outer clutch 18. The inner circumferential surface of the step section 18*c* is formed to have a diameter larger than that of the inner circumferential surface of the sleeve 18*a*.

The clutch cover 6 (to be described below) is fixed to the outer circumferential surface of the outer clutch 18 by, for example, caulking or the like.

The inner clutch 22 is formed to have a diameter larger than that of the sleeve 18*a* of the outer clutch 18, and a space is formed between the inner circumferential surfaces of the inner clutch 22 and the step section 18*c*, and the drive shaft 4. A return spring 21 (to be described below) is disposed in the space.

A clutch washer 64 having a substantially disk shape is fixedly fitted onto the outer circumferential surface of the inner clutch 22 at a position corresponding to the first side end surface of the outer clutch 18 in the radial direction.

The clutch cover 6 is a bottomed cylindrical member having a cylindrical main body section 68 and a bottom wall 66 of the first side (the left side of FIG. 1) of the cylindrical main body section 68, and is formed of, for example, a metal plate member such as an iron plate member or the like through drawing.

The cylindrical main body section 68 is fitted onto the outer clutch 18 and the clutch washer 64 and fixed to the outer clutch 18 and the clutch washer 64 by caulking the edge section of the second side of the cylindrical main body section 68 into the second side end surface of the outer clutch 18.

An opening passing through the first side and the second side is formed in substantially a center of the bottom wall 66, and a cylindrical reinforcement section 67 extending from the opening toward the first side in the axial direction is formed in substantially the center. The cylindrical reinforcement section 67 is concentrically formed on the drive shaft 4, and the drive shaft 4 is inserted therethrough.

A movement restriction section 20 is formed on the drive shaft 4 at a position closer to the first side (the left side of FIG. 1) than the helical spline 19.

The movement restriction section 20 is a substantially ring-shaped member fitted onto the drive shaft 4, and installed such that movement toward the first side in the axial direction is restricted by a circlip 20*a*. In addition, the movement restriction section 20 is formed to have a diameter larger than that of the inner circumferential surface of the step section 18*c* to interfere with the step section 18*c* formed on the outer clutch 18. As will be described below, when the clutch mechanism 5 slides to the first side, the step section 18*c* of the outer clutch 18 interferes with the movement restriction section 20. Accordingly, the sliding movement of the clutch mechanism 5 toward the first side is restricted.

The return spring 21 is installed between the movement restriction section 20 and the sleeve 18*a* of the outer clutch 18 and between the inner circumferential surface of the step section 18*c* and the outer circumferential surface of the drive shaft 4. The return spring 21 is formed to surround the drive shaft 4, and installed in a compressively deformed state. Accordingly, the outer clutch 18 is constantly biased to be pushed back toward the motor unit 3.

The transmission pinion gear 70 is integrally installed on the clutch mechanism 5 formed in this way at a distal end of the inner clutch 22.

The transmission pinion gear 70 is configured of a cylindrical section 70*a* slidably fitted onto the drive shaft 4, and an external tooth section 70*b* integrally formed with the outer circumferential surface and meshed with the idle gear 101 (to be described below). Then, the cylindrical section 70*a* is integrally formed with the inner clutch 22.

In addition, an outer flange section 73 is integrally formed with a base end side of the cylindrical section 70*a*, i.e., the clutch mechanism 5 side, and spaced an interval from the external tooth section 70*b* of the transmission pinion gear 70 in the axial direction. Two slide bearings 72 and 72 configured to slidably support the transmission pinion gear 70 at the drive shaft 4 are installed on both sides in the axial direction of the inner circumferential surface of the cylindrical section 70*a*.

(Idle Gear Unit)

Figure 8:
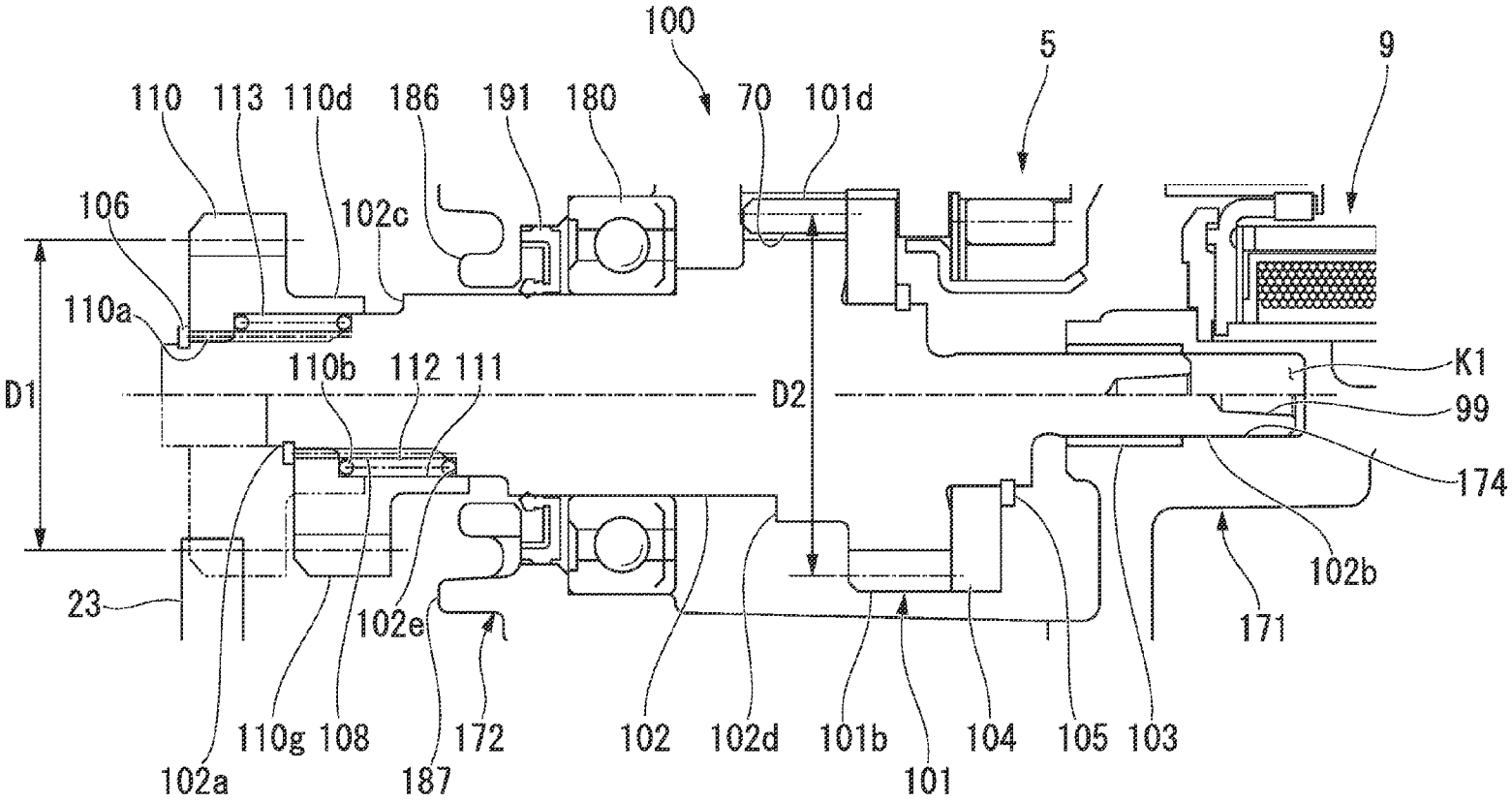
FIG. 8 is an enlarged cross-sectional view of an idle gear unit according to the first embodiment and the second embodiment of the present invention.

FIG. 8 is an enlarged cross-sectional view of the idle gear unit. In FIGS. 1 and 8, a state in which the starter 1 is stopped (a state in which the idle shaft 102 is withdrawn) is shown at the lower side of the dotted line along the central axis of the idle shaft 102, and a state in which the starter 1 is supplied with electricity (a state in which the idle shaft 102 moves forward and a driving pinion gear (a driving gear) 110 and the ring gear 23 of the engine (not shown) are meshed) is shown at the upper side of the dotted line along the central axis of the idle shaft 102.

As shown in FIGS. 1 and 8, the idle gear unit 100 includes the idle shaft 102 disposed in parallel with the drive shaft 4, the idle gear 101 integrally formed with an intermediate section in the axial direction of the idle shaft 102 and meshed with the transmission pinion gear 70, and the driving pinion gear 110 installed on the first end section 102*a* of the idle shaft 102 and configured to mesh with the ring gear 23.

The idle gear 101 is formed to have a diameter increased from the idle shaft 102 to the outer circumferential side, and an external tooth section 101*b* is formed on the outer circumferential surface thereof.

Here, a speed reduction ratio between the external tooth section 101*b* of the idle gear 101 and the external tooth section 70*b* of the transmission pinion gear 70 is set such that the rotational speed of the idle gear 101 is reduced with respect to a rotational speed of the transmission pinion gear 70. Accordingly, a rotational torque of the idle shaft 102 can be increased to be larger than that of the drive shaft 4. In this way, as the gear ratio between the transmission pinion gear 70 and the idle gear 101 is adjusted, the starter may be a torque-oriented or rotation-oriented starter.

In addition, the idle gear 101 and the transmission pinion gear 70 are configured of helical gears. A skew direction of the teeth of the idle gear 101 is set to the same direction as that of the teeth of the driving pinion gear 110 (to be described below). Meanwhile, a skew direction of the teeth of the transmission pinion gear 70 is set to the same direction as that of the teeth of the ring gear 23.

The first end section 102*a* of the idle shaft 102 (the end section 102*a* of the left side of FIGS. 1 and 8) passes through the shaft through-hole 179 of the gear cover 172 to protrude to the outside of the gear cover 172. That is, a nearer side of the idle shaft 102 than the first end section 102*a* is rotatably supported by the ball bearing 180 installed on the gear cover 172.

In addition, a second end section 102*b* of the idle shaft 102 is rotatably and slidably supported by the shaft hole 174 formed on the bracket section 171 in the axial direction (the thrust direction) via a slide bearing 103.

Here, grease as a lubricant used to increase slidability of the idle shaft 102 with respect to the slide bearing 103 is filled in an aperture section K1 formed between the second end section 102*b* of the idle shaft 102 and the shaft hole 174 of the bracket section 171. Meanwhile, a grease gathering section 99 is recessed on the second end section 102*b* of the idle shaft 102.

The grease gathering section 99 is configured such that the grease is not discharged from the aperture section K1 by a pumping action when the second end section 102*b* of the idle shaft 102 is inserted into the slide bearing 103 of the bracket section 171. That is, when a capacity of the aperture section K1 is varied (when a capacity of the aperture section K1 is reduced) as the idle shaft 102 slides, the grease of the aperture section K1 is received in the grease gathering section 99. Accordingly, the grease can be prevented from scattering to the outside of the bracket section 171.

In addition, the grease gathering section 99 is formed in a tapered shape such that an opening area is gradually increased toward an end section 102*b*. For this reason, for example, when the capacity of the aperture section K1 is varied and increased, the grease remaining in the grease gathering section 99 is likely to be discharged to the aperture section K1. Accordingly, slidability between the slide bearing 103 and the idle shaft 102 is sufficiently secured by circulating the grease between the aperture section K1 and the grease gathering section 99.

In addition, a disk-shaped idle washer 104 is fitted onto the outer circumferential section of the idle shaft 102 near the clutch mechanism 5 with respect to the idle gear 101. Movement of the idle washer 104 toward the clutch mechanism 5 in a withdrawal direction is restricted by a retaining ring 105 attached to the idle shaft 102. In addition, an outer diameter of the idle washer 104 is set to be substantially the same as the outer diameter of the external tooth section 101*b*. Further, an outer circumferential section of the idle washer 104 is inserted into an annular gap between the external tooth section 70*b* of the transmission pinion gear 70 and the outer flange section 73.

Accordingly, the idle shaft 102 having the idle gear 101 is movable with the transmission pinion gear 70 in the axial direction via the idle washer 104.

Further, the idle washer 104 has a function of improving slidability between the transmission pinion gear 70 and the idle gear 101. For this reason, grease or the like is also applied to the idle washer 104 as a lubricant.

In addition, in the idle shaft 102, a step difference section 102*d* is formed by increasing an outer diameter thereof at a position closer to the idle gear 101 than a portion thereof inserted into the ball bearing 180. As the step difference section 102*d* collides with the ball bearing 180, a movement of the idle shaft 102 toward the driving pinion gear 110 is restricted.

Further, a spline 108 is formed on an outer circumferential surface of the first end section 102*a* of the idle shaft 102. A spline 110*a* configured to be spline-fitted to the spline 108 is formed on a distal end side of an inner circumferential surface of the driving pinion gear 110 installed on the first end section 102*a* of the idle shaft 102. The length of the spline 108 near the idle shaft 102 is set to be longer than that of the spline 110*a* of the driving pinion gear 110 in the axial direction. Accordingly, the idle shaft 102 and the driving pinion gear 110 are positioned such that they cannot be relatively rotated and can slide in the axial direction.

In addition, a step difference section 102*c* having a diameter larger than that of the spline 108 is formed on the idle shaft 102 closer to the second side (the right side of FIGS. 1 and 8) than the spline 108.

Meanwhile, an extended cylindrical section 110*d* is extended and installed on an end surface of the second side (the right side of FIGS. 1 and 8) of the driving pinion gear 110.

The extended cylindrical section 110*d* is formed concentrically with the idle shaft 102. The extended cylindrical section 110*d* is configured to abut the step difference section 102*c* when the driving pinion gear 110 slides to the second side (the right side of FIGS. 1 and 8) in the axial direction. That is, when the driving pinion gear 110 slides with respect to the idle shaft 102 in the axial direction, as the extended cylindrical section 110*d* collides with the step difference section 102*c*, movement of the driving pinion gear 110 toward the second side is restricted.

In addition, a retaining ring 106 fitted and fixed onto the idle shaft 102 is installed on the first end section 102*a* of the idle shaft 102. Accordingly, the driving pinion gear 110 is restricted from falling out of the idle shaft 102 at the first side of the idle shaft 102.

Here, a pitch diameter D1 of an external tooth section 110*g* of the driving pinion gear 110 may be set with respect to a pitch diameter D2 of the external tooth section 101*b* of the idle gear 101 to satisfy the following relation:

$$D1 \leq D2.$$

Further, the pitch diameters may also be set to satisfy the following relation:

$$D1 < D2.$$

When the pitch diameter D2 of the external tooth section 101*b* of the idle gear is larger than the 101 pitch diameter D1 of the external tooth section 110*g*, a torque obtained by the external tooth section 101*b* is larger than a torque output from the driving pinion gear 110. That is, torque transmission from the idle gear 101 side, i.e., the drive shaft 4 side, toward the driving pinion gear 110 can be efficiently performed.

The ring gear 23 and the driving pinion gear 110 are configured of helical gears, and a skew direction of teeth of the ring gear 23 and the driving pinion gear 110 is set such that a thrust load with respect to the ring gear 23 in the plunge direction is generated at the driving pinion gear 110 when the driving pinion gear 110 drives the ring gear 23.

In addition, upon cranking during the start of the engine, the rotational speed of the ring gear 23 is likely to be varied.

Here, when the rotational speed difference is generated between the driving pinion gear 110 and the ring gear 23, which are helically meshed, the direction of the thrust load applied to the driving pinion gear 110 varies.

When the rotational speed of the ring gear 23 is lower than that of the driving pinion gear 110, a thrust load is generated at the driving pinion gear 110 in a direction approaching the ring gear 23. In addition, when the rotational speed of the ring gear 23 is higher than that of the driving pinion gear 110, a thrust load is generated at the driving pinion gear 110 in a direction away from the ring gear 23 (toward the right side of FIG. 1).

However, in this case, since the rotational speed of the idle gear 101 is higher than that of the transmission pinion gear 70, the thrust load is applied to the idle gear 101 from the transmission pinion gear 70 in a direction opposite to the thrust load applied to the driving pinion gear 110 from the ring gear 23. For this reason, the thrust load applied to the driving pinion gear 110 in the direction away from the ring gear 23 is offset.

That is, while the skew direction of the teeth of the idle gear 101 is set to the same direction as that of the teeth of the driving pinion gear 110, the skew direction of the teeth of the transmission pinion gear 70 is set to the same direction as that of the teeth of the ring gear 23. For this reason, the direction of the thrust load generated at the driving pinion gear 110 is opposite to the direction of the thrust load generated at the idle gear 101, and both of the thrust loads are offset.

Here, the thrust load in the separation direction of the driving pinion gear 110 may be set to be larger than the thrust load applied in the direction opposite to the idle gear 101. Further, the thrust load in the separation direction of the driving pinion gear 110 may be smaller than the attractive force by the electromagnetic device 9.

An expansion diameter section 111 having a diameter increased via a step difference section 110*b* is formed on a rear end side of the spline 110*a* of the inner circumferential surface of the driving pinion gear 110, and a receiving section 112 is formed between the idle shaft 102 and the driving pinion gear 110.

An opening section of the receiving section 112 formed near the idle gear 101 is closed by a step difference section 102*e* formed by increasing the diameter at an end section of the spline 108 of the idle shaft 102 near the idle gear 101.

A pinion spring 113 formed to surround the outer circumferential surface of the idle shaft 102 is received in the receiving section 112. The pinion spring 113 is configured of, for example, a coil spring.

The pinion spring 113, while received in the receiving section 112, is compressed and deformed by the step difference section 110*b* of the expansion diameter section 111 of the driving pinion gear 110 and the step difference section 102*e* of the idle shaft 102. Accordingly, the driving pinion gear 110 is biased toward the ring gear 23 with respect to the idle shaft 102.

In addition, as will be described below, the pinion spring 113 functions as a so-called damper mechanism configured to be elastically deformed in the axial direction and absorb a shock when the driving pinion gear 110 abuts the ring gear 23. Accordingly, abrasion of the driving pinion gear 110 and the ring gear 23 can be suppressed to improve the durability of the starter 1.

(Electromagnetic Device)

As shown in FIG. 1, a yoke 25 that configures the electromagnetic device 9 is fitted and fixed into the inner circumferential surface of the housing 17 (the bracket section 171) at a position closer to the motor unit 3 than the clutch mechanism 5. The yoke 25 is formed of a magnetic material in a bottomed cylindrical shape, and most of a center in the radial direction of a bottom section 25*a* thereof is largely opened.

In addition, an annular plunger holder 26 formed of a magnetic material is installed on an end of the yoke 25 opposite to the bottom section 25*a*. The plunger holder 26 has an annular holder main body 26*a*, and a plunger-holder-side cylindrical section 26*b* integrally formed with the holder main body 26*a* and bending and extending from the inside in the radial direction of the holder main body 26*a* toward the second side in the axial direction. Accordingly, since the distance separating a gear plunger 80 and an iron core 88 is reduced, the attractive force of the iron core 88 by the plunger holder 26 (hereinafter, simply referred to as an "attractive force") can be increased.

A substantially cylindrical exciting coil 24 is received in a receiving concave section 25*b* formed inside in the radial direction by the yoke 25 and the plunger holder 26. That is, the holder main body 26*a* of the plunger holder 26 is formed to cover a first side surface of the exciting coil 24, and the plunger-holder-side cylindrical section 26*b* is bent and extends to face the inside in the radial direction of the exciting coil 24.

The exciting coil 24 is electrically connected to an ignition switch (not shown) via a connector 150 installed on the outer circumferential surface of the bracket section 171.

A plunger mechanism 37 is installed in an aperture between the inner circumferential surface of the exciting coil 24 and the outer circumferential surface of the drive shaft 4 so as to be slidable with respect to the exciting coil 24 in the axial direction.

The plunger mechanism 37 has a substantially cylindrical switch plunger 27 formed of a magnetic material, and the gear plunger 80 disposed in the aperture between the switch plunger 27 and the outer circumferential surface of the drive shaft 4.

Figure 9:
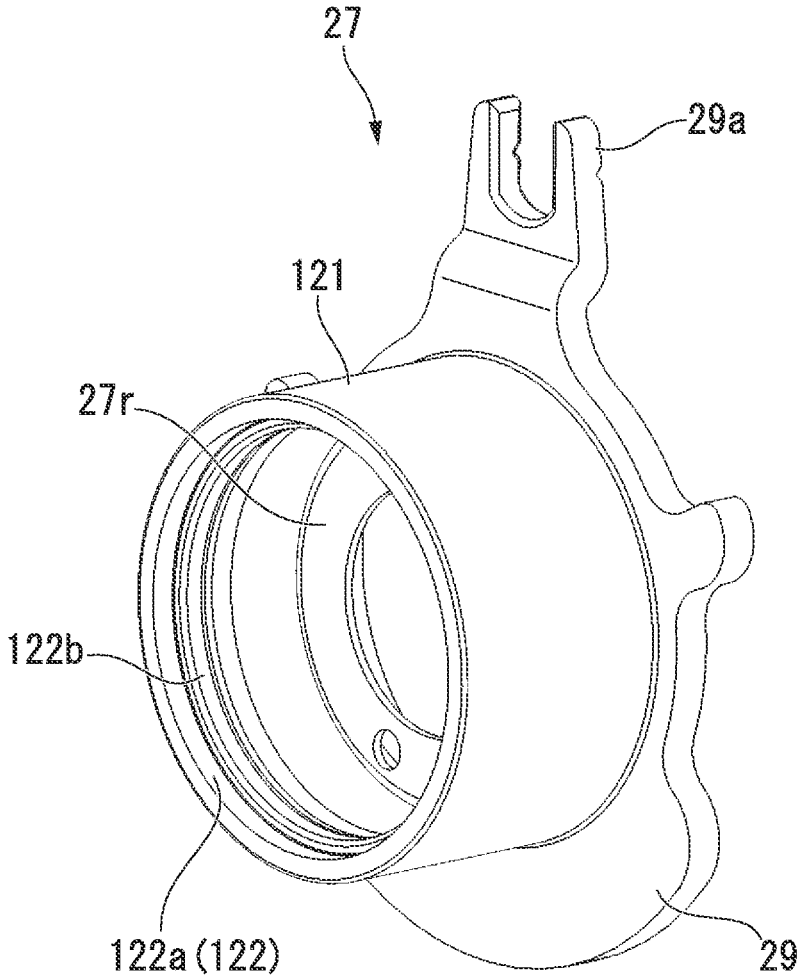
FIG. 9 is a perspective view of a switch plunger according to the first embodiment and the second embodiment of the present invention.
Figure 10:
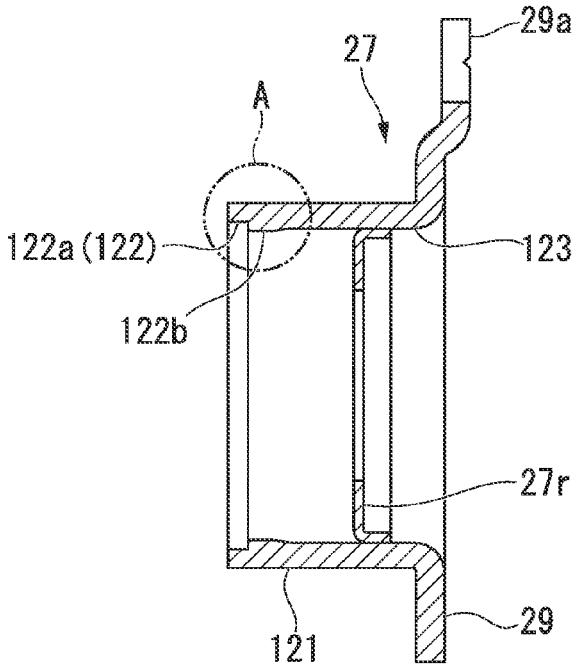
FIG. 10 is a cross-sectional view of the switch plunger according to the first embodiment and the second embodiment of the present invention.
Figure 11:
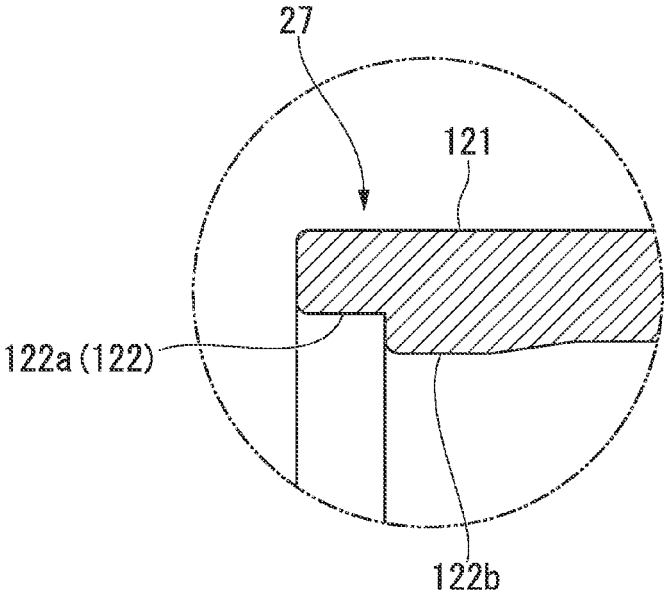
FIG. 11 is an enlarged view of a portion A of FIG. 10.

FIG. 9 is a perspective view of the switch plunger, FIG. 10 is a cross-sectional view of the switch plunger, and FIG. 11 is an enlarged view of a portion A.

As shown in FIGS. 9 to 11, the switch plunger 27 is formed by pressing a metal plate member formed of a magnetic material. In the switch plunger 27, the yoke 25 is integrally formed with a switch-plunger-side cylindrical section 121 configured to close the inside in the radial direction of the receiving concave section 25*b* formed by the plunger holder 26. An opening section (an opening section of the left side of FIG. 10, an opening section of the clutch mechanism 5 side) 122 of the first side of the switch-plunger-side cylindrical section 121 has an expansion diameter section (cutout section) 122*a* having a diameter increased by the step difference. The expansion diameter section 122*a* functions as a recess section configured to suppress a magnetic flux generated at the plunger holder 26 from directly leaking from the plunger-holder-side cylindrical section 26*b* toward the switch plunger 27 (described below in detail).

Further, the inner diameter of the expansion diameter section 122*a* is set to a size such that a switch return spring 27*a* (to be described below) can press the end section of the switch-plunger-side cylindrical section 121 near the first opening section 122. That is, when the inner diameter of the expansion diameter section 122*a* is excessively increased, the thickness of the first opening section 122 of the switch-plunger-side cylindrical section 121 is excessively reduced, and the switch return spring 27*a* cannot press the end section of the switch-plunger-side cylindrical section 121 near the first opening section 122.

In addition, a convex line section 122*b* is formed on an inner circumferential surface of the switch-plunger-side cylindrical section 121 near the second side (the right side of FIG. 10, near the motor unit 3) of the expansion diameter section 122*a* throughout the entire circumference.

The expansion diameter section 122*a* and the convex line section 122*b* are continuously formed on the inner circumferential surface of the switch-plunger-side cylindrical section 121 from the first opening section 122 side.

Further, as a method of forming the expansion diameter section 122*a* and the convex line section 122*b*, for example, there is a method of mounting a jig on the inner circumferential surface of the switch-plunger-side cylindrical section 121, and then allowing a cylindrical jig having a diameter slightly larger than the inner diameter of the switch-plunger-side cylindrical section 121 to collide therewith from a side of the switch-plunger-side cylindrical section 121 near the first opening section 122. Accordingly, the expansion diameter section 122*a* is formed, and a remaining thickness of the switch-plunger-side cylindrical section 121 obtained by forming the expansion diameter section 122*a* may become the convex line section 122*b*.

An outer flange section 29 overhanging toward the outer circumferential side is integrally formed with an opening section (an opening section of the right side of FIG. 10, an opening section near the motor unit 3) 123 of the second side of the switch-plunger-side cylindrical section 121. Further, a shaft holder 29*a* is formed to extend from a first side of the outer flange section 29. The shaft holder 29*a* is a member configured to hold a switch shaft 30 (to be described below), and is formed in a U shape into which an end section of the switch shaft 30 can be received.

In addition, a ring member 27*r* is integrally formed with the inner circumferential surface of the switch-plunger-side cylindrical section 121. The ring member 27*r* is a member configured to initially press the gear plunger 80 toward the ring gear 23 when the switch plunger 27 is moved toward a first side (toward the ring gear 23). The gear plunger 80 is installed so as to abut and be separated from the ring member 27*r*.

Further, the switch return spring 27*a* configured of a leaf spring material configured to bias the end section of the switch-plunger-side cylindrical section 121 near the first opening section 122 and the plunger holder 26 in the separation direction is installed therebetween.

Returning to FIG. 1, the gear plunger 80 is installed inside in the radial direction of the switch-plunger-side cylindrical section 121 of the switch plunger 27 concentrically with the switch-plunger-side cylindrical section 121. The gear plunger 80 includes an inner plunger 81 disposed inside in the radial direction, the outer plunger 85 disposed outside in the radial direction, and the plunger spring 91 disposed between the inner plunger 81 and the outer plunger 85.

The inner plunger 81 is formed of a resin or the like in a substantially cylindrical shape. The inner diameter of the inner plunger 81 is formed to be slightly larger than the outer diameter of the drive shaft 4 so as be fitted onto the drive shaft 4. Accordingly, the inner plunger 81 is slidably installed with respect to the drive shaft 4 in the axial direction.

An outer flange section 82 overhanging toward the outside in the radial direction is integrally formed with a first side end 81*a* (the left side end of FIG. 1) of the inner plunger 81. As will be described below, when the inner plunger 81 slides to the first side, the first side end 81*a* of the inner plunger 81 abuts the second side end of the outer clutch 18, and the clutch mechanism 5 and the transmission pinion gear 70 are slid toward the first side.

A plurality of claw sections 83 having an outer diameter gradually increased from the second side toward the first side are formed on a second side end 81*b* (the right side end of FIG. 1) of the inner plunger 81 in the circumferential direction. In addition, a groove section 84 is formed on the first side (the left side of FIG. 1) of the claw section 83 in the circumferential direction.

Like the inner plunger 81, the outer plunger 85 is formed of a resin or the like in a substantially cylindrical shape. The outer plunger 85 has an inner diameter slightly larger than the outer diameter of the outer flange section 82 of the inner plunger 81, and is fitted onto the inner plunger 81.

An inner flange section 86 overhanging toward the inside in the radial direction is integrally formed with a second side end 85*a* (a right side end of FIG. 1) of the outer plunger 85. The inner diameter of the inner flange section 86 is set to be smaller than the outer diameter of the claw section 83 of the inner plunger 81 and larger than the outer diameter of the bottom section of the groove section 84 of the inner plunger 81. Then, as the inner flange section 86 of the outer plunger 85 is disposed in the groove section 84 of the inner plunger 81, the inner plunger 81 and the outer plunger 85 are integrated to configure the plunger mechanism 37.

The thickness of the inner flange section 86 of the outer plunger 85 is formed to be smaller than the width of the groove section 84 of the inner plunger 81. Accordingly, a clearance is formed between the inner flange section 86 of the outer plunger 85 and the groove section 84 of the inner plunger 81. Accordingly, the inner plunger 81 and the outer plunger 85 are relatively slidable in the axial direction to an extent of the clearance between the inner flange section 86 of the outer plunger 85 and the groove section 84 of the inner plunger 81.

An outer flange section 87 overhanging toward the outside in the radial direction is integrally formed with the second side end 85*a* (the right side end of FIG. 1) of the outer plunger 85. The outer flange section 87 functions as an abutting section configured to abut the ring member 27*r* of the switch plunger 27.

In addition, the iron core 88 having a ring shape is installed on the outer circumferential surface of the outer plunger 85 near the first side (the left side of FIG. 1) of the outer flange section 87. The iron core 88 is integrally formed with the outer plunger 85 by, for example, a resin mold. The iron core 88 is attracted to the electromagnetic device 9 with a predetermined attractive force by a magnetic flux generated when current is supplied to the exciting coil 24 as will be described below.

A receiving section 90 is formed between the outer flange section 82 of the inner plunger 81 and the inner flange section 86 of the outer plunger 85. The plunger spring 91 configured to surround the outer circumferential surface of the inner plunger 81 is received in the receiving section 90.

The plunger spring 91, while received in the receiving section 90, is compressed and deformed by the outer flange section 82 of the inner plunger 81 and the inner flange section 86 of the outer plunger 85. Then, the inner plunger 81 is biased toward the first side (the left side of FIG. 1) and the outer plunger 85 is biased toward the second side (the right side of FIG. 1).

Since the first side end 81*a* of the inner plunger 81 and the second side end of the outer clutch 18 do not abut each other, the outer clutch 18 is pressed against the stopper 94 by a spring load of the return spring 21. Accordingly, in the stopped state of the starter 1, the clutch mechanism 5 is not pushed out by the spring load of the plunger spring 91, i.e., the transmission pinion gear 70 cannot be unintentionally pushed out.

Meanwhile, in the electrical connection state of the starter 1, when the gear plunger 80 is maximally displaced to the first side (the left side of FIG. 1), the first side end 81*a* of the inner plunger 81 always abuts the second side end of the outer clutch 18 of the clutch mechanism 5. That is, the plunger spring 91 functions as a backlash absorption mechanism configured to prevent generation of an aperture in the axial direction between the clutch mechanism 5 and the gear plunger 80 and absorb backlash of the clutch mechanism 5.

In addition, the switch shaft 30 is vertically installed on the shaft holder 29*a* of the switch plunger 27 via a holder member 30*a* in the axial direction. The switch shaft 30 passes through the top plate 12 of the motor unit 3 and a brush holder 33 (to be described below). The movable contact plate 8 of the switch unit 7 disposed in the vicinity of the commutator 61 of the brushed direct current motor 51 is connected to an end section protruding from the top plate 12 of the switch shaft 30.

The movable contact plate 8 is slidably attached with respect to the switch shaft 30 in the axial direction, and is floatingly supported by a switch spring 32. Then, the movable contact plate 8 can approach or be separated from a fixed contact plate 34 of the switch unit 7 fixed to the brush holder 33 (to be described below).

The fixed contact plate 34 is divided into a first fixed contact plate 34*a* disposed at the inside in the radial direction, which is the commutator 61 side, with the switch shaft 30 sandwiched therebetween, and a second fixed contact plate 34*b* disposed at the outside in the radial direction opposite to the commutator 61. The movable contact plate 8 abuts and straddles the first fixed contact plate 34*a* and the second fixed contact plate 34*b*. As the movable contact plate 8 is stroked along the drive shaft 4 and abuts the first fixed contact plate 34*a* and the second fixed contact plate 34*b*, the first fixed contact plate 34*a* and the second fixed contact plate 34*b* are in an ON state and electrically connected.

Here, the outer clutch 18 of the clutch mechanism 5 is biased toward the inner plunger 81 by the return spring 21. Accordingly, while the starter 1 is stopped, the clutch mechanism 5 presses the switch plunger 27 toward the second side (the right side of FIG. 1) via the gear plunger 80 and the ring member 27*r*. Accordingly, the movable contact plate 8 is pressed toward the second side and is separated from the fixed contact plate 34 to be in an OFF state.

Meanwhile, when the electromagnetic device 9 causes the transmission pinion gear 70 and the movable contact plate 8 to slide to the first side (the left side of FIG. 1), the movable contact plate 8 enters the ON state and the transmission pinion gear 70 abuts the ring gear 23.

The brush holder 33 is formed closer to the second side (the right side of FIG. 1) than the electromagnetic device 9 and the planetary gear mechanism 2. Here, a cut and raised section 34*c* that is bent in the axial direction is integrally formed with the outer circumferential side of the second fixed contact plate 34*b*. An axial terminal 44*a* passes through an outer wall 33*a* of the brush holder 33 via an insertion hole of the cut and raised section 34*c* to protrude toward the outside in the radial direction of the starter 1. Further, a terminal nut 44*b* to which a positive electrode of a battery is electrically connected is installed on a distal end of a protrusion side of the axial terminal 44*a*.

Further, a cover 45 configured to protect peripheries of the fixed contact plate 34 and the switch shaft 30 is mounted on the brush holder 33. The brush holder 33 and the cover 45 are sandwiched between the motor yoke 53 and the bracket section 171 and fixed.

Four brushes 41 are disposed at the brush holder 33 around the commutator 61 to advance or retreat in the radial direction. A brush spring 42 is installed on a base end side of each of the brushes 41. The brush 41 is biased toward the commutator 61 by the brush spring 42, and a distal end of the brush 41 comes in sliding contact with the segment 62 of the commutator 61.

The four brushes 41 are configured of two positive-electrode-side brushes and two negative-electrode-side brushes, and the two positive-electrode-side brushes are connected to the first fixed contact plate 34*a* of the fixed contact plate 34 via a pigtail (not shown). Meanwhile, a positive electrode of the battery (not shown) is connected to the second fixed contact plate 34*b* of the fixed contact plate 34 via the terminal nut 44*b*.

That is, when the movable contact plate 8 abuts the fixed contact plate 34, a voltage is applied to the two positive-electrode-side brushes among the four brushes 41 via the terminal nut 44*b*, the fixed contact plate 34 and the pigtail (not shown), and current is supplied to the coil 59.

In addition, the two negative-electrode-side brushes among the four brushes 41 are connected to a ring-shaped center plate via a pigtail (not shown). Then, the two negative-electrode-side brushes among the four brushes 41 are electrically connected to the negative electrode of the battery via the center plate, the housing 17, and the vehicle body (not shown).

(Assembly Method of Starter)

Next, an assembly method of the starter 1 will be described based on FIG. 12.

Figure 12:
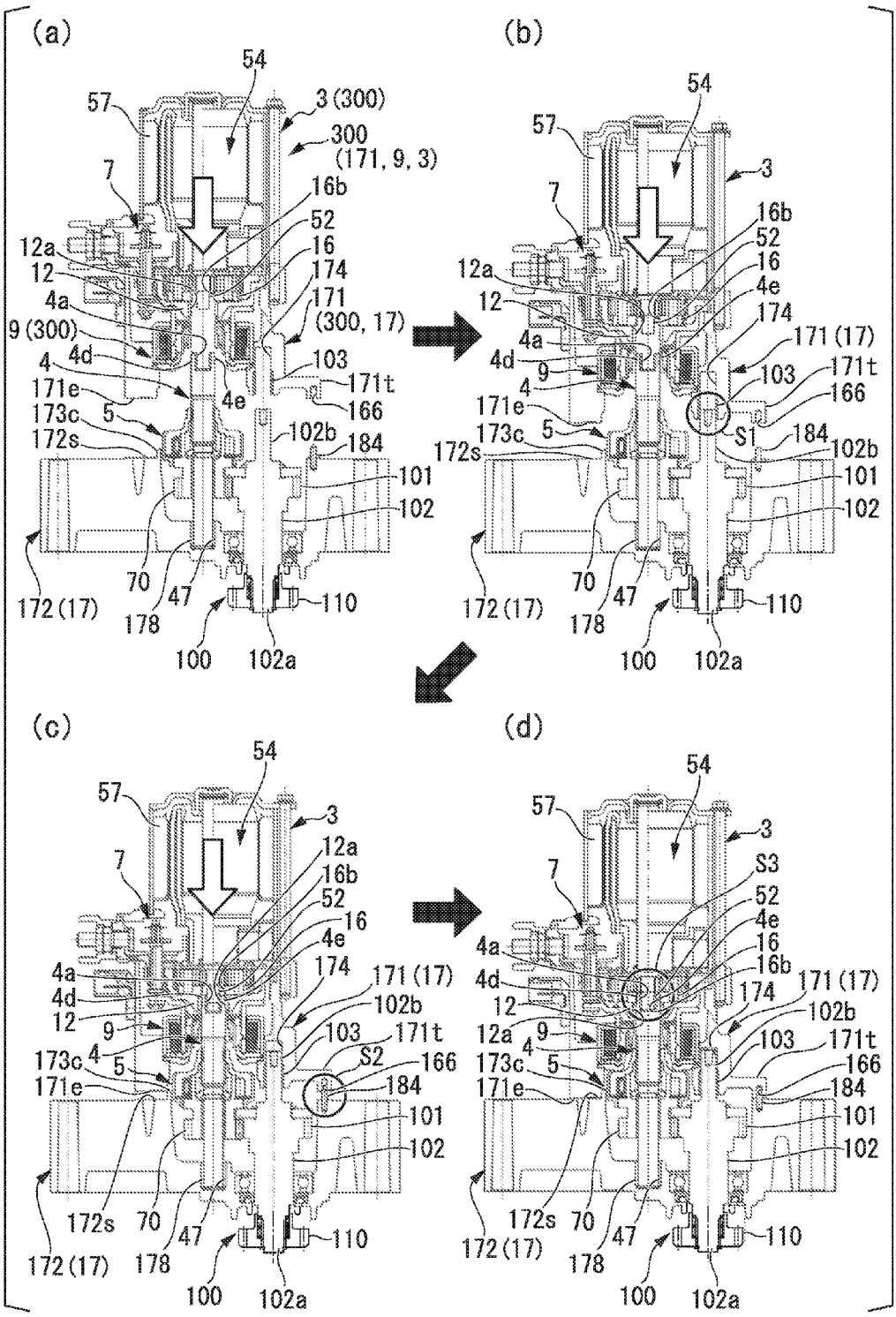
FIG. 12 is a view showing an assembly sequence of the starter according to the first embodiment and the second embodiment of the present invention, FIGS. 12 (*a*) to (*d*) showing processes.

FIG. 12 is a view showing an assembly sequence of the starter, FIGS. 12(*a*) to 12(*d*) showing processes thereof.

First, as shown in FIG. 12(*a*), the electromagnetic device 9 previously attached to the bracket section 171 (an electromagnetic device assembly process) and the electromagnetic device 9 is incorporated in the bracket section 171, and the motor unit 3 is attached to the bracket section 171 to form a sub-unit 300.

Here, the shrinkage diameter section (retainer section) 171*d* having a diameter reduced by a step difference closer to the first opening section 171*a* than the electromagnetic device 9 (the stopper 94) is formed on an inner wall of the bracket section 171. Since the shrinkage diameter section (retainer section) 171*d* restricts the electromagnetic device 9 from slipping out of the first opening section 171*a* of the bracket section 171 near the gear cover 172, the sub-unit 300 in which the electromagnetic device 9 does not slip out of the bracket section 171 can be provided.

In addition, the first side end of the drive shaft 4 to which the clutch mechanism 5 is assembled is inserted into the slide bearing 178 installed on the bearing concave section 47 of the gear cover 172. In addition, the first side end of the idle shaft 102 is inserted into the ball bearing 180 installed in the shaft through-hole 179 of the gear cover 172 (a pre-assembly process). Here, a gear meshing operation of the transmission pinion gear 70 and the idle gear 101 can be easily performed with good visibility.

Then, the driving pinion gear 110 is attached to the first end section 102*a* of the idle shaft 102. Accordingly, the drive shaft 4 and the idle shaft 102 enter a state in which the first side end is supported by the gear cover 172.

In this state, the bracket section 171 is moved toward the gear cover 172 such that the abutting surface 171*e* of the bracket section 171 previously configured as the sub-unit by the electromagnetic device 9 and the motor unit 3 overlaps the abutting surface 172*s* of the gear cover 172 (see an arrow of FIG. 12(*a*)).

Here, as shown in FIG. 12(*b*), first, the second end section 102*b* of the idle shaft 102 is inserted into the slide bearing 103 installed on the shaft hole 174 of the bracket section 171 (see a portion S1 of FIG. 12(*b*)). At this time, the rotary shaft 52 of the motor unit 3 is not inserted into the concave section 4*a* formed on the second side end section 4*d* of the drive shaft 4.

Further, when the bracket section 171 and the gear cover 172 are moved in an approaching direction, as shown in FIG. 12(*c*), the second side end section 4*d* of the drive shaft 4 is inserted into the slide bearing 12*a* installed on the inner circumferential surface of the top plate 12. Further, the positioning pin 184 of the gear cover 172 is inserted into the pin insertion hole 166 of the bracket section 171 (see a portion S2 of FIG. 12(*c*)).

At this time, positions in the circumferential direction (the rotational direction of the drive shaft 4) of the bracket section 171 and the gear cover 172 are determined at two points (a point by the slide bearing 103 and the idle shaft 102 and a point by the pin insertion hole 166 and the positioning pin 184). For this reason, the relative position in the circumferential direction of the bracket section 171 with respect to the gear cover 172 is determined.

Here, the shaft diameter of the second end section 102*b* of the idle shaft 102 and the inner diameter of the slide bearing 103 of the bracket section 171 are set to sizes such that some backlash (a gap) is generated between the second end section 102*b* and the slide bearing 103. For this reason, even when a manufacturing error of the pin insertion hole 166, the positioning pin 184, the shaft hole 174, and so on, occurs, the manufacturing error can be absorbed by the backlash between the second end section 102*b* of the idle shaft 102 and the slide bearing 103.

In addition, when the positioning pin 184 of the gear cover 172 is inserted into the pin insertion hole 166 of the bracket section 171, while the second side end section 4*d* of the drive shaft 4 is inserted into the slide bearing 12*a*, the engaging hole 16*b* of the carrier plate 16 is not engaged with the serration section 4*e* of the drive shaft 4.

In addition, an axial length of the drive shaft 4 and an axial length of the rotary shaft 52 is set to a length at which the second side end section 4*d* of the drive shaft 4 is not inserted into the slide bearing 12*a*, before the second end section 102*b* of the idle shaft 102 is inserted into the slide bearing 103 of the bracket section 171.

Further, a fitting area of the engaging hole 16*b* of the carrier plate 16 and the serration section 4*e* of the second side end section 4*d* of the drive shaft 4 is set to be smaller than an insertion area of the second end section 102*b* of the idle shaft 102 with respect to the shaft hole 174 of the bracket section 171. In addition, a fitting area of the rotary shaft 52 and the drive shaft 4 is set to be smaller than an insertion area of the positioning pin 184 of the gear cover 172 with respect to the pin insertion hole 166 of the bracket section 171.

Continuously, when the bracket section 171 and the gear cover 172 further move in the approaching direction, as shown in 12(*d*), the engaging hole 16*b* of the carrier plate 16 of the motor unit 3 is engaged with the serration section 4*e* of the second side end section 4*d* of the drive shaft 4, and they are meshed together (see a portion S3 of FIG. 12(*d*)).

In this way, connection of the concave section 4*a* of the drive shaft 4 and the rotary shaft 52 of the motor unit 3, which cannot be easily seen from the outside upon assembly of the starter 1, is performed after the relative position in the circumferential direction of the bracket section 171 with respect to the gear cover 172 is determined.

In addition, substantially simultaneously with fitting of the serration section 4*e* of the second side end section 4*d* of the drive shaft 4 and the engaging hole 16*b* of the carrier plate 16 of the motor unit 3, the spigot joint section 173*c* of the gear cover 172 is fitted into the first opening section 171*a* of the bracket section 171 by a spigot joint.

Continuously, after the abutting surface 171*e* of the bracket section 171 overlaps the abutting surface 172*s* of the gear cover 172, the bracket section 171 and the gear cover 172 are fastened and fixed to each other using the bolts 177*a* and 177*b* (see FIG. 2) (a bracket section assembly process). Accordingly, assembly of the starter 1 is completed.

(Operation of Starter)

Next, an operation of the starter 1 will be described.

As shown in FIG. 1, while the starter 1 is stopped before supply of current to the exciting coil 24, the return spring 21 is fully biased toward the motor unit 3 (the right side of FIG. 1) such that the outer clutch 18 biased to the return spring 21 pulls the inner clutch 22 integrated with the transmission pinion gear 70. Then, the outer clutch 18 of the clutch mechanism 5 stops at a position abutting the stopper 94. Accordingly, the idle gear unit 100 having the idle gear 101 meshed with the transmission pinion gear 70 is disengaged such that the driving pinion gear 110 is separated from the ring gear 23.

In addition, the switch plunger 27 is pushed back by the switch return spring 27*a*, and fully moved toward the motor unit 3 (the right side of FIG. 1). Then, the outer flange section 29 of the switch plunger 27 stops such that it abuts the top plate 12. Further, the movable contact plate 8 of the switch shaft 30 vertically installed on the outer flange section 29 is separated from the fixed contact plate 34 to be electrically disconnected.

When an ignition switch (not shown) of the vehicle is turned on, current is supplied to excite the exciting coil 24, and a magnetic path through which a magnetic flux passes is formed by the switch plunger 27 and the gear plunger 80. Accordingly, the switch plunger 27 and the gear plunger 80 slide toward the ring gear 23.

Here, as the ring member 27*r* is integrally formed with the inner circumferential surface of the switch plunger 27, the ring member 27*r* presses the gear plunger 80, the gear plunger 80 is initially pressed toward the ring gear 23, and thus the switch plunger 27 and the gear plunger 80 are integrated to slide toward the ring gear 23.

In addition, the outer clutch 18 is meshed with the drive shaft 4 by a helical spline, and the sleeve 18*a* abuts the inner plunger 81 of the gear plunger 80. Accordingly, the outer clutch 18 is pushed while being slightly rotated relative to a an inclination angle of the helical spline 18*b* with respect to the drive shaft 4 when the switch plunger 27 and the gear plunger 80 slide toward the ring gear 23. Further, the transmission pinion gear 70 and the idle gear unit 100 are also pushed toward the ring gear 23 interlocking with the gear plunger 80 via the clutch mechanism 5.

Further, when the switch plunger 27 is moved toward the ring gear 23, the movable contact plate 8 is moved toward the fixed contact plate 34 via the outer flange section 29 and the switch shaft 30 to come in contact with the fixed contact plate 34. Since the movable contact plate 8 is floated and supported to be displaced in the axial direction with respect to the switch shaft 30, a pressing force of the switch spring 32 is applied to the movable contact plate 8 and the fixed contact plate 34.

When the movable contact plate 8 comes into contact with the fixed contact plate 34, a voltage of a battery (not shown) is applied to the two positive-electrode-side brushes among the four brushes 41, and the coil 59 is supplied with electricity via the segment 62 of the commutator 61.

Then, a magnetic field is generated at the armature core 58, and a magnetic attractive force or repulsive force is generated between the magnetic field and the permanent magnet 57 installed on the motor yoke 53. Accordingly, the armature 54 starts to rotate. Then, as the armature 54 is rotated, a rotational force of the rotary shaft 52 of the armature 54 (a rotational force of the motor unit 3) is transmitted to the drive shaft 4 via the planetary gear mechanism 2, and the drive shaft 4 starts to rotate.

As the drive shaft 4 is rotated, the outer clutch 18 meshed with the helical spline 19 of the drive shaft 4 is rotated therewith, and an inertial force is applied to the clutch mechanism 5. Then, the clutch mechanism 5 is pushed out toward the ring gear 23 along the helical spline 19 by the inertial force. Here, since a force directed toward the ring gear 23 is applied to a gear plunger 28, the gear plunger 28 is also moved toward the ring gear 23 based on the movement of the clutch mechanism 5.

As the clutch mechanism 5 is pushed out toward the ring gear 23, the idle gear 101 is interlocked with the transmission pinion gear 70 integrated with the clutch mechanism 5 so as to be pushed out toward the ring gear 23 while rotating. Then, the driving pinion gear 110 installed on the end section 102*b* of the idle shaft 102 is also integrated with the idle gear 101 so as to be pushed out toward the ring gear 23 while rotating.

When the driving pinion gear 110 starts to rotate while a first side end surface 110*f* of the driving pinion gear 110 abuts a second side end surface 23*a* of the ring gear 23, the abutting state is released and the gears are meshed. Then, the driving pinion gear 110 is pushed toward the ring gear 23 by the biasing force of the pinion spring 113, and the driving pinion gear 110 and the ring gear 23 start to mesh with each other.

Here, the first side end surface 110*f* of the driving pinion gear 110 and the second side end surface 23*a* of the ring gear 23 abut each other or are in a state in which the dimensional distance in the axial direction therebetween is zero. For this reason, in the case in which the first side end surface 110*f* of the driving pinion gear 110 and the second side end surface 23*a* of the ring gear 23 abut each other, when the driving pinion gear 110 is further pushed, the pinion spring 113 is shrunk. Accordingly, the first side end surface 110*f* of the driving pinion gear 110 is biased toward the second side end surface 23*a* of the ring gear 23.

That is, the pinion spring 113 configures a damper mechanism configured to absorb a thrust load when the driving pinion gear 110 and the ring gear 23 abut each other. Accordingly, even when the first side end surface 110*f* of the driving pinion gear 110 and the second side end surface 23*a* of the ring gear 23 abut each other, the switch plunger 27 can be pushed out to a predetermined position, abrasion between the first side end surface 110*f* of the driving pinion gear 110 and the second side end surface 23*a* of the ring gear 23 can be suppressed, and durability of the starter 1 can be improved.

Here, as described above, since the driving pinion gear 110 and the ring gear 23 are helically meshed, a thrust load in a direction of the ring gear 23 (a plunge direction) is generated at the driving pinion gear 110. Then, the driving pinion gear 110 is moved toward the ring gear 23 by the thrust load. In addition, the outer clutch 18 is also pushed out toward the ring gear 23 against the biasing force of the return spring 21 along the helical spline 19 by the inertial force.

Here, a predetermined attractive force directed toward the ring gear 23 is applied to the gear plunger 80. Accordingly, the gear plunger 80 slides toward the ring gear 23 while pressing the outer clutch 18 to be interlocked with the outer clutch 18. As a result, the driving pinion gear 110 is pushed out toward the ring gear 23, and the ring gear 23 is meshed at a predetermined meshing position.

As the ring gear 23 and the driving pinion gear 110 are meshed in this way and the rotational force of the drive shaft 4 is transmitted to the ring gear 23, the engine is started.

Figure 13:
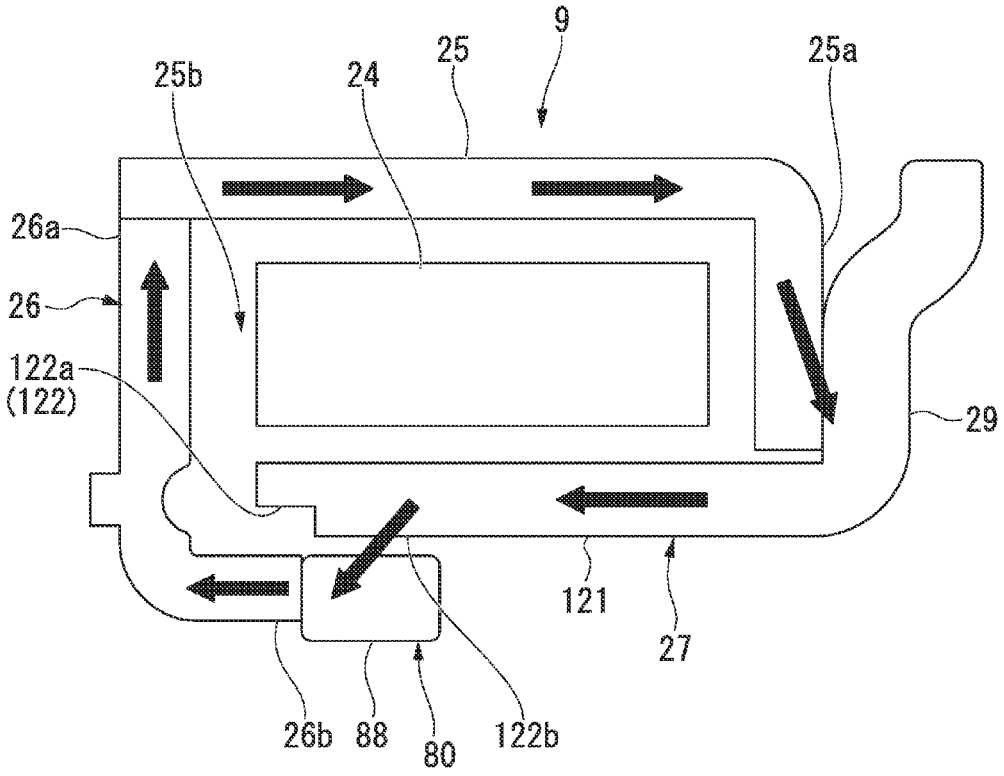
FIG. 13 is a view showing a generation state of a magnetic flux around the switch plunger and the gear plunger according to the first embodiment and the second embodiment of the present invention.

FIG. 13 is a view showing a state in which the switch plunger and the gear plunger completely slide toward the ring gear and a generation state of a magnetic flux around the switch plunger and gear plunger.

As shown in FIG. 13, when the switch plunger 27 completely slides toward the ring gear 23, the outer flange section 29 of the switch plunger 27 abuts the bottom section 25*a* of the yoke 25. In addition, the iron core 88 of the gear plunger 80 abuts the plunger-holder-side cylindrical section 26*b*.

In this state, a magnetic path configured of a magnetic flux passing through the yoke 25, the switch plunger 27, the iron core 88 of the gear plunger 80 and the plunger holder 26 is formed. Then, the iron core 88 of the gear plunger 80 is magnetically attracted to the convex line section 122*b* formed on the plunger-holder-side cylindrical section 26*b* and the switch-plunger-side cylindrical section 121 to be held in place.

Here, since the expansion diameter section 122*a* is formed on the first opening section 122 of the switch-plunger-side cylindrical section 121, the interval between the expansion diameter section 122*a* and the plunger-holder-side cylindrical section 26*b* is increased. For this reason, direct leakage of a magnetic flux from the plunger-holder-side cylindrical section 26*b* to the switch plunger 27 can be effectively suppressed.

In addition, the interval between the convex line section 122*b* of the switch plunger 27 and the iron core 88 of the gear plunger 80 is reduced in comparison with the case in which the convex line section 122*b* is not formed. In this way, a magnetic flux density between the convex line section 122*b* and the iron core 88 can be increased.

Accordingly, a position of the iron core 88 of the gear plunger 80 can be securely held by the plunger-holder-side cylindrical section 26*b* of the plunger holder 26 and the convex line section 122*b* of the switch plunger 27.

Here, since the driving pinion gear 110 and the ring gear 23 are helically meshed, when the rotational force of the drive shaft 4 is transmitted from the driving pinion gear 110 to the ring gear 23, a thrust load is generated at the driving pinion gear 110 toward the first side (the left side of FIG. 1). The thrust load generated at the driving pinion gear 110 is transmitted to the retaining ring 106 installed on the first side of the driving pinion gear 110, and then transmitted to the drive shaft 4 via the idle shaft 102, the idle gear 101, the transmission pinion gear 70, the inner clutch 22, the outer clutch 18, the movement restriction section 20, and the circlip 20*a*. For this reason, a thrust load is generated at the drive shaft 4 toward the first side, and the drive shaft 4 slides toward the first side.

However, the load receiving member 50 is installed on the gear cover 172 of the housing 17.

Accordingly, the first side end surface 4*c* of the drive shaft 4 abuts the load receiving member 50, and slide movement of the drive shaft 4 to the first side is restricted. In this way, the thrust load applied to the drive shaft 4 can be effectively received by the load receiving member 50.

Meanwhile, after the driving pinion gear 110 and the ring gear 23 are meshed, upon cranking when the engine starts, a variation in rotational speed of the ring gear 23 occurs. Accordingly, a thrust load is generated at the driving pinion gear 110 toward the first side (the left side of FIG. 1) and the second side (the right side of FIG. 1).

Specifically, when the rotational speed of the ring gear 23 is lower than that of the driving pinion gear 110, a thrust load is generated at the driving pinion gear 110 in a direction approaching the ring gear 23 (the left side of FIG. 1).

Meanwhile, when the rotational speed of the ring gear 23 is higher than that of the driving pinion gear 110, a thrust load is generated at the driving pinion gear 110 in a direction away from the ring gear 23 (the right side of FIG. 4).

In particular, in the vehicle including the idle stop function, since stop/start of the engine are frequently performed and use frequency of the starter is increased in comparison with the conventional starter, the above-described thrust load is frequently generated.

However, when the rotational speed of the ring gear 23 is higher than that of the driving pinion gear 110, while the thrust load is generated at the driving pinion gear 110 in the direction away from the ring gear 23 (the right side of FIG. 4), in this case, a thrust load is applied from a helical mesh section between the idle gear 101 and the transmission pinion gear 70 in a direction apposite to the thrust load applied from the ring gear 23 to the driving pinion gear 110.

That is, while the skew direction of the teeth of the idle gear 101 is set to the same direction as the skew direction of the teeth of the driving pinion gear 110, the skew direction of the teeth of the transmission pinion gear 70 is set to the same direction as the skew direction of the teeth of the ring gear 23. In this state, in contrast with the case in which the rotational speed of the ring gear 23 is higher than that of the driving pinion gear 110, the rotational speed of the idle gear 101 is higher than that of the transmission pinion gear 70. For this reason, the thrust load applied to the driving pinion gear 110 in the direction away from the ring gear 23 can be offset.

Accordingly, even when the thrust load is generated at the driving pinion gear 110 in the direction away from the ring gear 23, an appropriate and stable helical meshing can be maintained without releasing the helical meshing between the driving pinion gear 110 and the ring gear 23.

In addition, the convex line section 122*b* is formed on the switch-plunger-side cylindrical section 121 along with the expansion diameter section 122*a* formed on the first opening section 122. For this reason, a position of the iron core 88 of the gear plunger 80 is held by the plunger-holder-side cylindrical section 26*b* and the convex line section 122*b* of the switch plunger 27.

Accordingly, for example, even when the inertia of the idle shaft 102 (the idle gear 101) is increased by the thrust load applied to the driving pinion gear 110 in the direction away from the ring gear 23 and the thrust load cannot be offset by the idle gear 101 and the transmission pinion gear 70, since the position of the gear plunger 80 is held, the helical meshing between the driving pinion gear 110 and the ring gear 23 is not released. For this reason, an appropriate and stable helical meshing can be maintained.

In addition, the thrust load generated at the driving pinion gear 110 is transmitted to the retaining ring 106 installed on the first side of the driving pinion gear 110, and then transmitted to the bottom wall 66 of the clutch cover 6 via the idle shaft 102, the inner clutch 22 and the clutch washer 64. However, since the cylindrical reinforcement section 67 is integrally formed with the bottom wall 66, deformation in the axial direction of the clutch cover 6 is suppressed.

When the engine is completely started and the rotational speed of the driving pinion gear 110 is higher than that of the drive shaft 4, a one-way clutch function of the clutch mechanism 5 is performed and the driving pinion gear 110 idles. In addition, when electricity supplied to the exciting coil 24 is blocked because of the start of the engine, the driving pinion gear 110 is separated from the ring gear 23 by the biasing force of the return spring 21 with respect to the outer clutch 18 and the movable contact plate 8 is separated from the fixed contact plate 34 to stop the brushed direct current motor 51.

(Effects)

In this way, in this embodiment, the housing 17 configured to receive the top plate 12 (the planetary gear mechanism 2), the electromagnetic device 9, the clutch mechanism 5, the idle gear unit 100, and so on, is divided into the bracket section 171 and the gear cover 172. Then, the shaft hole 174 configured to rotatably support the second end section 102*b* of the idle shaft 102 is formed in the bracket section 171. In addition, the bearing concave section 47 configured to rotatably support the end section of the first side of the drive shaft 4 (the end section of the left side of FIG. 1) and the shaft through-hole 179 configured to rotatably support the first side of the idle shaft 102 (the left side of FIG. 1) are formed in the gear cover 172. In addition, the motor unit 3 is installed separately from the bracket section 171 and the gear cover 172. For this reason, the drive shaft 4 and the idle shaft 102 can be assembled using two members of the bracket section 171 and the gear cover 172. In addition, positioning of the drive shaft 4 and the idle shaft 102 can be easily performed, and an assembly of the starter 1 can be simplified.

In addition, a speed reduction ratio between the external tooth section 101*b* of the idle gear 101 and the external tooth section 70*b* of the transmission pinion gear 70 is set such that the rotational speed of the idle gear 101 is reduced with respect to the rotational speed of the transmission pinion gear 70. Accordingly, the rotational torque of the idle shaft 102 can be increased to be larger than the rotational torque of the drive shaft 4. In this way, as a gear ratio between the transmission pinion gear 70 and the idle gear 101 is adjusted, a torque-oriented or rotation-oriented starter can be provided.

Further, the first end section 102*a* of the idle shaft 102 (the end section 102*a* of the left side of FIGS. 1 and 8) passes through the shaft through-hole 179 of the gear cover 172 to protrude toward the outside of the gear cover 172. For this reason, the respective parts that configure the starter 1, except for the idle gear unit 100 attached to the first end section 102*a* of the idle shaft 102, can be sealed by the housing 17 or the motor yoke 53. Accordingly, inferior meshing of the gears or damage to the bearing or the like due to dust or the like can be securely prevented.

In addition, since the idle shaft 102 and the idle gear 101 are integrally formed, the number of parts can be reduced. For this reason, an assembly operation of the starter 1 can be further simplified.

Further, the clutch mechanism 5 is installed on the drive shaft 4 so that the rotational force of the drive shaft 4 can be transmitted to the transmission pinion gear 70 or blocked. For this reason, upon start of the engine, in the overrun state in which the inner clutch 22 is faster than the outer clutch 18, the rotational force from the ring gear 23 of the engine can be blocked, damage to the motor unit 3 or the like can be prevented, and a starter 1 having high reliability can be provided.

Further, the yoke 25 that configures the electromagnetic device 9 is formed in a bottomed cylindrical shape, the plunger mechanism 37 having a substantially cylindrical shape is formed on an inner circumferential surface side of the yoke 25, and the electromagnetic device 9 is concentrically disposed on the drive shaft 4. For this reason, the structure of the electromagnetic device 9 can be simplified and reduced in size, and the disposition space of the electromagnetic device 9 can be reduced.

In addition, the shrinkage diameter section (retainer section) 171*d* having a diameter reduced by the step difference closer to the first opening section 171*a* than the electromagnetic device 9 (the stopper 94) is formed on the inner wall of the bracket section 171, and the shrinkage diameter section (retainer section) 171*d* functions as a retainer section 171*d* configured to prevent the electromagnetic device 9 from slipping off from the bracket section 171 toward the gear cover 172. For this reason, the electromagnetic device 9 and the motor unit 3 can be previously attached to the bracket section 171 to form the sub-unit 300, and the drive shaft 4 and the idle shaft 102 can be previously attached to the gear cover 172.

Further, the axial length of the drive shaft 4 and the axial length of the rotary shaft 52 are set to lengths such that the rotary shaft 52 is not inserted into the concave section 4*a* of the drive shaft 4 before the second end section 102*b* of the idle shaft 102 is inserted into the slide bearing 103 of the bracket section 171. In addition, the axial length of the drive shaft 4 and the axial length of the rotary shaft 52 are set to lengths such that the rotary shaft 52 is not inserted into the concave section 4*a* of the drive shaft 4 before the positioning pin 184 of the gear cover 172 is inserted into the pin insertion hole 166 of the bracket section 171. For this reason, connection of the concave section 4*a* of the drive shaft 4 and the rotary shaft 52 of the motor unit 3, which cannot be easily seen from the outside, can be performed after the relative position in the circumferential direction between the bracket section 171 and the gear cover 172 is determined. Accordingly, an assembly operation of the starter 1 can be further simplified.

Then, the draining-off groove 168 is formed in the outer flange section 171*t* of the bracket section 171, and the draining-off section (the draining-off hole) 185 is configured of the draining-off groove 168 and the abutting surface 172*s* of the gear cover 172. For this reason, waterdrops generated at the bracket section 171 or the gear cover 172 due to intrusion or condensation can be rapidly discharged.

In addition, the outer flange section 171*t* of the bracket section 171 overlaps the gear cover 172 to form the draining-off section 185. For this reason, even when a shape of the gear cover 172 is varied or a position of the bolt insertion hole 172*b* to be fixed to the frame is varied to change specifications of the gear cover 172, the draining-off section 185 can be easily configured by using the bracket section 171 as a common part, and manufacturing cost can be reduced by eliminating the necessity of forming a hole in a side surface of the bracket section 171 or the gear cover 172 to form the draining-off section 185.

Further, as a method of assembling the starter 1, there is a method of previously preparing the sub-unit in which the electromagnetic device 9 is attached to the bracket section 171 (an electromagnetic device assembly process), further attaching the drive shaft 4 and the idle shaft 102 to the gear cover 172 (a pre-assembly process), and then attaching the bracket section 171 and the gear cover 172 (a bracket section assembly process). For this reason, an assembly of the starter 1 can be simplified.

In addition, in this embodiment, since the expansion diameter section 122*a* is formed on the first opening section 122 of the switch-plunger-side cylindrical section 121, the interval between the expansion diameter section 122*a* and the plunger-holder-side cylindrical section 26*b* is increased. For this reason, leakage of the magnetic flux from the plunger-holder-side cylindrical section 26*b* to the switch plunger 27 can be effectively suppressed.

In addition, the interval between the convex line section 122*b* of the switch plunger 27 and the iron core 88 of the gear plunger 80 is reduced in comparison with the case in which the convex line section 122*b* is not formed. For this reason, a magnetic flux density between the convex line section 122*b* and the iron core 88 can be increased.

Accordingly, when the gear plunger 80 fully slide toward the ring gear, the position of the iron core 88 is held by the plunger-holder-side cylindrical section 26*b* and the convex line section 122*b* of the switch plunger 27. As a result, the helical meshing between the driving pinion gear 110 and the ring gear 23 can be maintained.

In addition, since the expansion diameter section (the cutout section) 122*a* configured to increase the interval between the plunger-holder-side cylindrical section 26*b* and the switch plunger 27 is formed throughout the entire circumference of the switch plunger 27, leakage of the magnetic flux from the plunger-holder-side cylindrical section 26*b* to the switch plunger 27 can be suppressed.

Further, since the convex line section 122*b* of the switch plunger 27 is also formed throughout the entire circumference, a magnetic flux density between the convex line section 122*b* and the iron core 88 can be increased.

In addition, the expansion diameter section 122*a* and the convex line section 122*b* are continuously formed on the switch-plunger-side cylindrical section 121 from the first opening section 122 side in sequence of the expansion diameter section 122*a* and the convex line section 122*b*. For this reason, as a method of forming the expansion diameter section 122*a* and the convex line section 122*b*, for example, a method of mounting a jig on the inner circumferential surface of the switch-plunger-side cylindrical section 121, and then colliding a columnar jig having a diameter slightly larger than the inner diameter of the switch-plunger-side cylindrical section 121 from the first opening section 122 side of the switch-plunger-side cylindrical section 121 can be used. That is, as the pressing is performed, the expansion diameter section 122*a* and the convex line section 122*b* can be formed on the same time. For this reason, the manufacturing cost of the switch plunger 27 can be reduced.

In this embodiment, the case in which the clutch mechanism 5 can slide in the axial direction with respect to the drive shaft 4 by forming the helical spline 19 at the drive shaft 4, forming the helical spline 18*b* at the outer clutch 18 and spline-meshing the clutch mechanism 5 with the drive shaft 4 has been described. However, this embodiment is not limited to the above-described configuration. The inclination angle between the helical spline 19 of the drive shaft 4 and the helical spline 18*b* of the outer clutch 18 at this time may be set so that the outer clutch 18 is pushed while slightly rotating relative with respect to the drive shaft 4 when the switch plunger 27 and the gear plunger 80 start to slide toward the ring gear 23.

Then, in this embodiment, while the spline 108 is formed on the distal end side of the idle shaft 102, the spline 110*a* meshed with the spline 108 is formed on the distal end side of the inner circumferential surface of the driving pinion gear 110. Accordingly, the idle shaft 102 and the driving pinion gear 110 cannot be relatively rotated and can be slid in the axial direction.

However, as described above, the idle shaft 102 and the driving pinion gear 110 are not limited to the case in which they can be slid by the spline meshing. For example, while a key is installed on the idle shaft 102, a key groove may be formed on the driving pinion gear 110 and the idle shaft 102 and the driving pinion gear 110 may be slidably formed.

In addition, when the electromagnetic device 9 slides the driving pinion gear 110 and the movable contact plate 8 to a first side (the left side of FIG. 1), the driving pinion gear 110 may abut the ring gear 23 before the movable contact plate 8 enters the ON state.

Further, in this embodiment, the case in which the positioning pin 184 configured to perform the positioning with respect to the bracket section 171 is press-fitted and fixed to one position of the gear cover 172 has been described.

However, the embodiment of the present invention is not limited thereto, and the positioning pin 184 may be formed on any one of the gear cover 172 and the bracket section 171 or may be integrally formed with the gear cover 172 or the bracket section 171 without press-fitting the positioning pin 184. Further, the plurality of positioning pins 184 may be installed on a plurality of places.

When the plurality of positioning pins 184 are formed, the spigot joint section 173*c* may not be formed on the gear cover 172.

Second Embodiment

Next, a second embodiment of the present invention will be described based on the accompanying drawings. Further, the same elements as the first embodiment will be described with the same reference numerals.

In the embodiment, the first opening section 171*a* shown in FIG. 1 is referred to as a first positioning unit. In addition, the pin insertion hole 166 shown in FIG. 3 is referred to as a second positioning unit. Further, the positioning pin 184 shown in FIG. 1 is referred to as a second positioning unit. In addition, the spigot joint section 173*c* shown in FIG. 1 is referred to as a first positioning unit.

Here, as will be described below, in the case of this embodiment in which the spigot joint section 173*c* which is one of the first positioning unit and the spigot joint section near the idle gear accommodating concave section which is the second positioning unit are formed to continue in substantially an 8 shape, a cutting blade cannot be easily inserted when cutting processing is performed to precisely obtain a connecting area of the spigot joint section, and exclusive cutting processing is needed. For this reason, it may be a problem in a viewpoint of reduction in manufacturing cost. However, like this embodiment, as the spigot joint section 173, which is one of the first positioning unit, is formed in substantially a C shape and the second positioning unit is used as the positioning pin 184 or the pin insertion hole 166, a structure of the positioning unit can be simplified. In addition, when the cutting processing is performed to precisely obtain the spigot joint section 173*c*, since the second positioning unit is not disturbed, workability can be improved and manufacturing cost can be reduced.

As described above, the positioning unit of this embodiment is configured of the first positioning unit (the spigot joint section 173*c* and the opening section 171*a*) and the second positioning unit (the positioning pin 184 and the pin insertion hole 166).

Here, the positioning pin 184 press-fitted and fixed to the abutting surface 172*s* of the gear cover 172 is disposed in the vicinity of a place of an opening section circumferential edge of the idle gear accommodating concave section 173*b* opposite to the pinion gear accommodating concave section 173*a*. In other words, the positioning pin 184 is disposed at an opposite side of the spigot joint section 173*c* with the idle gear 101 (the idle shaft 102 to be described below) sandwiched therebetween. Further, in other words, the spigot joint section 173*c* and the positioning pin 184 are disposed on the abutting surface 172*s* of the gear cover 172 so to be spaced as far apart from each other as possible. In this way, as the first positioning unit is configured of the substantially C-shaped spigot joint section 173*c* and the opening section 171*a* and the second positioning unit is configured of the positioning pin 184 and the pin insertion hole 166, the structure of the positioning unit can be simplified.

In this way, in the above-described second embodiment, the spigot joint section 173*c* fitted into the first opening section 171*a* of the bracket section 171 by a spigot joint protrudes from the opening section circumferential edge of the pinion gear accommodating concave section 173*a* of the gear cover 172. In addition, the positioning pin 184 inserted into the pin insertion hole 166 of the bracket section 171 is press-fitted and fixed to the abutting surface 172*s* of the gear cover 172. For this reason, when the drive shaft 4 and the idle shaft 102 are assembled, positioning of the bracket section 171 and the gear cover 172 can be precisely performed. As a result, the positioning of the drive shaft 4 and the idle shaft 102 or the meshing of the gears of the transmission pinion gear 70 and the idle gear 101 can be easily performed, and an assembly of the starter 1 can be simplified.

In addition, the positioning pin 184 is disposed on the abutting surface 172*s* of the gear cover 172 at an opposite side of the spigot joint section 173*c* with the idle gear 101 (the idle shaft 102) sandwiched therebetween. For this reason, the spigot joint section 173*c* and the positioning pin 184 can be disposed so as to be spaced as far apart from each other as possible. As the two points (the spigot joint section 173*c* and the positioning pin 184) of positioning the gear cover 172 and the bracket section 171 are spaced as far apart from each other as possible, the gear cover 172 and the bracket section 171 can be precisely positioned in comparison with the case in which the two points are closely disposed. That is, deviation in the circumferential direction (the rotational direction of the drive shaft 4) of the bracket section 171 and the gear cover 172 can be suppressed as much as possible.

In addition, a fitting area of the engaging hole 16*b* of the carrier plate 16 and the serration section 4*e* of the second side end section 4*d* of the drive shaft 4 is set to be smaller than an insertion area of the second end section 102*b* of the idle shaft 102 with respect to the shaft hole 174 of the bracket section 171. Further, a fitting area of the engaging hole 16*b* of the carrier plate 16 and the serration section 4*e* of the second side end section 4*d* of the drive shaft 4 is set to be smaller than an insertion area of the positioning pin 184 of the gear cover 172 with respect to the pin insertion hole 166 of the bracket section 171.

For this reason, connection of the concave section 4*a* of the drive shaft 4 and the rotary shaft 52 of the motor unit 3, which cannot be easily seen from the outside, can be performed after a relative position in the circumferential direction of the bracket section 171 and the gear cover 172 is determined. Accordingly, an assembly operation of the starter 1 can be further simplified.

Further, the shaft diameter of the second end section 102*b* of the idle shaft 102 and the inner diameter of the slide bearing 103 of the bracket section 171 are set to dimensions such that some backlash (a gap) is generated between the second end section 102*b* and the slide bearing 103. For this reason, even when positioning of the bracket section 171 and the gear cover 172 is performed such that manufacturing errors of the pin insertion hole 166, the positioning pin 184, the shaft hole 174, and so on, occurs, it is possible to absorb the manufacturing error using the backlash between the second end section 102*b* of the idle shaft 102 and the slide bearing 103 and prevent application of an excessive scooping force.

Then, as a method of assembling the starter 1, there is a method of previously assembling the electromagnetic device 9 to the bracket section 171 (an electromagnetic device assembly process), further attaching the drive shaft 4 and the idle shaft 102 to the gear cover 172 (a pre-assembly process), and then attaching the bracket section 171 and the gear cover 172 (a bracket section assembly process). For this reason, an assembly of the starter 1 can be simplified.

Third Embodiment

Next, a third embodiment of the present invention will be described with reference to FIGS. 14 and 15. Further, the same elements as the first embodiment and the second embodiment will be described with the same reference numerals.

Figure 14:
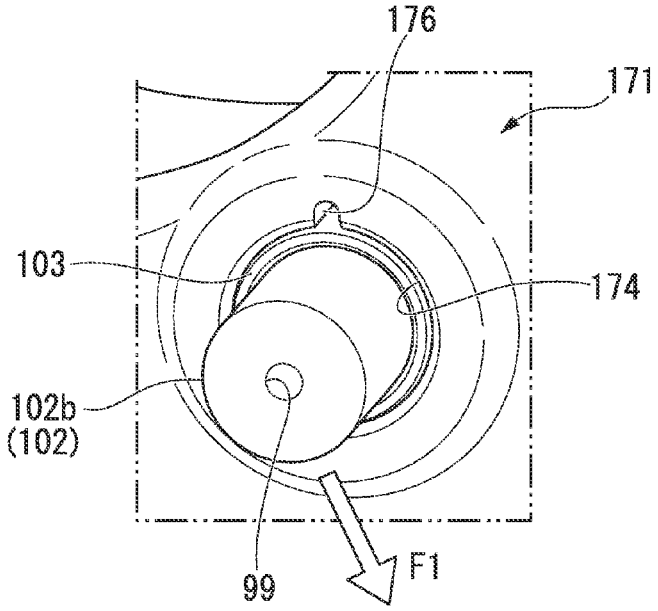
FIG. 14 is an enlarged perspective view of a shaft hole of a bracket section and a second end section of an idle shaft according to a third embodiment of the present invention.
Figure 15:
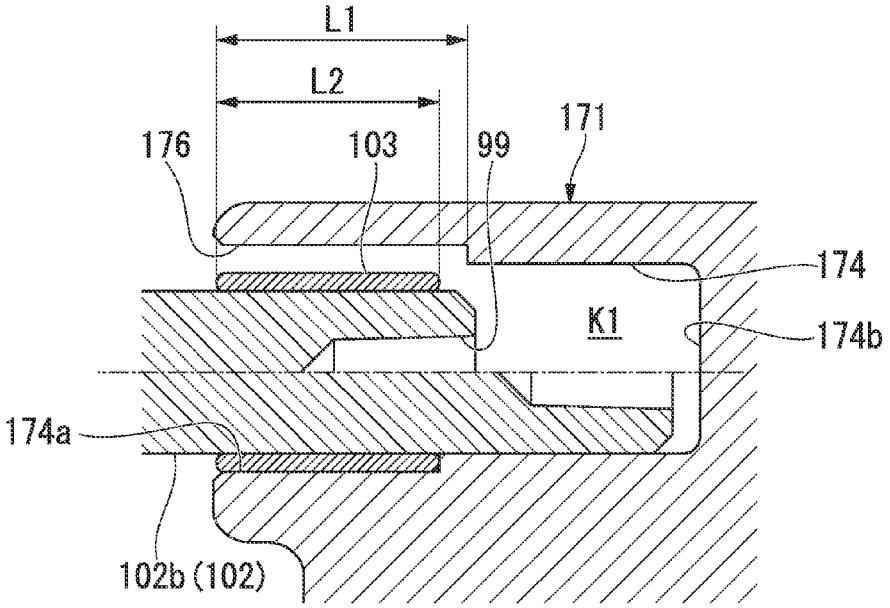
FIG. 15 is a cross-sectional view of FIG. 14.

FIG. 14 is an enlarged perspective view of a shaft hole of a bracket section and a second end section of an idle shaft (an end section of the right side of FIG. 1) when seen from the first side (the left side of FIG. 1), and FIG. 15 is a cross-sectional view of FIG. 14. Further, in FIG. 15, a state in which the starter 1 is stopped (a state in which the idle shaft 102 is retracted) is shown at the lower side of the dotted line along the central shaft of the idle shaft 102, a state in which the starter 1 is supplied with electricity (a state in which the idle shaft 102 advances and the driving pinion gear (the driving gear) 110 and the ring gear 23 of the engine (not shown) are meshed) is shown at the upper side the dotted line along the central shaft of the idle shaft 102.

As shown in FIGS. 14 and 15, an air discharge slit 176 is formed in an inner circumferential surface of the shaft hole 174 of the bracket section 171 of the third embodiment. The air discharge slit 176 extends from an opening section 174*a* of the shaft hole 174 toward a bottom section 174*b*. A length L1 of the air discharge slit 176 is set to be slightly longer than a length L2 of the slide bearing 103 installed on the shaft hole 174.

For this reason, the air discharge slit 176 comes in communication with a portion of the shaft hole 174 closer to the bottom section 174*b* than the slide bearing 103. In other words, the aperture section K1 of the shaft hole 174 comes in communication with the outside of the bracket section 171 (the accommodating concave section 173) via the air discharge slit 176.

Accordingly, even when a capacity of the aperture section K1 is varied (when a capacity of the aperture section K1 is reduced) as the idle shaft 102 slides, leakage of grease from the aperture section K1 due to a pumping action can be securely prevented.

In addition, the air discharge slit 176 is formed on a substantially opposite side in a direction of a load F1 applied to the idle shaft 102 with a rotational center of the idle shaft 102 sandwiched therebetween. For this reason, inhibition of the function of the slide bearing 103 due to formation of the air discharge slit 176 can be prevented.

Further, the present invention is not limited to this embodiment but may include addition of various modifications to this embodiment without departing from the spirit of the present invention.

For example, in the above-described third embodiment, the case in which the air discharge slit 176 is disposed at a substantially opposite side in the direction of the load F1 applied to the idle shaft 102 with the rotational center of the idle shaft 102 sandwiched therebetween was described. However, this embodiment is not limited thereto, and the air discharge slit 176 may be formed on a different place from the direction of the load F1 applied to the idle shaft 102.

Further, in this embodiment, the case in which the spigot joint section 173*c* is formed on an opening section circumferential edge of the pinion gear accommodating concave section 173*a* in the accommodating concave section 173 of the gear cover 172 has been described. However, this embodiment is not limited thereto, and the spigot joint section 173*c* fitted into the first opening section 171*a* of the bracket section 171 by a spigot joint may be installed on the opening section circumferential edge of the idle gear accommodating concave section 173*b* in the accommodating concave section 173. In this case, a position of the positioning pin 184 of the gear cover 172 may be disposed in vicinity of a place disposed at an opposite side of the idle gear accommodating concave section 173*b* in the opening section circumferential edge of the pinion gear accommodating concave section 173*a*. In the above-described disposition, the spigot joint section 173*c* and the positioning pin 184 can be spaced as far from each other as possible.

Further, in this embodiment, an example in which the second positioning unit is configured of the positioning pin 184 and the pin insertion hole 166 has been described. However, this embodiment of the present invention is not limited thereto, and as the second positioning unit, the spigot joint section near the idle gear accommodating concave section fitted to the opening section 171*a* of the bracket section 171 by a spigot joint may be provided at the opening section circumferential edge of the idle gear accommodating concave section 173*b*. Further, the spigot joint section 173*c* which is one of the first positioning unit and the spigot joint section near the idle gear accommodating concave section may be formed continuously in substantially an 8 shape. In this case, a configuration in which the positioning pin 184 is not installed on the gear cover 172 may be provided.

Fourth Embodiment

Next, a starter according to a fourth embodiment of the present invention will be described with reference to the accompanying drawings. Further, the same elements as the first embodiment to the third embodiment will be described with the same reference numerals.

Figure 16:
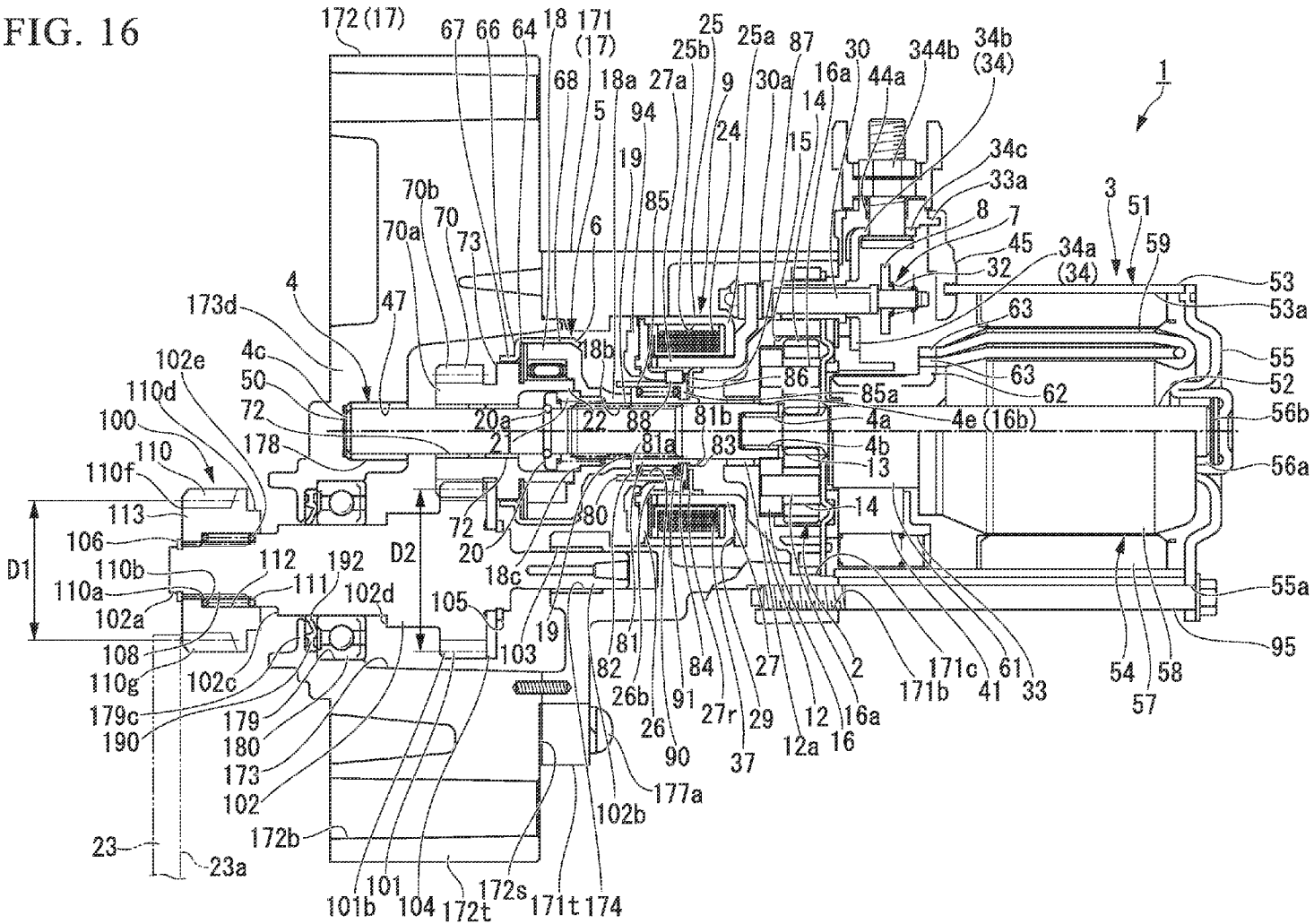
FIG. 16 is a cross-sectional view of a starter according to a fourth embodiment of the present invention.
Figure 17:
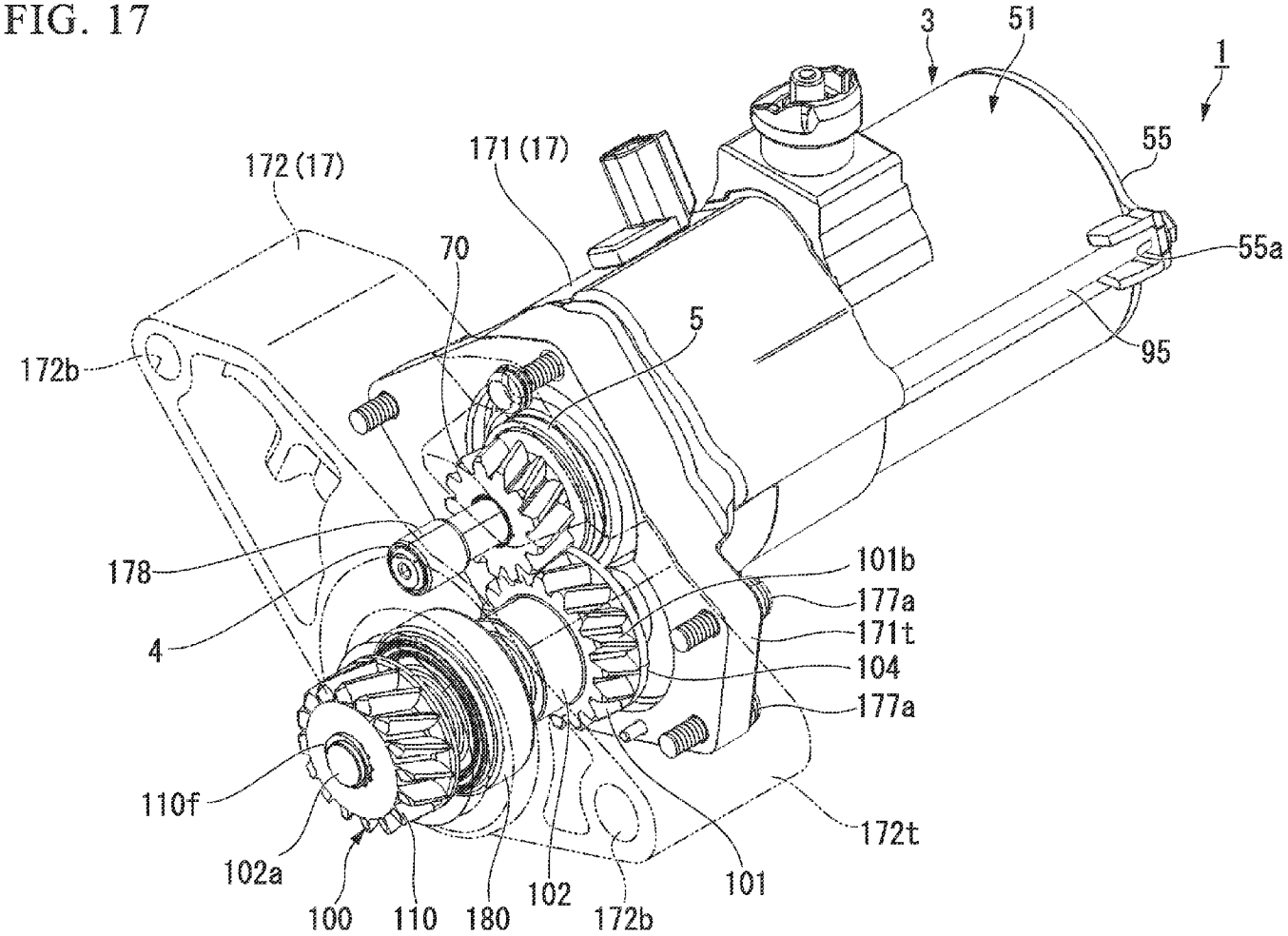
FIG. 17 is a perspective view of a starter according to a fourth embodiment of the present invention.
Figure 18:
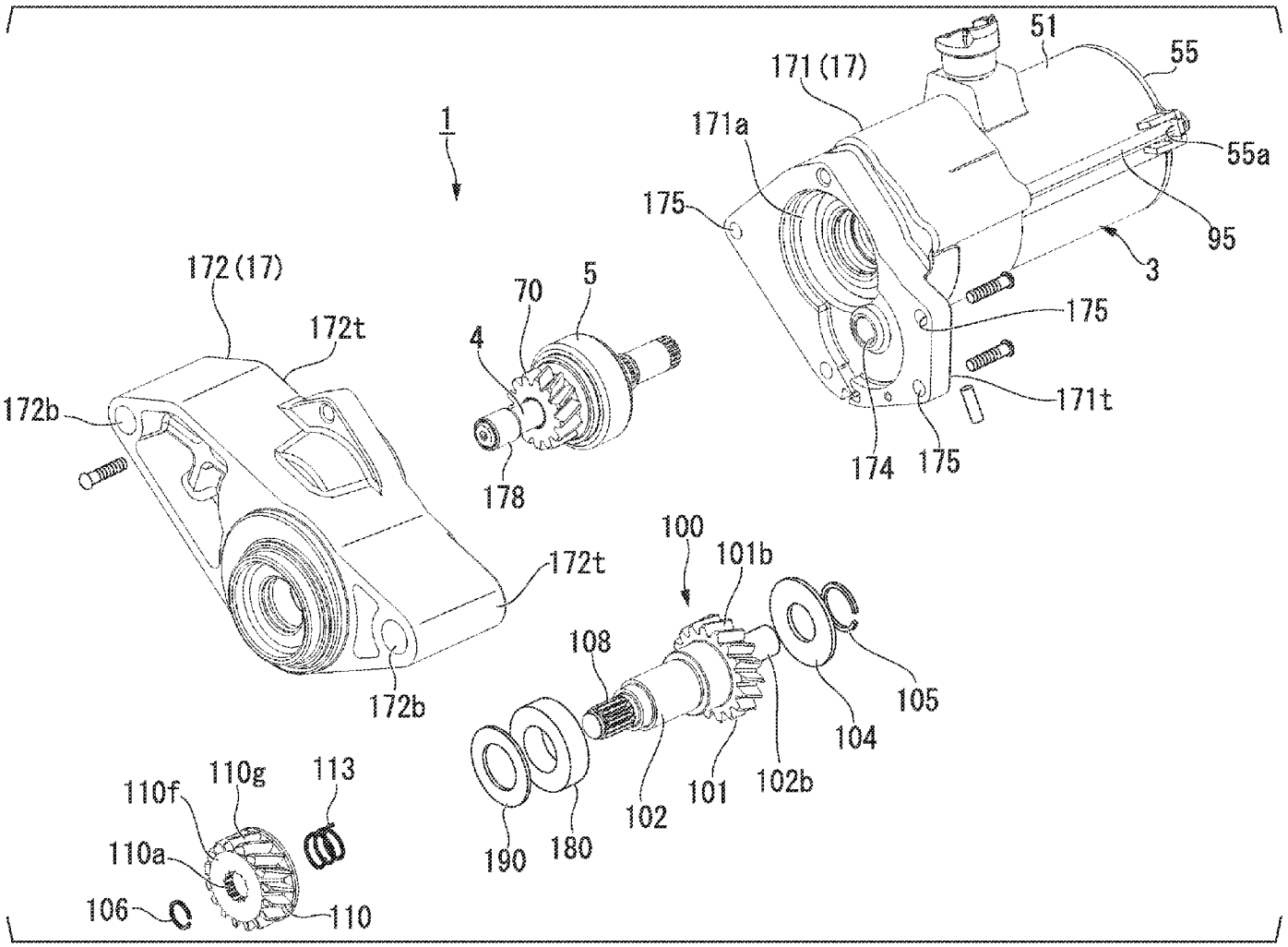
FIG. 18 is an exploded perspective view showing a schematic configuration of the starter according to the fourth embodiment of the present invention.
Figure 19:
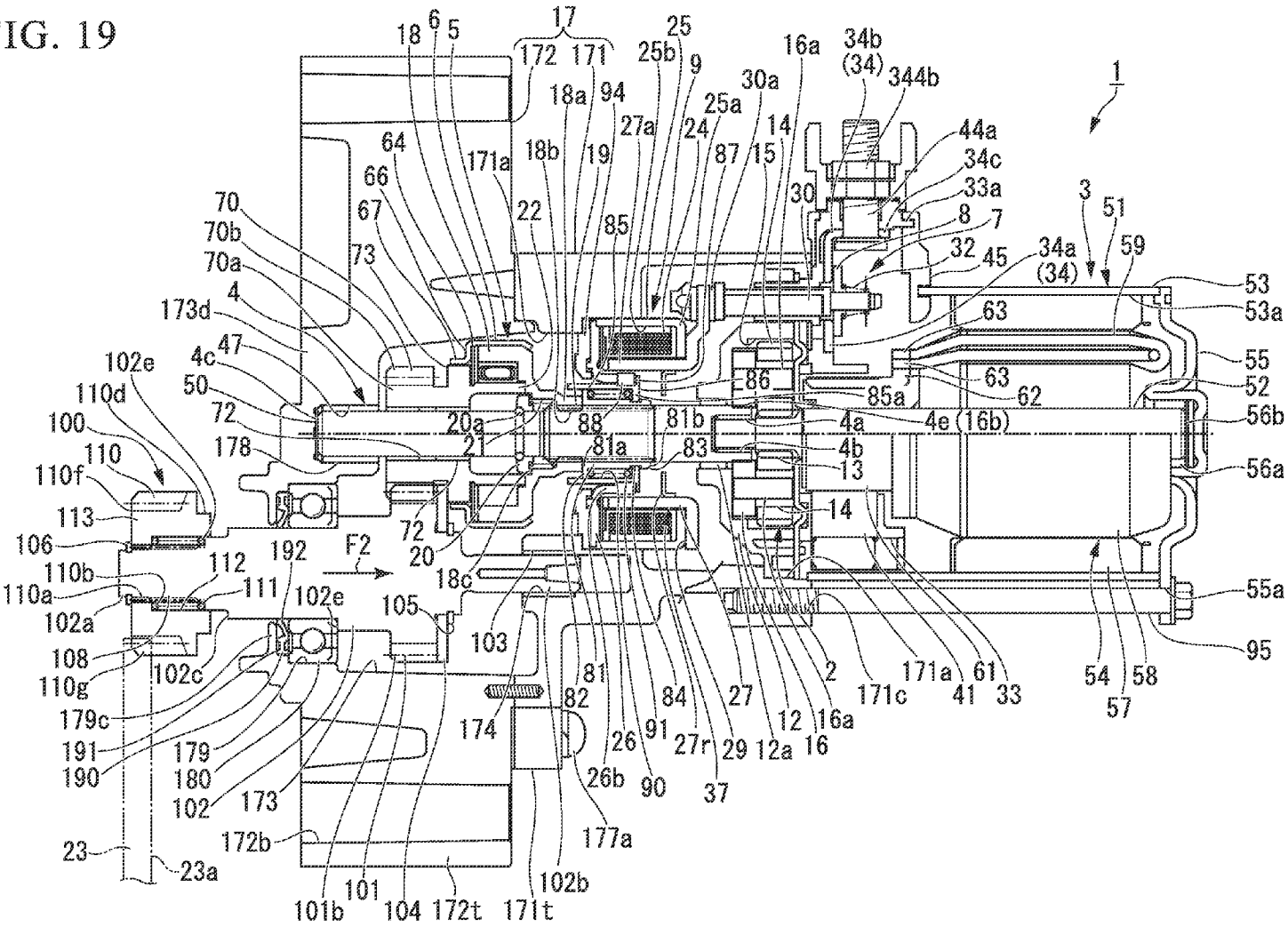
FIG. 19 is a cross-sectional view of the starter at the time an engine is started by a driving pinion gear according to the fourth embodiment of the present invention.
Figure 20A:
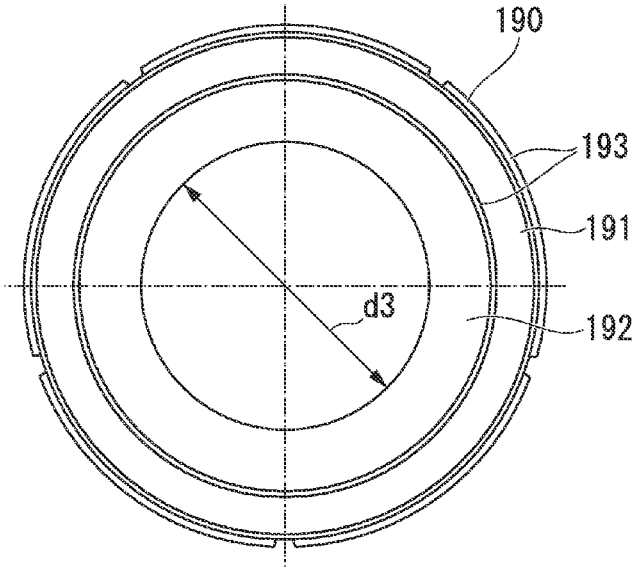
FIG. 20A is a front view showing a seal member according to the fourth embodiment of the present invention.
Figure 20B:
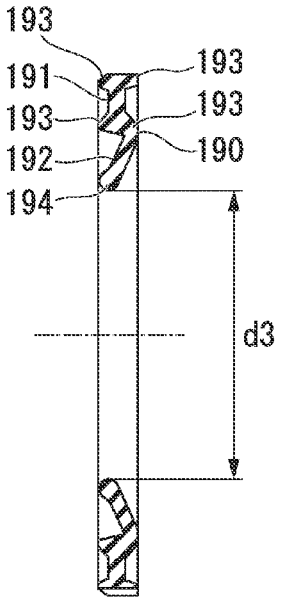
FIG. 20B is a side cross-sectional view showing the seal member according to the fourth embodiment of the present invention.
Figure 21:
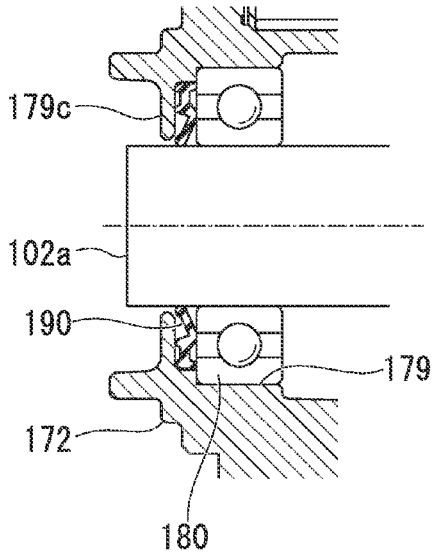
FIG. 21 is a cross-sectional view showing a mounting state of the seal member according to the fourth embodiment of the present invention.
Figure 22:
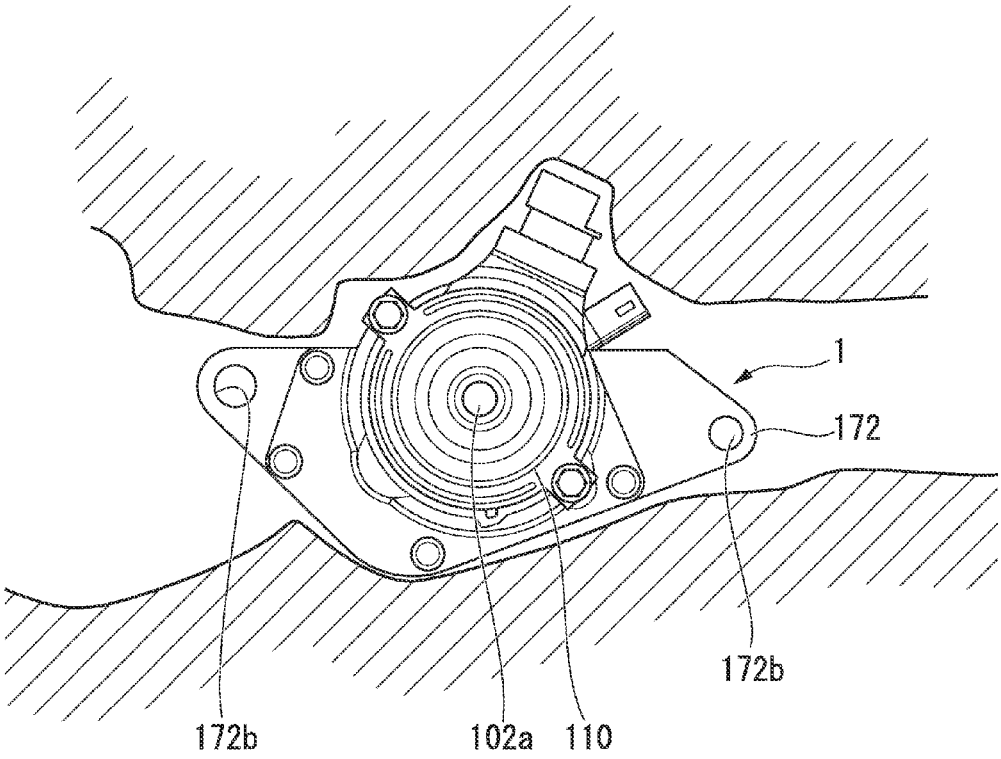
FIG. 22 is a view showing a layout example of the starter according to the fourth embodiment of the present invention.

FIG. 16 is a cross-sectional view of the starter 1 according to this embodiment. FIG. 17 is a perspective view of the starter and FIG. 18 is an exploded perspective view showing a schematic configuration of the starter. FIG. 19 is a cross-sectional view of the starter such that the engine is started by the driving pinion gear. FIG. 20A is a front view showing a seal member. FIG. 20B is a side cross-sectional view showing the seal member. FIG. 21 is a cross-sectional view showing a mounting state of the seal member. FIG. 22 is a view showing a layout example of the starter.

In this embodiment, the housing 17 configured to fix the starter 1 to the engine (not shown) is mounted on the top plate 12. As shown in FIGS. 17 and 18, the housing 17 is configured of a cylindrical housing (a bracket section) 171 fixed to the top plate 12 and having opening sections 171*a* and 171*c* formed on a first side (a left side of FIG. 16) and a second side (a right side of FIG. 16), and a gear cover 172 mounted on the first side of the cylindrical housing 171 (the left side of FIG. 16).

The cylindrical housing 171 and the gear cover 172 are formed of aluminum through die casting. The drive shaft 4, the clutch mechanism 5, the idle gear unit 100, the electromagnetic device 9, and so on, are installed in the housing 17.

As shown in FIG. 16, the top plate 12 is adhered to the cylindrical housing 171 near the opening section 171*c* to close the opening section 171*c*.

The female screw section 171*b* is formed on the outer circumferential surface of the cylindrical housing 171 near the opening section 171*c* along the axial direction. In addition, a bolt hole 55*a* is formed on the end plate 55 disposed at the second side (the right end side of FIG. 16) of the motor yoke 53 at a position corresponding to the female screw section 171*b*. As the bolt 95 is inserted into the bolt hole 55*a* and the bolt 95 is screwed into the female screw section 171*b*, the motor unit 3 and the cylindrical housing 171 are integrated.

The ring-shaped stopper 94 configured to restrict displacement of the outer clutch 18 toward the motor unit 3 (to be described below) is formed on an inner wall of the cylindrical housing 171. The stopper 94 is formed of a resin, rubber, or the like, and can attenuate a shock when the outer clutch 18 abuts the stopper 94.

As shown in FIGS. 17 and 18, a front bracket section (an outer flange section) 171*t* overhanging toward the outer circumferential side is integrally formed with the cylindrical housing 171 near the opening section 171*a*. In the front bracket section 171*t*, the shaft hole 174 into which the second end section 102*b* of the idle shaft 102 (to be described below) is inserted is formed on a side of the opening section 171*a* opposite to the gear cover 172 (the left side of FIG. 16). In addition, the plurality of bolt insertion holes 175 are formed in the outer circumferential section of the front bracket section 171*t* in the circumferential direction at intervals.

As shown in FIG. 16, the gear cover 172 has an adhering surface (an abutting surface) 172*s* adhered to the front bracket section 171*t* at an opposite side of the cylindrical housing 171. A female screw hole (not shown) is formed in an outer circumferential section of the adhering surface 172*s* at a position coinciding with the bolt insertion hole 175. As a fastening bolt (a bolt) 177*a* is inserted through the bolt insertion hole 175 of the front bracket section 171*t* and screwed into the female screw hole, the cylindrical housing 171 is integrally adhered to the gear cover 172.

In addition, the gear cover 172 has the attachment bracket section 172*t* overhanging toward the outer circumferential side with respect to the adhering surface 172*s*. The plurality of bolt insertion holes 172*b* are formed in the attachment bracket section 172*t*, which can be fixed to the engine, the vehicle body chassis, or the like (not shown).

The gear cover 172 has the accommodating concave section 173 opened at an opposite side of the cylindrical housing 171 and configured to accommodate the clutch mechanism 5 and the transmission pinion gear (the transmission gear) 70, and the idle gear 101 (to be described below).

A bottomed bearing hole (a bearing concave section) 47 is formed in the bottom section 173*d* of the accommodating concave section 173 concentrically with the drive shaft 4. In addition, the shaft through-hole 179 through which the idle shaft 102 (to be described below) is inserted is formed in the bottom section 173*d* of the accommodating concave section 173 at a side of the bearing hole 47.

The bearing hole (the bearing concave section) 47 has an inner diameter larger than the outer diameter of the drive shaft 4. The slide bearing 178 configured to rotatably support the first side end (the left side end of FIG. 16) of the drive shaft 4 is press-fitted and fixed into the bearing hole 47. A lubricant formed of desired base oil is impregnated in the slide bearing 178, and the drive shaft 4 can smoothly come in sliding contact therewith.

In addition, the load receiving member 50 is disposed between the bottom section of the bearing hole 47 and the first side end surface 4*c* of the drive shaft 4.

The load receiving member 50 is a plate-shaped metal member, and for example, a ring-shaped washer formed by pressing is employed. The load receiving member 50 is formed of a material having hardness greater than that of the drive shaft 4 and good wear and abrasion resistance. Carbon tool steel such as SK85 or the like may be appropriately used as the material of the load receiving member 50.

As the load receiving member 50 is disposed, even when the thrust load is generated at the drive shaft 4 toward the first side (the left side of FIG. 16), the thrust load of the drive shaft 4 can be received while restricting movement of the drive shaft 4 using the load receiving member 50 installed on the gear cover 172. In addition, upon rotation of the drive shaft 4, since the first side end surface 4*c* of the drive shaft 4 comes in sliding contact with the load receiving member 50, direct sliding contact between the first side end surface 4*c* of the drive shaft 4 and the gear cover 172 can be prevented. Accordingly, the starter 1 configured to prevent abrasion of the gear cover 172 and having good durability can be provided.

Further, while grease used to reduce friction upon sliding contact with the first side end surface 4*c* of the drive shaft 4 is applied to peripheries of the load receiving member 50, since grease including the same base oil as the lubricant impregnated into the slide bearing 178 is employed as the grease, the lubricant of the slide bearing 178 can be held for a long time.

The concave section 4*a* into which the first side end (the left side end of FIG. 16) of the rotary shaft 52 can be inserted is formed on the second side end (the right side end of FIG. 16) of the drive shaft 4. The slide bearing 4*b* is press-fitted into the inner circumferential surface of the concave section 4*a*, and the drive shaft 4 and the rotary shaft 52 are connected to be relatively rotated.

(Idle Gear Unit)

The idle gear unit 100 includes the idle shaft 102 disposed in parallel with the drive shaft 4, the idle gear 101 integrally formed with an intermediate section in the axial direction of the idle shaft 102 and meshed with the transmission pinion gear 70, and the driving pinion gear (the driving gear) 110 installed on the first end section 102*a* of the idle shaft 102 and configured to mesh with the ring gear 23 of the engine (not shown).

The idle gear 101 is formed integrally with the outer circumferential surface of the idle shaft 102, and formed by increasing a diameter at the outer circumferential side from the idle shaft 102. The external tooth section 101*b* is formed on the outer circumferential surface of the idle gear 101.

The idle gear 101 and the transmission pinion gear 70 are configured of helical gears. While the skew direction of the teeth of the idle gear 101 is set to the same direction as the skew direction of the teeth of the driving pinion gear 110 (to be described below), the skew direction of the teeth of the transmission pinion gear 70 is set to the same direction as the skew direction of the teeth of the ring gear 23.

The second end section 102*b* of the idle shaft 102 is rotatably and movably supported in the axial direction (the thrust direction) by the shaft hole 174 formed on the front bracket section 171*t* of the cylindrical housing 171 via the slide bearing 103. In addition, the idle shaft 102 passes through the shaft through-hole 179 and the first end section 102*a* protrudes to the outside of the gear cover 172. The ball bearing 180 is installed on the inner circumferential surface of the shaft through-hole 179 and the idle shaft 102 is rotatably supported around the axis thereof by the ball bearing 180 between the idle gear 101 and the first end section 102*a*.

The idle washer 104 having a disk shape is fitted onto the outer circumferential section of the idle shaft 102 near the clutch mechanism 5 with respect to the idle gear 101. Movement of the idle washer 104 toward the clutch mechanism 5 in the escape direction is restricted by the retaining ring 105 attached to the idle shaft 102. In addition, an outer diameter of the idle washer 104 is set to be substantially the same as the outer diameter of the external tooth section 101*b*. Further, the outer circumferential section of the idle washer 104 is inserted into an annular gap between the external tooth section 70*b* of the transmission pinion gear 70 and the outer flange section 73. Accordingly, the idle shaft 102 having the idle gear 101 is movable with the transmission pinion gear 70 in the axial direction via the idle washer 104.

Here, the idle washer 104 has a function of improving slidability between the transmission pinion gear 70 and the idle gear 101, and grease or the like is applied as a lubricant.

In addition, the step difference section 102*d* is formed on a portion of the idle shaft 102 closer to the idle gear 101 than a portion thereof inserted through the ball bearing 180 by increasing the outer diameter. As shown in FIG. 19, as the step difference section 102*d* collides with the ball bearing 180, a movement of the idle shaft 102 toward the driving pinion gear 110 is restricted.

A seal member 190 is installed between a bottom section 179*c* of the shaft through-hole 179 and the ball bearing 180 in the shaft through-hole 179 through which the first end section 102*a* of the idle shaft 102 is exposed to the outside from the gear cover 172. As shown in FIGS. 20A, 20B and 21, the seal member 190 is a member formed of an elastic rubber material, and is configured of a ring section 191 formed to come in contact with a distal end of the ball bearing 180 and a lip section 192 integrally formed with an inner circumferential edge of the ring section 191.

The ring section 191 has an outer diameter set to be substantially the same as the inner diameter of the shaft through-hole 179. Then, substantially annular convex line sections 193 when seen in a plan view in the axial direction protrude from both surfaces of the ring section 191. The convex line section 193 is a member pressed against the ball bearing 180 and the bottom section 179*c* of the shaft through-hole 179 to be compressed and deformed, and is configured to increase sealability between the ball bearing 180 and the bottom section 179*c* of the shaft through-hole 179 and to prevent intrusion of moisture or foreign substances from the outside into the starter 1.

In addition, the lip section 192 integrally formed with the inner circumferential edge of the ring section 191 extends to be gradually inclined toward the first side (the left side of FIG. 16) of the idle shaft 102, i.e., a front side in an advance direction of the driving pinion gear 110, from the inner circumferential edge of the ring section 191 toward the inside in the radial direction.

The lip section 192 has an inner diameter d3 set to be slightly smaller than the outer diameter of the idle shaft 102.

A small ring section 194 having a substantially circular cross-section is integrally formed with the inner circumferential edge of the lip section 192, and the small ring section 194 comes in sliding contact with the outer circumferential surface of the idle shaft 102. The small ring section 194 is formed in a substantially circular cross-sectional shape, in other words, the small ring section 194 has an inner diameter that gradually increases toward a front side in the advance direction of the driving pinion gear 110.

In addition, a fluorine resin coat (not shown) is formed on an outer surface of the small ring section 194.

Sliding frictional resistance between the seal member 190 and the idle shaft 102 is reduced by the fluorine resin coat.

As shown in FIG. 16, in the idle shaft 102, the spline 108 is formed on the outer circumferential surface of the first end section 102*a* passing through the shaft through-hole 179 and protruding to the outside of the gear cover 172. The spline 110*a* is formed on the spline 108 of the distal end side of the inner circumferential surface of the driving pinion gear 110. The spline 108 of the idle shaft 102 side is longer in the axial direction than the spline 110*a* of the driving pinion gear 110. Accordingly, the idle shaft 102 and the driving pinion gear 110 cannot be rotated relative to each other but are slidable in the axial direction.

In addition, the step difference section 102*c* having a diameter larger than that of the spline 108 side is formed on the idle shaft 102 closer to the second side than the spline 108.

Meanwhile, the extended cylindrical section 110*d* extending toward the second side is formed on the end surface of the second side (the right side of FIG. 16) of the driving pinion gear 110. The extended cylindrical section 110*d* is formed concentrically with the idle shaft 102. The extended cylindrical section 110*d* can abut the step difference section 102*c* when the driving pinion gear 110 slides to the second side (the right side of FIG. 16) in the axial direction. That is, when the driving pinion gear 110 slides in the axial direction with respect to the idle shaft 102, the extended cylindrical section 110*d* collides with the step difference section 102*c*, and thus movement of the driving pinion gear 110 toward the second side is restricted.

The retaining ring 106 fixed onto the idle shaft 102 is installed on the first end section 102*a* of the idle shaft 102. Accordingly, the driving pinion gear 110 restricts escape of the idle shaft 102 to the first side with respect to the idle shaft 102.

Here, in the driving pinion gear 110, the pitch diameter D1 of the external tooth section 110*g* may be set with respect to the pitch diameter D2 of the external tooth section 101*b* of the idle gear 101 to satisfy the following relation:

$$D1 \leq D2.$$

Further, the diameters may be set to the following relation:

$$D1 < D2.$$

When the pitch diameter D2 of the external tooth section 101*b* of the idle gear 101 is larger than the pitch diameter D1 of the external tooth section 110*g*, a torque obtained by the external tooth section 101*b* is larger than a torque output from the driving pinion gear 110. That is, torque transmission from the idle gear 101 side, i.e., the drive shaft 4, to the driving pinion gear 110 can be efficiently performed.

The ring gear 23 and the driving pinion gear 110 are configured of helical gears. Skew directions of the teeth of the ring gear 23 and the driving pinion gear 110 are set such that the thrust load in the plunge direction with respect to the ring gear 23 is generated at the driving pinion gear 110 such that the driving pinion gear 110 drives the ring gear 23.

In addition, upon cranking when the engine is started, the rotational speed of the ring gear 23 is likely to be varied. Here, when a rotational speed difference occurs between the driving pinion gear 110 and the ring gear 23, which are helically meshed, a direction of the thrust load applied to the driving pinion gear 110 is varied.

When the rotational speed of the ring gear 23 is lower than that of the driving pinion gear 110, the thrust load in the direction approaching the ring gear 23 is generated at the driving pinion gear 110. In addition, when the rotational speed of the ring gear 23 is higher than that of the driving pinion gear 110, the thrust load in the direction away from the ring gear 23 (the right side of FIG. 16) is generated at the driving pinion gear 110.

However, in this case, since the rotational speed of the idle gear 101 is higher than that of the transmission pinion gear 70, a thrust load in an opposite direction of the thrust load applied from the ring gear 23 to the driving pinion gear 110 is applied to the idle gear 101 from the transmission pinion gear 70. For this reason, the thrust load applied to the driving pinion gear 110 in the direction away from the ring gear 23 is offset. That is, while the skew direction of the teeth of the idle gear 101 is set to the same direction as the skew direction of the teeth of the driving pinion gear 110, since the skew direction of the teeth of the transmission pinion gear 70 is set to the same direction as the skew direction of the teeth of the ring gear 23, the direction of the thrust load generated at the driving pinion gear 110 is opposite to the direction of the thrust load generated at the idle gear 101, and the thrust loads are offset with respect to each other.

Here, the thrust load in the direction away from the driving pinion gear 110 may be set to be larger than the thrust load in the opposite direction applied to the idle gear 101. Further, the thrust load in the separating direction of the driving pinion gear 110 may be smaller than the attractive force by the electromagnetic device 9.

The expansion diameter section 111 having a diameter increased via the step difference section 110*b* is formed on a rear end side of the spline 110*a* of the inner circumferential surface of the driving pinion gear 110, and the receiving section 112 is formed between the idle shaft 102 and the driving pinion gear 110.

An opening section formed on the receiving section 112 near the idle gear 101 is closed by the step difference section 102*e* having a diameter increased at the end section of the spline 108 of the idle shaft 102 near the idle gear 101.

The pinion spring 113 formed to surround the outer circumferential surface of the idle shaft 102 is received in the receiving section 112. The pinion spring 113 is formed of, for example, a coil spring.

The pinion spring 113, which is received in the receiving section 112, is compressed and deformed by the step difference section 110*b* of the expansion diameter section 111 of the driving pinion gear 110 and the step difference section 102*e* of the idle shaft 102. Accordingly, the driving pinion gear 110 is biased toward the ring gear 23 with respect to the idle shaft 102.

As described above, the pinion spring 113 functions as a damper mechanism elastically deformed in the axial direction to absorb a shock when the driving pinion gear 110 abuts the ring gear 23. Accordingly, abrasion between the driving pinion gear 110 and the ring gear 23 is suppressed, and durability of the starter 1 is improved.

(Electromagnetic Device)

The yoke 25 that constitutes the electromagnetic device 9 is fitted and fixed into the inner circumferential surface of the housing 17 closer to the motor unit 3 than the clutch mechanism 5. The yoke 25 is formed of a magnetic material in a bottomed cylindrical shape, and most of a center portion in the radial direction of the bottom section 25*a* is largely opened.

In addition, the annular plunger holder 26 formed of a magnetic material is formed on an opposite end of the bottom section 25*a* of the yoke 25. A cylindrical section 26*b* extending toward the second side in the axial direction is formed on the inside in the radial direction of the plunger holder 26. Accordingly, since a spaced distance of the gear plunger 80 from the iron core 88 (to be described below) is reduced, an attractive force of the iron core 88 by the plunger holder 26 (hereinafter, simply referred to as an "attractive force") can be increased.

The exciting coil 24 formed in a substantially cylindrical shape is received in the receiving concave section 25*b* formed inside in the radial direction by the yoke 25 and the plunger holder 26. The exciting coil 24 is electrically connected to an ignition switch via a connector (neither of which is shown).

The plunger mechanism 37 is installed in an aperture between the inner circumferential surface of the exciting coil 24 and the outer circumferential surface of the drive shaft 4 so as to be slidable in the axial direction with respect to the exciting coil 24.

The plunger mechanism 37 has the switch plunger 27 formed of a magnetic material in a substantially cylindrical shape, and the gear plunger 80 disposed in the aperture between the switch plunger 27 and the outer circumferential surface of the drive shaft 4. The switch plunger 27 and the gear plunger 80 are installed concentrically and are relatively movable in the axial direction. In addition, the switch return spring 27*a* configured of a leaf spring member configured to bias them away from each other is disposed between the plunger holder 26 and the switch plunger 27.

The outer flange section 29 is integrally formed with an end of the switch plunger 27 near the motor unit 3. The switch shaft 30 is vertically installed on the outer circumferential section side of the outer flange section 29 in the axial direction via the holder member 30*a*. The switch shaft 30 passes through the top plate 12 of the motor unit 3 and the brush holder 33 (to be described below). The movable contact plate 8 of the switch unit 7 disposed in vicinity of the commutator 61 of the brushed direct current motor 51 is connected to the end section of the switch shaft 30 protruding from the top plate 12.

The movable contact plate 8 is slidably attached to the switch shaft 30 in the axial direction and floatingly supported by the switch spring 32. Then, the movable contact plate 8 can approach or be separated from the fixed contact plate 34 of the switch unit 7, which is fixed to the brush holder 33 (to be described below).

The fixed contact plate 34 is divided into the first fixed contact plate 34*a* disposed at the inside in the radial direction near the commutator 61 with the switch shaft 30 sandwiched therebetween, and the second fixed contact plate 34*b* disposed at the outside in the radial direction opposite to the commutator 61. The movable contact plate 8 is configured to abut and straddle both of the first fixed contact plate 34*a* and the second fixed contact plate 34*b*. As the movable contact plate 8 strokes along the drive shaft 4 and the first fixed contact plate 34*a* and the second fixed contact plate 34*b* abut each other, the first fixed contact plate 34*a* and the second fixed contact plate 34*b* become electrically connected in an ON state.

The ring member 27*r* abutting and away from the gear plunger 80 is integrally formed with the inner circumferential surface of the switch plunger 27. The ring member 27*r* is a member configured to initially press the gear plunger 80 toward the ring gear 23 when the switch plunger 27 slides toward the ring gear 23.

The outer clutch 18 of the clutch mechanism 5 is biased toward the inner plunger 81 by the return spring 21. Accordingly, in a state in which the starter 1 is stopped (see FIG. 16), the clutch mechanism 5 presses the switch plunger 27 toward the second side (the right side of FIG. 16) via the gear plunger 80 and the ring member 27*r*. Accordingly, the movable contact plate 8 is pressed toward the second side to become separated from the fixed contact plate 34 in the OFF state.

When the electromagnetic device 9 slides the transmission pinion gear 70 and the movable contact plate 8 toward the first side (the left side of FIG. 16), the movable contact plate 8 enters the ON state and the transmission pinion gear 70 abuts the ring gear 23.

The gear plunger 80 disposed inside in the radial direction of the switch plunger 27 includes the inner plunger 81 disposed inside in the radial direction, the outer plunger 85 disposed outside in the radial direction, and the plunger spring 91 disposed between the inner plunger 81 and the outer plunger 85.

The inner plunger 81 is formed of a resin or the like in a substantially cylindrical shape. The inner plunger 81 has an inner diameter slightly larger than the outer diameter of the drive shaft 4 to be fitted on the drive shaft 4. Accordingly, the inner plunger 81 is installed so as to be slidable in the axial direction with respect to the drive shaft 4.

The outer flange section 82 overhanging toward the outside in the radial direction is integrally formed with the first side end 81*a* (the left side end of FIG. 16) of the inner plunger 81. When the inner plunger 81 slides to the first side as described above, the first side end 81*a* of the inner plunger 81 abuts the second side end of the outer clutch 18 to slide the clutch mechanism 5 and the transmission pinion gear 70 to the first side.

The second side end 81*b* (the right side end of FIG. 16) of the inner plunger 81 has the plurality of claw sections 83 formed in the circumferential direction and having outer diameters gradually increased from the second side toward the first side. In addition, the groove section 84 is formed on the first side (the left side of FIG. 16) of the claw section 83 in the circumferential direction.

The outer plunger 85 is formed of a resin or the like in a substantially cylindrical shape like the inner plunger 81. The outer plunger 85 has an inner diameter slightly larger than the outer diameter of the outer flange section 82 of the inner plunger 81, and is fitted onto the inner plunger 81.

The inner flange section 86 overhanging inward in the radial direction is integrally formed with the second side end 85*a* (the right side end of FIG. 16) of the outer plunger 85. The inner diameter of the inner flange section 86 is smaller than the outer diameter of the claw section 83 of the inner plunger 81 and larger than the outer diameter of the bottom section of the groove section 84 of the inner plunger 81. Then, as the inner flange section 86 of the outer plunger 85 is disposed in the groove section 84 of the inner plunger 81, the inner plunger 81 and the outer plunger 85 are integrated to configure the plunger mechanism 37.

A thickness of the inner flange section 86 of the outer plunger 85 is smaller than the width of the groove section 84 of the inner plunger 81. Accordingly, a clearance is formed between the inner flange section 86 of the outer plunger 85 and the groove section 84 of the inner plunger 81. Accordingly, the inner plunger 81 and the outer plunger 85 are relatively slidable in the axial direction to an extent of the clearance between the inner flange section 86 of the outer plunger 85 and the groove section 84 of the inner plunger 81.

The outer flange section 87 overhanging outward in the radial direction is integrally formed with the second side end 85*a* (the right side end of FIG. 16) of the outer plunger 85. The outer flange section 87 functions as the abutting section configured to abut the ring member 27*r* of the switch plunger 27.

In addition, a ring-shaped iron core 88 is installed on the outer circumferential surface of the outer plunger 85, which is the first side (the left side of FIG. 16) of the outer flange section 87. The iron core 88 is integrally formed with the outer plunger 85 by, for example, a resin mold. The iron core 88 is attracted to the electromagnetic device 9 with a predetermined attractive force by a magnetic flux generated when current is supplied to the exciting coil 24 as described below.

The receiving section 90 is formed between the outer flange section 82 of the inner plunger 81 and the inner flange section 86 of the outer plunger 85. The plunger spring 91 formed to surround the outer circumferential surface of the inner plunger 81 is received in the receiving section 90.

The plunger spring 91, which is received in the receiving section 90, is compressed and deformed by the outer flange section 82 of the inner plunger 81 and the inner flange section 86 of the outer plunger 85. Then, the inner plunger 81 is biased toward the first side (the left side of FIG. 16) and the outer plunger 85 is biased toward the second side (the right side of FIG. 16) so that the plungers are alternately biased.

The inner plunger 81 is biased toward the first side (the left side of FIG. 16) and the outer plunger 85 is biased toward the second side (the right side of FIG. 16) by the plunger spring 91 to be alternately biased, and the first side end 81*a* of the inner plunger 81 does not come in contact with the second side end of the outer clutch 18. Accordingly, the outer clutch 18 is pressed against the stopper 94 by a spring load of the return spring 21. Accordingly, in a state in which the starter 1 is stopped, the clutch mechanism 5 is not pushed by the spring load of the plunger spring 91, i.e., the transmission pinion gear 70 is set so as not to be unintentionally pushed.

In addition, as shown in FIG. 19, in the electrical connection state of the starter 1, when the gear plunger 80 is maximally displaced to the first side (the left side of FIG. 19), the first side end 81*a* of the inner plunger 81 constantly abuts the second side end of the outer clutch 18 of the clutch mechanism 5.

That is, the plunger spring 91 constitutes a backlash absorption mechanism configured to prevent generation of the aperture in the axial direction between the clutch mechanism 5 and the gear plunger 80 and absorb backlash of the clutch mechanism 5.

The brush holder 33 is formed closer to the second side (the right side of FIG. 16) than the electromagnetic device 9 and the planetary gear mechanism 2. Here, the cut and raised section 34*c* curved and integrally formed in the axial direction is formed on the outer circumferential side of the second fixed contact plate 34*b*. The axial terminal 44*a* passes through the outer wall 33*a* of the brush holder 33 to protrude outward in the radial direction of the starter 1 via the insertion hole of the cut and raised section 34*c*. Further, a terminal bolt 344*b* to which a positive electrode of a battery is electrically connected is installed on a distal end of a protrusion side of the axial terminal 44*a*.

Further, the cover 45 configured to protect peripheries of the fixed contact plate 34 and the switch shaft 30 is mounted on the brush holder 33. The brush holder 33 and the cover 45 are fixed and sandwiched between the motor yoke 53 and the cylindrical housing 171. The four brushes 41 are disposed at the brush holder 33 around the commutator 61 to advance or retract in the radial direction.

The brush spring 42 is installed on the base end side of each of the brushes 41. The brushes 41 are biased toward the commutator 61 by the brush spring 42, and the distal ends of the brushes 41 come in sliding contact with the segment 62 of the commutator 61.

The four brushes 41 are configured of the two positive-electrode-side brushes and the two negative-electrode-side brushes. The two positive-electrode-side brushes are connected to the first fixed contact plate 34*a* of the fixed contact plate 34 via a pigtail (not shown). Meanwhile, the positive electrode of the battery (not shown) is electrically connected to the second fixed contact plate 34*b* of the fixed contact plate 34 via the terminal bolt 344*b*.

That is, when the movable contact plate 8 abuts the fixed contact plate 34, a voltage is applied to the two positive-electrode-side brushes among the four brushes 41 via the terminal bolt 344*b*, the fixed contact plate 34 and the pigtail (not shown), and current is supplied to the coil 59.

In addition, the two negative-electrode-side brushes among the four brushes 41 are connected to a ring-shaped center plate via a pigtail (not shown). Then, the two negative-electrode-side brushes among the four brushes 41 are electrically connected to the negative electrode of the battery via the center plate, the housing 17 and the vehicle body (not shown).

(Effects)

According to this embodiment, the ring gear 23 is helically meshed with the driving pinion gear 110 installed on the idle shaft 102, and the idle gear 101 installed on the idle shaft 102 is meshed with the transmission pinion gear 70 installed on the drive shaft 4. Accordingly, when the rotational speed of the ring gear 23 is higher than that of the driving pinion gear 110, even if a thrust load F2 is generated at the driving pinion gear 110 in a direction away from the ring gear 23 (a right side of FIG. 19), a thrust load in an opposite direction from a helical mesh section between the idle gear 101 and the driving pinion gear 110 can be applied. Accordingly, the thrust load applied to the driving pinion gear 110 in the direction away from the ring gear 23 can be offset. Accordingly, unintentional separation of the driving pinion gear 110 from the ring gear 23 can be prevented. Here, enhancement of the electromagnetic force in the electromagnetic device 9 is not needed, and thus an increase in size and weight of the starter 1 is not needed either.

Further, noises from an operation of the starter 1 can be reduced by the helical meshing between the ring gear 23 and the driving pinion gear 110 and the helical meshing between the idle gear 101 and the transmission pinion gear 70.

In addition, according to this embodiment, the pitch diameter D1 of the external tooth section 110*g* of the driving pinion gear 110 with respect to the pitch diameter D2 of the idle gear 101 is set to satisfy the following relation:

$$D1 \leq D2.$$

Thus, torque transmission from the idle gear 101 side, i.e., the drive shaft 4 side, to the driving pinion gear 110 can be efficiently performed. That is, starting performance of the engine in the starter 1 can be improved.

Further, according to this embodiment, the seal member 190 is installed on the shaft through-hole 179 in which the first end section 102*a* of the idle shaft 102 is exposed to the outside from the gear cover 172. The lip section 192 of the seal member 190 has the inner diameter d3 set to be smaller than the outer diameter of the idle shaft 102. Accordingly, even when the idle shaft 102 is moved in the axial direction, sealing performance in the shaft through-hole 179 can be maintained at a high level, and intrusion of moisture or foreign substances from the outside can be securely prevented.

In addition, as the driving pinion gear 110 is installed on the idle shaft 102 offset and disposed with respect to the drive shaft 4, for example, as shown in FIG. 22, even when a surrounding space is limited, layout performance of the starter 1 can be improved.

Fifth Embodiment

Next, a fifth embodiment of a starter according to the present invention will be described. Further, in the fifth embodiment to be described below, the same elements as the first embodiment to the fourth embodiment are designated by the same reference numerals throughout the drawings and a description thereof will be omitted here.

Figure 23A:
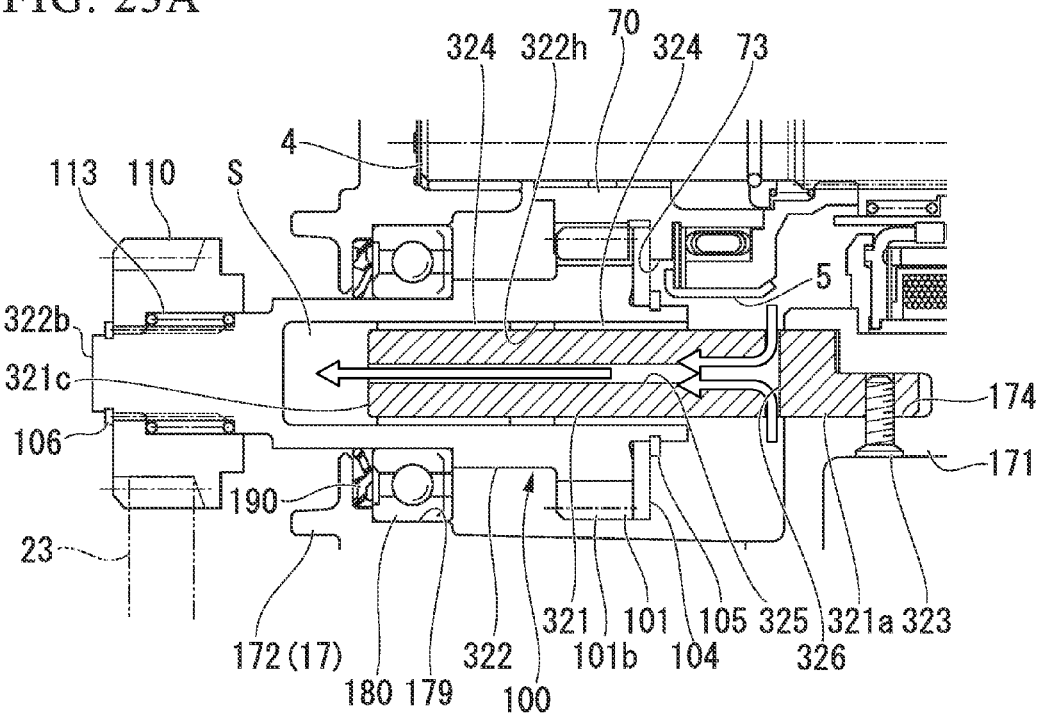
FIG. 23A is a cross-sectional view of major parts of a starter according to a fifth embodiment of the present invention at the time an engine is started by a driving pinion gear.
Figure 23B:
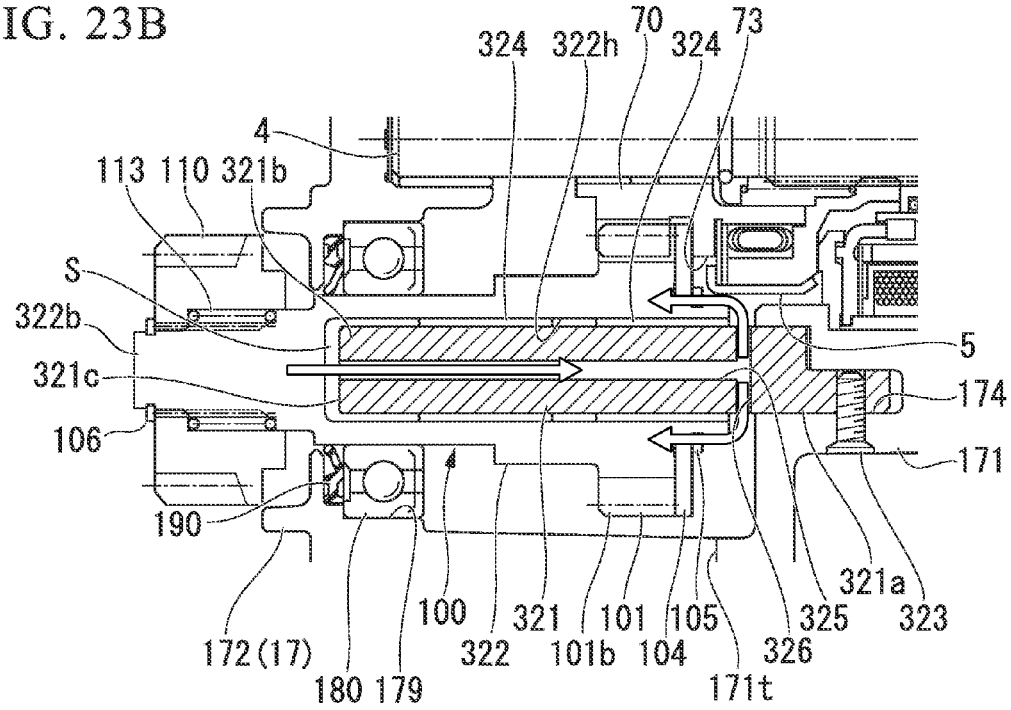
FIG. 23B is a cross-sectional view of the major parts of the starter according to the fifth embodiment of the present invention when the driving pinion gear is separated from the ring gear.

FIGS. 23A and 23B are views showing major parts of the starter according to the fifth embodiment of the present invention. FIG. 23A is a cross-sectional view of the starter such that the engine is started by the driving pinion gear. FIG. 23B is a cross-sectional view of the starter when the driving pinion gear is separated from the ring gear.

As shown in FIGS. 23A and 23B, in this embodiment, the idle gear unit 100 includes a support shaft 321 disposed in parallel with the drive shaft 4, an idle shaft 322 having a bottomed cylindrical shape and fitted onto the support shaft 321, the idle gear 101 formed on an outer circumferential section of the idle shaft 322 and meshed with the transmission pinion gear 70, and the driving pinion gear 110 formed on a second end section 321*b* of the support shaft 321 and configured to mesh with the ring gear 23 of the engine (not shown).

The support shaft 321 has a first end section 321*a* inserted into the shaft hole 174 formed in the front bracket section 171*t* of the cylindrical housing 171, and is fixed by a screw member 323 threaded from the outside of the cylindrical housing 171. Further, one-side machining is performed in the first end section 321*a*, and a step difference conforming to a shape formed by the one-side machining is formed on a bottom section of the shaft hole 174.

The support shaft 321 is disposed such that the second end section 321*b* is positioned inside the ball bearing 180 installed in the shaft through-hole 179.

The idle shaft 322 has a bottomed shaft insertion hole (a hole) 322*h* opened at the clutch mechanism 5 side. Two slide bearings 324 and 324 are installed on the inner circumferential surface of the shaft insertion hole 322*h*, and the support shaft 321 is inserted thereinto. Accordingly, the idle shaft 322 is movable in the axial direction of the support shaft 321 and rotatably supported by an axis thereof.

In addition, the idle gear 101 is integrally formed with the outer circumferential surface of the idle shaft 322. Then, the idle shaft 322 passes through the shaft through-hole 179, and a second end section 322*b* thereof protrudes to the outside of the gear cover 172. The ball bearing 180 is installed on the inner circumferential surface of the shaft through-hole 179, and the idle shaft 322 is rotatably supported around an axis thereof by the ball bearing 180 between the idle gear 101 and the second end section 322*b*.

The idle washer 104 having a disk shape is fitted onto the outer circumferential section of the idle shaft 322 near the clutch mechanism 5 with respect to the idle gear 101. Movement in the escape direction of the idle washer 104 toward the clutch mechanism 5 is restricted by the retaining ring 105 attached to the idle shaft 322. In addition, an outer diameter of the idle washer 104 is set to be substantially the same as the outer diameter of the external tooth section 101*b*. Further, the idle washer 104 has an outer circumferential section inserted into an annular gap between the external tooth section 70*b* of the transmission pinion gear 70 and the outer flange section 73. Accordingly, the support shaft 321 having the idle gear 101 is movable with the transmission pinion gear 70 in the axial direction via the idle washer 104.

An air discharge hole (an air passage) 325 opened at a distal end surface 321*c* of a bottom section side of the shaft insertion hole 322*h* of the idle shaft 322 is formed in the support shaft 321 to continue along the central shaft. The air discharge hole 325 comes in communication with an air discharge hole (an air passage) 326 formed on a position exposed to the outside of the shaft insertion hole 322*h*, at the base section side of the support shaft 321.

In the above-described idle gear unit 100, like the fourth embodiment, as shown in FIG. 23A, upon start of the engine, as the clutch mechanism 5 installed on the drive shaft 4 is pushed out toward the ring gear 23, the idle gear 101 interlocked with the transmission pinion gear 70 integrated with the clutch mechanism 5 is pushed out toward the ring gear 23 while being rotated. Then, the driving pinion gear 110 installed on the idle shaft 322 is also integrated with the idle gear 101 and pushed out toward the ring gear 23 while being rotated. Accordingly, the volume of a space S formed between the shaft insertion hole 322*h* and the distal end surface 321*c* of the support shaft 321 is reduced. Here, air in the space S is discharged from the inside of the shaft insertion hole 322*h* through the air discharge hole 325 and the air discharge hole 326.

As shown in FIG. 23B, after completion of the start of the engine, when the idle shaft 322 is moved with the driving pinion gear 110 in the direction away from the ring gear 23, the volume of the space S in the shaft insertion hole 322*h* is increased. Here, air is introduced into the space S from the outside through the air discharge hole 325 and the air discharge hole 326.

In the starter 1 according to this embodiment, as the air discharge hole 325 and the air discharge hole 326 are formed in the support shaft 321 of the idle gear unit 100, the air remaining in the space S between the shaft insertion hole 322*h* and the shaft insertion hole 322*h* can be smoothly removed. Accordingly, compressive resistance generated by pumping the air remaining in the space S can be suppressed, and a smooth operation of the idle gear unit 100 can be realized.

In addition, since the support shaft 321 is disposed such that the second end section 321*b* is positioned inside the ball bearing 180 installed in the shaft through-hole 179, regardless of the position at which the idle shaft 322 is disposed, the idle shaft 322 can be supported from the inside and a radial load can be received.

Sixth Embodiment

Next, a sixth embodiment of the present invention will be described. The embodiment is an embodiment in which the configurations of the fourth embodiment and the fifth embodiment are modified.

In the fifth embodiment, while the air discharge hole 325 and the air discharge hole 326 are formed in the support shaft 321, an air passage may be formed on the idle shaft 322 side.

In addition, in the fourth embodiment and the fifth embodiment, while the example of the starter in which the shaft of the electromagnetic device (the plunger mechanism 37), the rotary shaft 52 and the drive shaft 4 are concentrically disposed and the idle shafts 102 and 322 are disposed in parallel with the drive shaft 4 was shown, the present invention is not limited thereto, and for example, may be applied to various types of starters such as a starter in which the shaft of the electromagnetic device (the plunger mechanism 37), the rotary shaft 52 and the drive shaft 4 are eccentrically disposed.

Seventh Embodiment

Next, a seventh embodiment of the present invention will be described based on FIGS. 24 and 25. Further, the same elements as the first embodiment to the sixth embodiment will be described with the same reference numerals.

Figure 24:
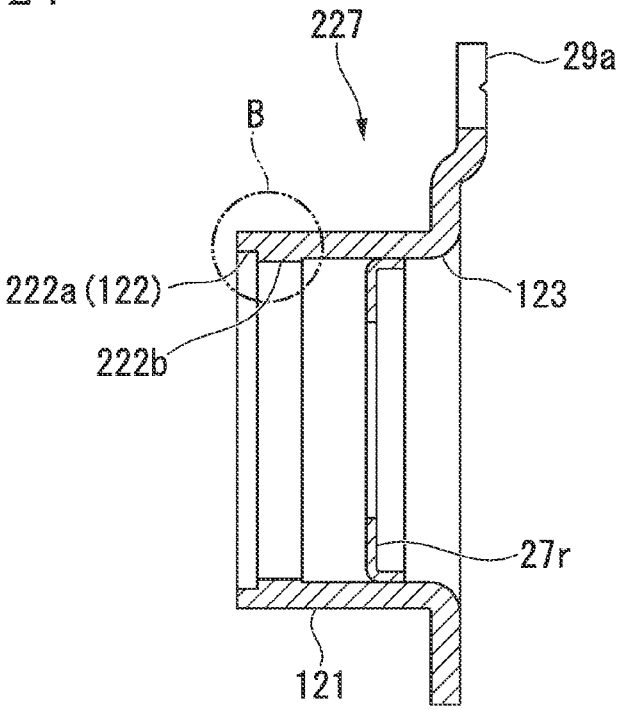
FIG. 24 is a cross-sectional view of a switch plunger according to a seventh embodiment of the present invention.

FIG. 24 is a cross-sectional view of a switch plunger according to a seventh embodiment, corresponding to FIG. 10 of the above-described first embodiment. FIG. 25 is an enlarged view of a portion B of FIG. 24.

Figure 25:
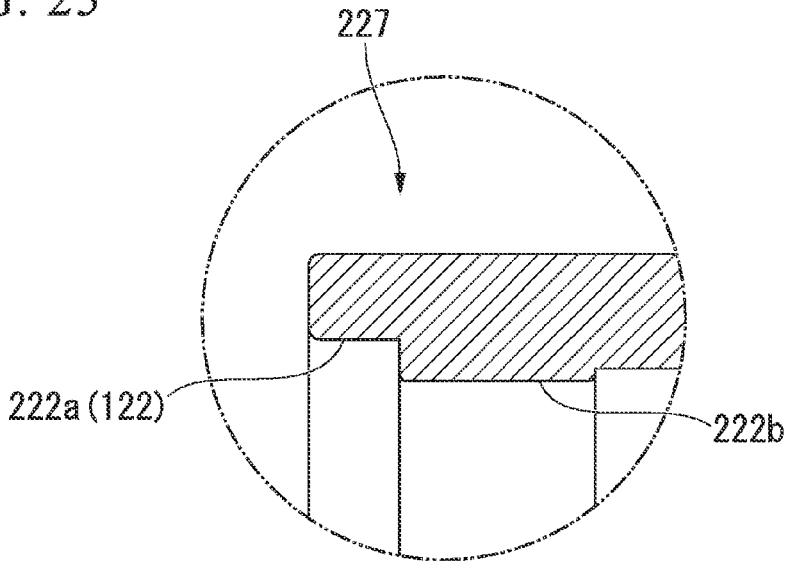
FIG. 25 is an enlarged view of a portion B of FIG. 24.

As shown in FIGS. 24 and 25, the seventh embodiment is distinguished from the above-described first embodiment in that, while the switch plunger 27 of the first embodiment is formed by pressing the expansion diameter section 122*a* and the convex line section 122*b*, an expansion diameter section 222*a* and a convex line section 222*b* are formed on a switch plunger 227 of the seventh embodiment through machining.

That is, in the seventh embodiment, the inner circumferential surface of the switch-plunger-side cylindrical section 121 is formed by cutting the first opening section 122 and the second opening section 123 from both sides thereof to form the expansion diameter section 222*a* and the convex line section 222*b*. In the above-described configuration, a boundary (a ridgeline) of the expansion diameter section 222*a* and the convex line section 222*b* can be more apparent than in the above-described first embodiment.

Accordingly, in the above-described seventh embodiment, regardless of proximity of the expansion diameter section 222*a* and the convex line section 222*b*, magnetic flux density between the convex line section 122*b* and the iron core 88 can be increased while suppressing leakage of a magnetic flux from the plunger-holder-side cylindrical section 26*b* to the switch plunger 227. For this reason, when the gear plunger 80 completely slides toward the ring gear, a position of the iron core 88 can be further held by the plunger-holder-side cylindrical section 26*b* and the convex line section 222*b* of the switch plunger 227.

Further, the present invention is not limited to this embodiment but may include aspects in which various modifications are added to this embodiment without departing from the spirit of the present invention.

For example, in this embodiment, the case in which the expansion diameter sections 122*a* and 222*a* are formed on the switch-plunger-side cylindrical section 121 as unit of increasing an interval between the plunger-holder-side cylindrical section 26*b* and the switch plungers 27 and 227 has been described. However, this embodiment of the present invention is not limited thereto, but the inner circumferential surface of the switch-plunger-side cylindrical section 121 is cut at a plurality of places in the circumferential direction and an interval between the plunger-holder-side cylindrical section 26*b* and the switch plungers 27 and 227 may be partially increased. Even in the case of the above-described configuration, a leakage of the magnetic flux from the plunger-holder-side cylindrical section 26*b* to the switch plunger 227 can be suppressed in comparison with the conventional art.

Similarly, the convex line sections 122*b* and 222*b* of the switch plungers 27 and 227 are not formed throughout the entire circumference either, and the convex line sections 122*b* and 222*b* may be formed on a plurality of places of the inner circumferential surface of the switch-plunger-side cylindrical section 121 in the circumferential direction. Even in the case of the above-described configuration, since a magnetic flux density between the switch-plunger-side cylindrical section 121 and the iron core 88 can be partially increased, in comparison with the conventional art, a magnetic attractive force of the iron core 88 by the switch-plunger-side cylindrical section 121 can be increased.

In addition, in this embodiment, the case in which the starter 1 is a so-called 2-shaft type starter having two shafts, i.e., the drive shaft 4 and the idle shaft 102, has been described. However, this embodiment of the present invention is not limited thereto but the above-described electromagnetic device 9 may be applied to also a so-called single shaft type starter in which the driving pinion gear 110 is installed on the drive shaft 4.

Eighth Embodiment

Starter

Next, an eighth embodiment of the present invention will be described based on the accompanying drawings.

Figure 26:
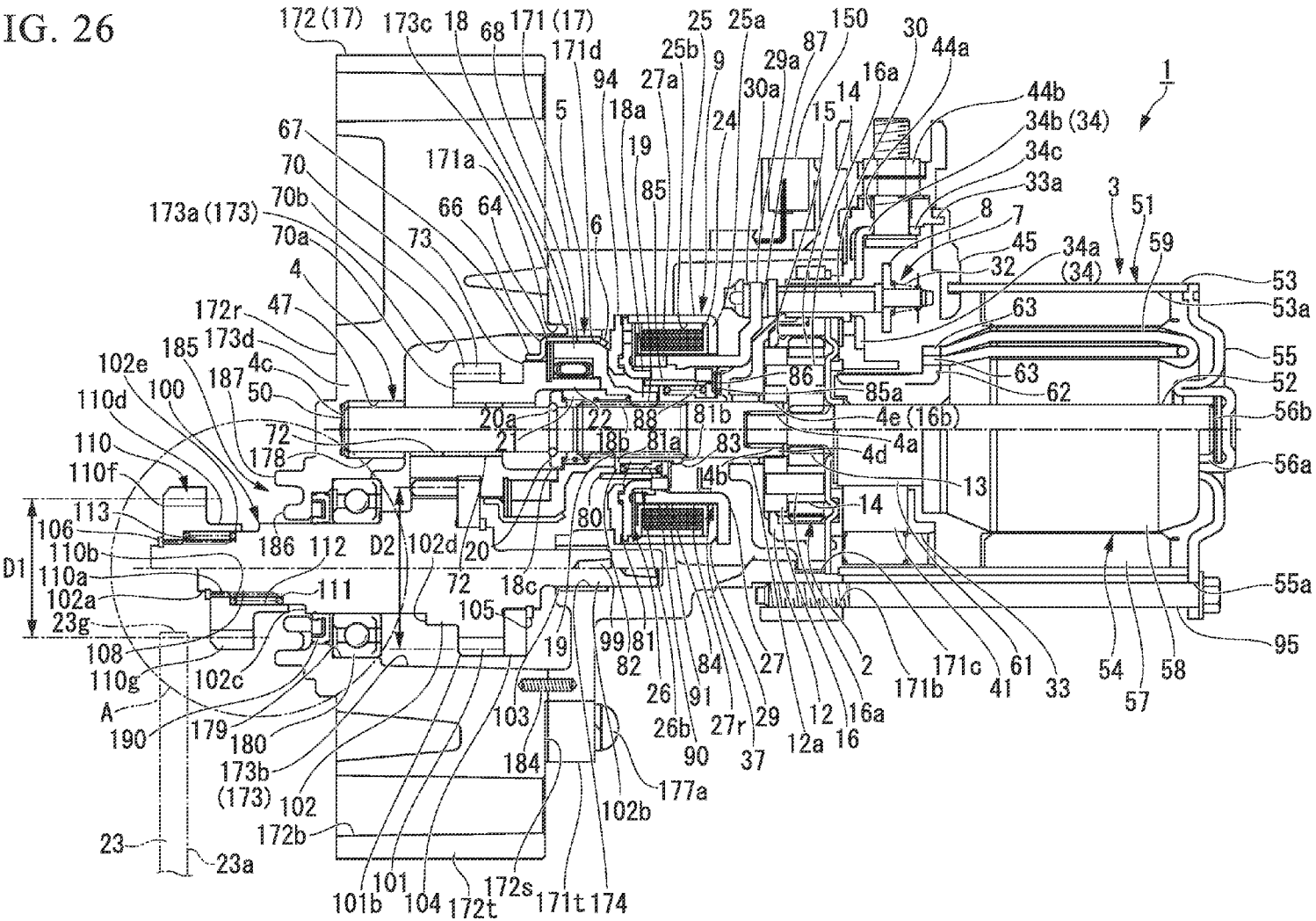
FIG. 26 is a cross-sectional view of a starter according to an eighth embodiment of the present invention.
Figure 27:
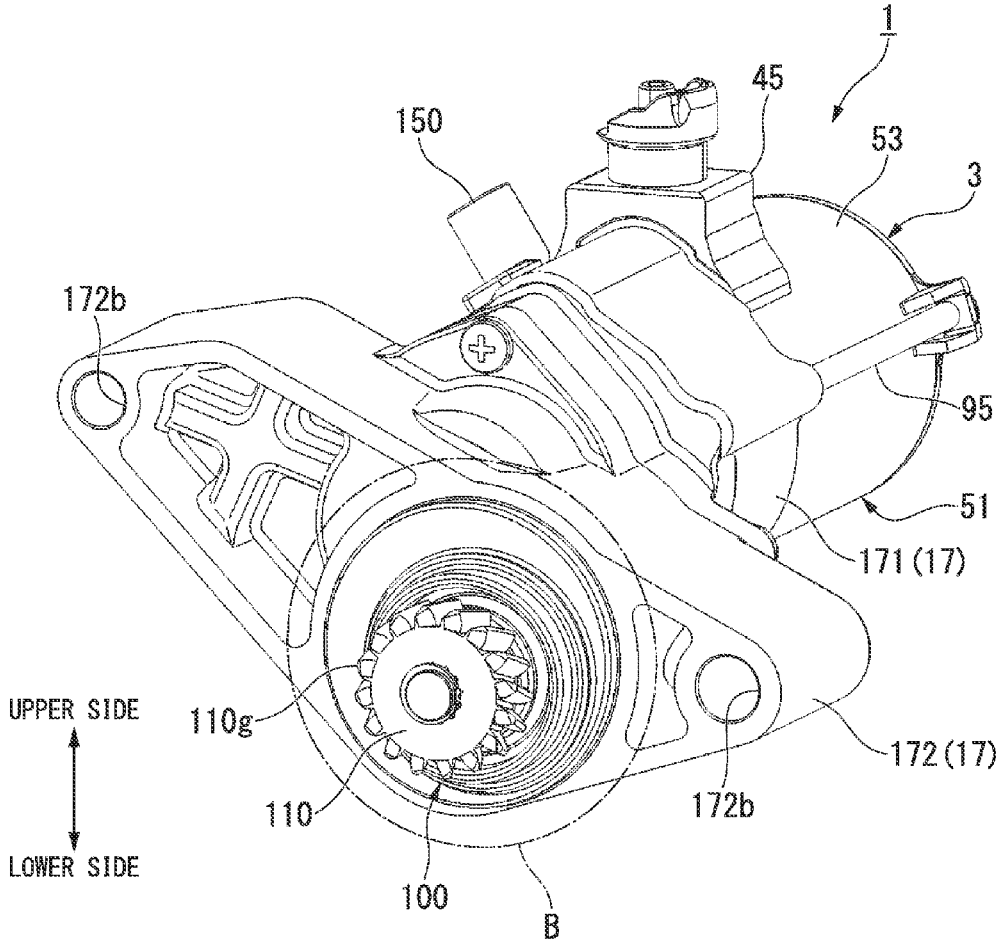
FIG. 27 is a perspective view of the starter according to the eighth embodiment of the present invention.
Figure 28:
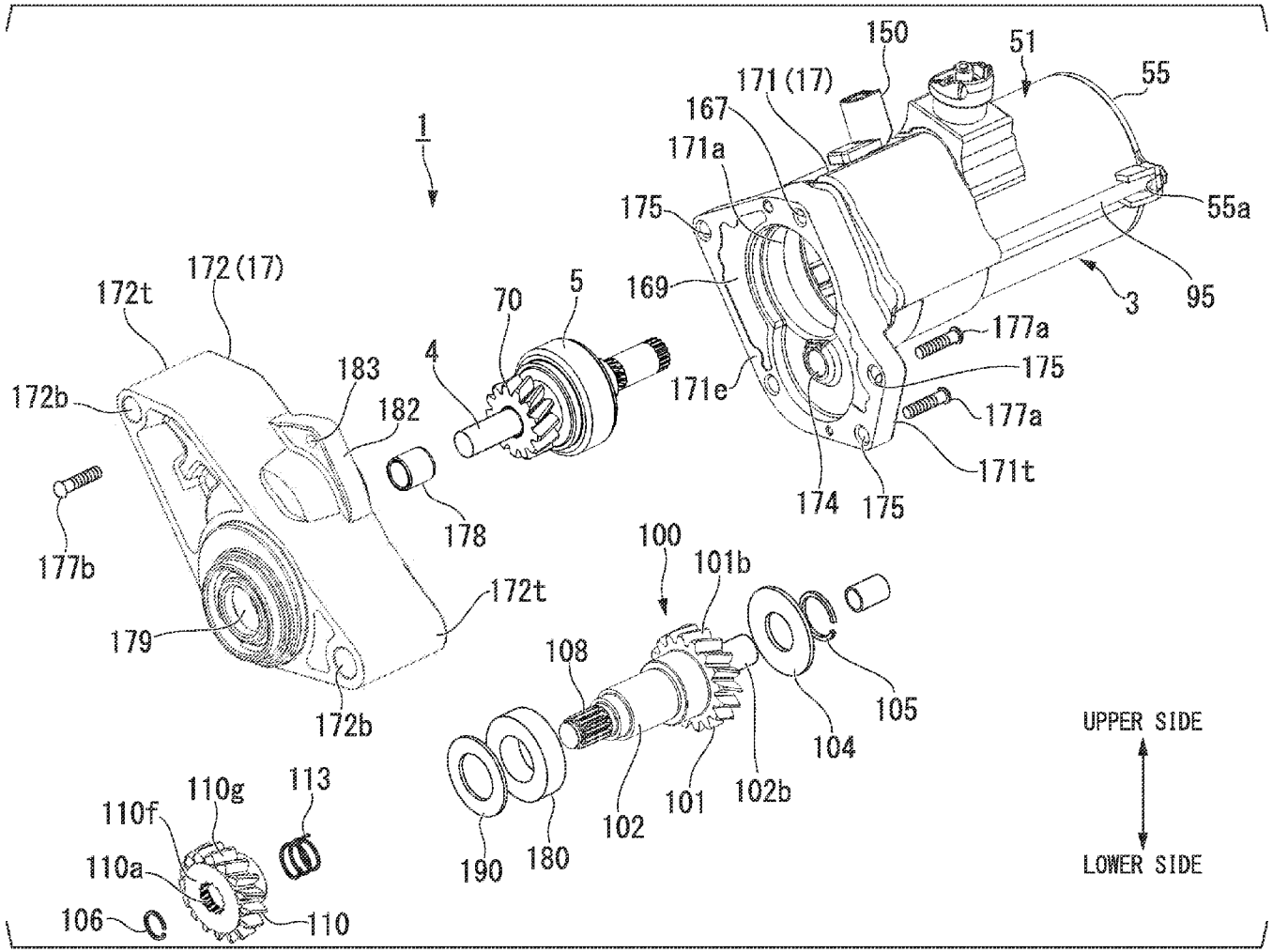
FIG. 28 is an exploded perspective view showing a schematic configuration of the starter according to the eighth embodiment of the present invention.

FIG. 26 is a cross-sectional view of a starter, FIG. 27 is a perspective view of the starter, and FIG. 28 is an exploded perspective view showing a schematic configuration of the starter.

As shown in FIGS. 26 to 28, the starter 1 generates a rotational force needed to start the engine (not shown). The starter 1 has the motor unit 3, the drive shaft 4 connected to a first side (a left side of FIG. 26) of the motor unit 3, the clutch mechanism 5 slidably installed on the drive shaft 4, the idle gear unit 100 configured to transmit a rotational force of the drive shaft 4 to the ring gear 23 of the engine (not shown), the switch unit 7 configured to open and close a power supply path with respect to the motor unit 3, and the electromagnetic device 9 configured to move the movable contact plate 8 of the switch unit 7 in the axial direction.

Further, when the starter 1 is attached to the engine (not shown), an upper side shown in FIGS. 27 and 28 is an upper side in a vertical direction of the starter 1, and a lower side shown in FIGS. 27 and 28 is a lower side in the vertical direction of the starter 1. Further, in the following description, the lower side in the vertical direction (the lower side shown in FIGS. 27 and 28) in the state in which the starter 1 is attached to the engine (not shown) may be simply referred to as a lower side, and the upper side (the upper side shown in FIGS. 27 and 28) in the vertical direction may be simply referred to as an upper side. In addition, a left side of FIG. 26 is a first side, and a right side is a second side.

(Motor Unit)

The motor unit 3 is configured of the brushed direct current motor 51, and the planetary gear mechanism 2 serving as a speed reduction mechanism connected to the rotary shaft 52 of the brushed direct current motor 51 and configured to transmit a rotational force of the rotary shaft 52 to the drive shaft 4.

The brushed direct current motor 51 has the motor yoke 53 having a substantially cylindrical shape, and the armature 54 disposed inside in the radial direction of the motor yoke 53 and rotatably installed with respect to the motor yoke 53. The plurality of (for example, six in this embodiment) permanent magnets 57 are installed on the inner circumferential surface of the motor yoke 53 such that magnetic poles are alternately disposed in the circumferential direction.

The end plate 55 configured to close the opening section 53*a* of the motor yoke 53 is installed on an end section of the second side (the right side of FIG. 26) of the motor yoke 53. The slide bearing 56*a* and the thrust bearing 56*b* configured to rotatably support a second side end of the rotary shaft 52 are installed in a center in the radial direction of the end plate 55.

The armature 54 is configured of the rotary shaft 52, the armature core 58 fitted and fixed onto the rotary shaft 52 at a position corresponding to the permanent magnet 57, and the commutator 61 fitted and fixed onto the rotary shaft 52 closer to the planetary gear mechanism 2 (the left side of FIG. 26) than the armature core 58.

The armature core 58 has a plurality of teeth (not shown) formed in a radial pattern, and a plurality of slots (not shown) formed between teeth neighboring in the circumferential direction. The coil 59 is wound between the slots disposed in the circumferential direction at predetermined intervals through, for example, wave winding.

A terminal section of the coil 59 is pulled toward the commutator 61.

The plurality of (for example, 26 in this embodiment) segments 62 are disposed at the commutator 61 in the circumferential direction at predetermined intervals to be electrically insulated from each other.

The riser 63 that is bent to turn back is formed on an end of each of the segments 62 near the armature core 58. A terminal section of the coil 59 wound on the armature core 58 is connected to the riser 63.

The top plate 12 having a bottomed cylindrical shape is installed on the motor yoke 53 opposite to the end plate 55. The planetary gear mechanism 2 is installed on the inner surface of the top plate 12 near the armature core 58.

The planetary gear mechanism 2 is configured of the sun gear 13 integrally formed with the rotary shaft 52, the plurality of planetary gears 14 meshed with the sun gear 13 and revolving about the sun gear 13, and the annular internal tooth ring gear 15 installed on the outer circumferential side of the planetary gears 14.

The plurality of planetary gears 14 are connected by the carrier plate 16 serving as the output section. The plurality of support shafts 16*a* are vertically installed on the carrier plate 16 at positions corresponding to the planetary gears 14, and the planetary gears 14 are rotatably supported by by the support shafts 16*a*. In addition, the engaging hole 16*b* having serration is formed in a center in the radial direction of the carrier plate 16, and the serration section 4*e* of the second side end section 4*d* of the drive shaft 4 is meshed with the engaging hole 16*b* through serration engagement.

The internal tooth ring gear 15 is integrally formed with the inner surface of the top plate 12 near the armature core 58. The slide bearing 12*a* is installed in a center in the radial direction of the inner circumferential surface of the top plate 12. The slide bearing 12*a* rotatably supports a second side end (a right side end of FIG. 26) of the drive shaft 4 disposed concentrically with the rotary shaft 52.

(Housing)

In this way, the top plate 12 at which the planetary gear mechanism 2 is installed is received and fixed in the housing 17. The housing 17 has a function of fixing the starter 1 to the engine (not shown), and a function of receiving the top plate 12 (the planetary gear mechanism 2), the electromagnetic device 9, the clutch mechanism 5, the idle gear unit 100, and so on.

The housing 17 is divided into the bracket section 171 having the opening sections 171*a* and 171*c* formed on the first side (the left side of FIG. 26) and the second side (the right side of FIG. 26), and the gear cover 172 mounted on the first side (the left side of FIG. 26) of the bracket section 171.

The bracket section 171 and the gear cover 172 are formed of aluminum through die casting. Then, the top plate 12 configured to close the second opening section 171*c* of the bracket section 171 is installed.

In addition, the female screw section 171*b* is formed on an outer circumferential surface of the bracket section 171 near the second opening section 171*c* in the axial direction. In addition, the bolt hole 55*a* is formed on the end plate 55 disposed at the second side (the right end side of FIG. 26) of the motor yoke 53 at a position corresponding to the female screw section 171*b*. As the bolt 95 is inserted into the bolt hole 55*a* and the bolt 95 is screwed into the female screw section 171*b*, the motor unit 3 and the bracket section 171 are integrated.

In addition, the ring-shaped stopper 94 configured to restrict displacement of the outer clutch 18 toward the motor unit 3 (to be described below) is installed on the inner wall of the bracket section 171. The stopper 94 is formed of a resin, rubber, or the like, and a shock when the outer clutch 18 abuts the stopper 94 can be attenuated.

Further, the shrinkage diameter section 171*d* having a diameter reduced by the step difference is formed on the inner wall of the bracket section 171 closer to the first opening section 171*a* than the stopper 94. The step difference surface of the shrinkage diameter section 171*d* functions as a retainer section configured to prevent the electromagnetic device 9 from slipping off from the first opening section 171*a* of the bracket section 171.

The shaft hole 174 is formed on the first opening section 171*a* side (a front side of FIG. 28) of the bracket section 171 outside in the radial direction of the opening section 171*a*. The shaft hole 174 rotatably supports the vicinity (an end section of the left side of FIG. 26) of the first end section 102*a* of the idle shaft 102 (to be described below).

In addition, the outer flange section 171*t* overhanging toward the outer circumferential side is integrally formed with the bracket section 171 near the first opening section 171*a*. A surface of the outer flange section 171*t* opposite to the gear cover 172 becomes an abutting surface (a mating surface) 171*e* of the gear cover 172. The concave section 169 is formed on the abutting surface 171*e* except for the outer circumferential section. As the concave section 169 is formed, the bracket section 171 can be reduced in weight, the processing area of the abutting surface 171*e* can be reduced and manufacturing cost can be reduced.

In addition, the plurality of bolt insertion holes 175 are formed in the outer circumferential section of the outer flange section 171*t* in the circumferential direction at intervals. Further, the female screw section 167 is formed on the upper side of the outer flange section 171*t* at a position corresponding to the bolt insertion hole 183 (to be described below) of the gear cover 172. The bolt insertion hole 175 and the female screw section 167 are disposed in the circumferential direction at substantially equal intervals.

Figure 29:
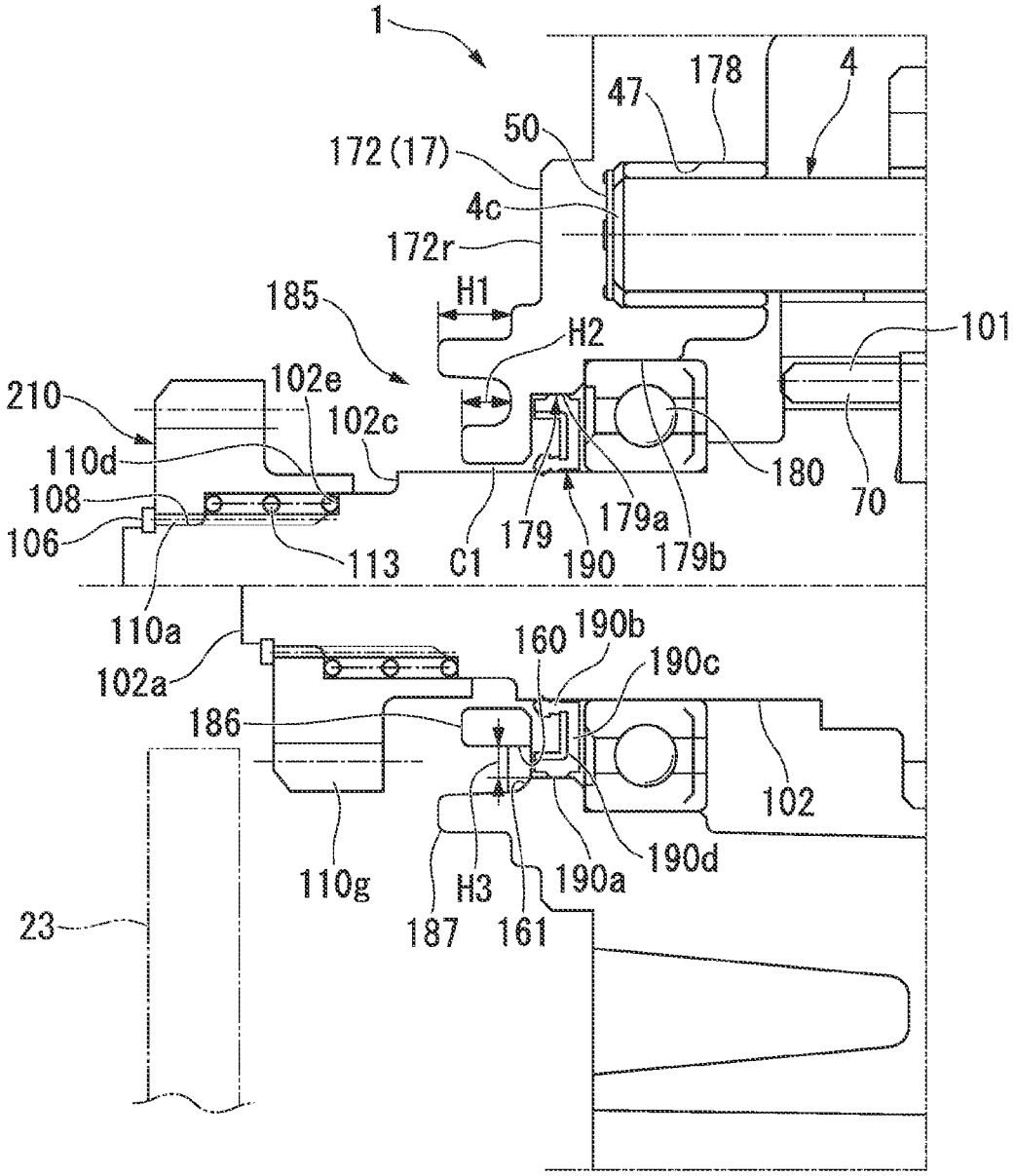
FIG. 29 is an enlarged view of a portion A of FIG. 26.
Figure 30:
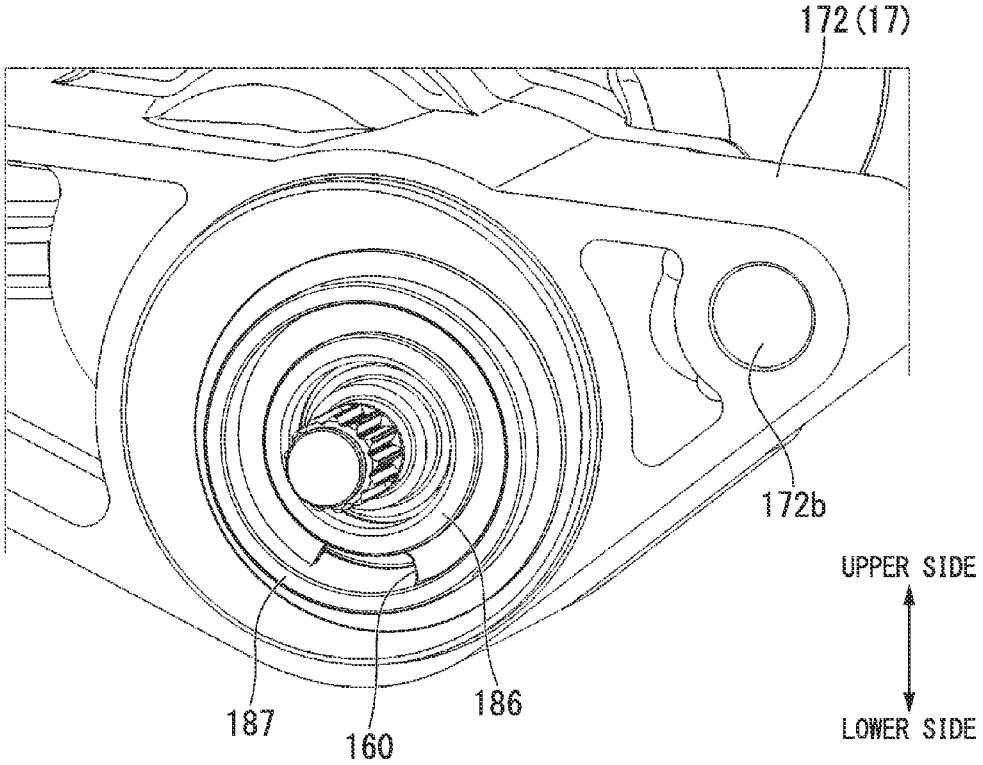
FIG. 30 is an enlarged view of a portion B of FIG. 27.

FIG. 29 is an enlarged view of a portion A of FIG. 26. FIG. 30 is an enlarged view of a portion B of FIG. 27, showing the driving pinion gear (to be described below) detached from the idle shaft.

As shown in FIGS. 26 and 28 to 30, the gear cover 172 has an abutting surface (a mating surface) 172*s* configured to abut the outer flange section 171*t* of the bracket section 171 at an opposite side of the bracket section 171. A concave section (not shown) is formed on the abutting surface 172*s*, at a position except for the outer circumferential section, in other words, at a position corresponding to the concave section 169 of the bracket section 171. As the concave section is formed, the gear cover 172 can be reduced in weight, the processing area of the abutting surface 172*s* can be reduced and the manufacturing cost can be reduced.

In addition, a female screw section (not shown) is formed on the outer circumferential section of the abutting surface 172*s* at a position corresponding to the bolt insertion hole 175 of the bracket section 171. Further, the flange section 182 overhanging toward the outer circumferential side is integrally formed with the outer circumferential section of the abutting surface 172*s* at a position corresponding to the female screw section 167 of the bracket section 171, and the bolt insertion hole 183 is formed therein.

In addition, the gear cover 172 has the accommodating concave section 173 opened at an opposite side of the bracket section 171 and configured to accommodate the clutch mechanism 5, the transmission pinion gear (the transmission gear) 70, and the idle gear 101 (to be described below).

The accommodating concave section 173 is configured of the pinion gear accommodating concave section 173*a* in which the transmission pinion gear 70 is accommodated, and the idle gear accommodating concave section 173*b* in which the idle gear 101 is accommodated, and the accommodating concave sections 173*a* and 173*b* are formed to come in communication with each other.

In addition, in the accommodating concave section 173, the spigot joint section 173*c* fitted into the first opening section 171*a* of the bracket section 171 by a spigot joint when the gear cover 172 overlaps the bracket section 171 protrudes from the opening section circumferential edge of the pinion gear accommodating concave section 173*a*.

The spigot joint section 173*c* is formed in substantially a C shape corresponding to a shape of the opening section circumferential edge of the pinion gear accommodating concave section 173*a* such that the idle gear accommodating concave section 173*b* side is opened in a plan view when seen in the axial direction.

In addition, the bottomed bearing concave section 47 is formed on the bottom section 173*d* of the accommodating concave section 173 concentrically with the drive shaft 4. Further, a shaft insertion hole 179 through which the idle shaft 102 is inserted (to be described below) is formed in the bottom section 173*d* of the accommodating concave section 173 at a side of the bearing concave section 47. An impermeable wall 185 formed in an annular shape is integrally formed with the gear cover 172 at an outer portion of the gear cover 172 of the shaft insertion hole 179.

The bearing concave section 47 is formed to have an inner diameter larger than the outer diameter of the drive shaft 4. The slide bearing 178 configured to rotatably support the first side end (the left side end of FIG. 26) of the drive shaft 4 is press-fitted and fixed into the bearing concave section 47. A lubricant formed of a desired base oil is impregnated in the slide bearing 178, and the drive shaft 4 can smoothly come in sliding contact with the slide bearing 178.

In addition, the load receiving member 50 is disposed between the bottom section of the bearing concave section 47 and the first side end surface 4*c* of the drive shaft 4.

The load receiving member 50 is a plate-shaped metal member, and for example, a ring-shaped washer formed by a press is employed as the load receiving member 50. The load receiving member 50 is formed of a material having higher hardness than that of the drive shaft 4 and good wear and abrasion resistance. For example, carbon tool steel such as SK85 or the like is appropriately used as a material of the load receiving member 50.

As the load receiving member 50 is disposed, even when a thrust load is generated at the drive shaft 4 toward the first side (the left side of FIG. 26), the thrust load of the drive shaft 4 can be received while restricting movement of the drive shaft 4 by the load receiving member 50 installed on the gear cover 172. In addition, upon rotation of the drive shaft 4, since the first side end surface 4*c* of the drive shaft 4 comes in sliding contact with the load receiving member 50, direct sliding contact between the first side end surface 4*c* of the drive shaft 4 and the gear cover 172 can be prevented. Accordingly, abrasion of the gear cover 172 can be prevented and the starter 1 having good durability can be provided.

Further, grease used to reduce friction upon sliding contact with the first side end surface 4*c* of the drive shaft 4 is applied around the load receiving member 50. Since grease including the same kind of base oil as the lubricant impregnated in the slide bearing 178 is used as the grease, the lubricant of the slide bearing 178 can be held for a long time.

The concave section 4*a* into which the first side end (the left side end of FIG. 26) of the rotary shaft 52 is inserted and fitted is formed on the second side end (the right side end of FIG. 26) of the drive shaft 4. The slide bearing 4*b* is press-fitted into the inner circumferential surface of the concave section 4*a*, and the drive shaft 4 and the rotary shaft 52 are relatively rotatably connected.

In addition, as shown in FIG. 29 in detail, a seal mounting section 179*a* and a bearing mounting section 179*b* are sequentially formed on the inner circumferential surface of the shaft insertion hole 179 of the gear cover 172 from the first side end surface 172*r*, which is an opposite side (the left side of FIG. 29) of the abutting surface 172*s*. The bearing mounting section 179*b* has a diameter increased by the step difference to be larger than that of the seal mounting section 179*a*.

The oil seal 190 is lightly press-fitted into the seal mounting section 179*a*. The ball bearing 180 is press-fitted into the bearing mounting section 179*b*. That is, the oil seal 190 is installed between the first side end surface 172*r* of the gear cover 172 and the ball bearing 180. Then, a portion of the first side end surface 172*r* of the gear cover 172 functions to prevent separation of the oil seal 190 from the gear cover 172 and functions as a waterproof wall such that water from the outside is not directly poured into the oil seal 190.

The ball bearing 180 rotatably supports the idle shaft 102 (to be described below).

Meanwhile, the oil seal 190 prevents dust or water from intruding into the gear cover 172 from the outside via the impermeable wall 185 and the shaft insertion hole 179. The oil seal 190 is formed of a rubber material in a ring shape to surround the idle shaft 102 and in a U-shaped cross-section such that the first side end surface 172*r* side of the gear cover 172 is opened. More specifically, the oil seal 190 has an outer circumferential wall 190*a* press-fitted into the inner circumferential surface of the shaft insertion hole 179, an inner circumferential wall 190*b* in sliding contact with the idle shaft 102, and a bottom wall 190*c* configured to connect the outer circumferential wall 190*a* and the inner circumferential wall 190*b* to the ball bearing 180 side, which are integrally formed with each other. In addition, the oil seal 190 is reinforced by an inner surface in the radial direction of the outer circumferential wall 190*a* and a metal material 190*d* disposed at an open side of the bottom wall 190*c*.

Further, the inner cylindrical section 186 and the outer cylindrical section 187 formed to surround the shaft insertion hole 179 and protruding concentrically are formed on the impermeable wall 185 formed on the first side end surface 172*r* of the gear cover 172. The inner cylindrical section 186 is formed in a ring shape to surround the idle shaft 102. The inner cylindrical section 186 is set to a height to overlap the extended cylindrical section 11*d* in the radial direction of the idle shaft such that the starter 1 is not operated.

A clearance C1 between the inner cylindrical section 186 and the idle shaft 102 is set to be as small as possible. The outer cylindrical section 187 is vertically formed in a ring shape at a position corresponding slightly farther to the outside in the radial direction than the oil seal 190. A protrusion height H1 of the outer cylindrical section 187 is set to be larger than a protrusion height H2 of the inner cylindrical section 186.

In addition, as shown in FIGS. 29 and 30 in detail, a draining-off hole 160 is formed to pass through the impermeable wall 185 of the gear cover 172 between the inner cylindrical section 186 and the outer cylindrical section 187 and is disposed at the lower side. The draining-off hole 160 is formed in an arc shape along the outer circumferential surface of the inner cylindrical section 186 and the inner circumferential surface of the outer cylindrical section 187.

In addition, a drainage gradient 161 having an arc-shaped cross-section is formed on a lower edge of the draining-off hole 160. More specifically, the drainage gradient 161 is formed to be gradually lowered toward the outside (the left side of FIG. 29) of the gear cover 172.

Further, an opening width H3 in a vertical direction in the inside (the right side of FIG. 29) of the draining-off hole 160 is set to be larger than a thickness of the outer circumferential wall 190*a* of the oil seal 190.

Accordingly, the draining-off hole 160 itself is not closed by the outer circumferential wall 190*a* of the oil seal 190.

Otherwise, the pair of attachment bracket sections 172*t* overhanging toward the outer circumferential side with respect to the abutting surface 172*s* are integrally formed with the gear cover 172 with the accommodating concave section 173 therebetween.

The attachment bracket section 172*t* is formed to be tapered as it is spaced apart from the accommodating concave section 173. The bolt insertion hole 172*b* is formed on a peak section of each of the attachment bracket sections 172*t*. As a bolt (not shown) is inserted into the bolt insertion hole 172*b*, the gear cover 172 can be fixed to the engine, the vehicle body chassis, or the like (not shown).

In the above-described configuration, as shown in FIG. 28 in detail, when the bracket section 171 and the gear cover 172 are assembled, the four bolts 177*a* are inserted into the bolt insertion hole 175 of the bracket section 171 from the motor unit 3 side, and the bolts 177*a* are screwed into female screw sections (not shown) of the gear cover 172. In addition, the bolt 177*b* is inserted into the bolt insertion hole 183 of the gear cover 172 from an opposite side of the motor unit 3, and the bolt 177*b* is screwed into the female screw section 167 of the bracket section 171. In this way, the bolts 177*a* and 177*b* are fastened with the abutting surface 171*e* of the bracket section 171 and the abutting surface 172*s* of the gear cover 172 sandwiched therebetween from both sides, and the bracket section 171 and the gear cover 172 are integrated.

Here, the bolt insertion hole 175, the female screw section 167, the female screw section 172*a* and the bolt insertion hole 183 configured to fasten and fix the bracket section 171 and the gear cover 172 are disposed in the circumferential direction at substantially equal intervals. For this reason, a fastening and fixing force is applied to the bracket section 171 and the gear cover 172 in the circumferential direction in a balanced manner to fix the bracket section 171 and the gear cover 172.

In addition, as the bolts 177*a* and 177*b* are fastened with the abutting surface 171*e* of the bracket section 171 and the abutting surface 172*s* of the gear cover 172 sandwiched therebetween from both sides, such that the starter 1 is attached to the engine (not shown), the starter 1 cannot be easily disassembled.

(Clutch Mechanism)

As shown in FIG. 26, the helical spline 19 is formed on substantially a center in the axial direction of the drive shaft 4. The clutch mechanism 5 is helically meshed with the helical spline 19.

The clutch mechanism 5 has the outer clutch 18 having a substantially cylindrical shape, the inner clutch 22 formed concentrically with the outer clutch 18, and the clutch cover 6 configured to integrally fix the outer clutch 18 and the inner clutch 22.

The clutch mechanism 5 has a known so-called one-way clutch function in which the rotational force from the outer clutch 18 transmits power to the inner clutch 22 but the rotational force from the inner clutch 22 side is not transmitted to the outer clutch 18. Accordingly, upon start of the engine, when the clutch mechanism 5 is in an overrun state in which the rotational speed of the inner clutch 22 is higher than that of the outer clutch 18, the rotational force from the ring gear 23 side of the engine is blocked. In addition, the clutch mechanism 5 alternately transmits the rotational force when a torque difference and a rotational speed difference generated between the outer clutch 18 and the inner clutch 22 are less than a predetermined value. Meanwhile, when the torque difference and the rotational speed difference exceed the predetermined value, transmission of the rotational force is blocked. That is, the clutch mechanism 5 also includes a so-called torque limiter function.

The sleeve 18*a* having a reduced diameter is integrally formed with the second side (the right side of FIG. 26) of the outer clutch 18, and the helical spline 18*b* meshed with the helical spline 19 of the drive shaft 4 is formed on an inner circumferential surface of the sleeve 18*a*. Accordingly, the clutch mechanism 5 is installed so as to be slidable in the axial direction with respect to the drive shaft 4.

The step section 18*c* is formed on the first side of the sleeve 18*a* of the inner circumferential surface of the outer clutch 18. The inner circumferential surface of the step section 18*c* has a larger diameter than the inner circumferential surface of the sleeve 18*a*.

The clutch cover 6 (to be described below) is fixed to the outer circumferential surface of the outer clutch 18 by, for example, caulking or the like.

The inner clutch 22 has a larger diameter than that of the sleeve 18*a* of the outer clutch 18. A space is formed between the inner circumferential surface of the inner clutch 22, the step section 18*c* and the drive shaft 4. The return spring 21 (to be described below) is disposed in the space.

The clutch washer 64 having substantially a disk shape is fitted and fixed onto the outer circumferential surface of the inner clutch 22 at a position corresponding to the first side end surface of the outer clutch 18 in the radial direction.

The clutch cover 6 is a bottomed cylindrical member having the cylindrical main body section 68 and the bottom wall 66 of the first side (the left side of FIG. 26) of the cylindrical main body section 68, and formed of a metal plate member such as an iron plate member through drawing.

The cylindrical main body section 68 is fixed to the outer clutch 18 and the clutch washer 64 fitting it onto the outer clutch 18 and the clutch washer 64 and caulking the edge section of the second side of the cylindrical main body section 68 to the second side end surface of the outer clutch 18.

An opening passing through the first side and the second side is formed on substantially a center of the bottom wall 66, and the cylindrical reinforcement section 67 extending from the opening toward the first side in the axial direction is formed on the center. The cylindrical reinforcement section 67 is formed concentrically with the drive shaft 4, and the drive shaft 4 is inserted therethrough.

The movement restriction section 20 is formed on the drive shaft 4 closer to the first side (the left side of FIG. 26) than the helical spline 19.

The movement restriction section 20 is a substantially ring-shaped member fitted onto the drive shaft 4 and formed such that movement toward the first side in the axial direction is restricted by the circlip 20*a*. In addition, the movement restriction section 20 has a larger diameter than the inner circumferential surface of the step section 18*c* to interfere with the step section 18*c* formed on the outer clutch 18. When the clutch mechanism 5 slides to the first side as will be described below, the step section 18*c* of the outer clutch 18 interferes with the movement restriction section 20. Accordingly, a slide movement of the clutch mechanism 5 toward the first side is restricted.

The return spring 21 is installed between the movement restriction section 20 and the sleeve 18*a* of the outer clutch 18 and between the inner circumferential surface of the step section 18*c* and the outer circumferential surface of the drive shaft 4. The return spring 21 is formed to surround the drive shaft 4 and installed in a compressively deformed state. Accordingly, the outer clutch 18 is always biased to be pushed back toward the motor unit 3.

The transmission pinion gear 70 is integrally formed with the distal end of the inner clutch 22 of the clutch mechanism 5 configured as described above.

The transmission pinion gear 70 is configured of the cylindrical section 70*a* slidably fitted onto the drive shaft 4, and the external tooth section 70*b* integrally formed with the outer circumferential surface and meshed with the idle gear 101 (to be described below). Then, the cylindrical section 70*a* is integrally formed with the inner clutch 22.

In addition, the outer flange sections 73 are integrally formed on the base end side of the cylindrical section 70*a*, which is the clutch mechanism 5 side, to be spaced an interval from the external tooth section 70*b* of the transmission pinion gear 70 in the axial direction. The two slide bearings 72 and 72 configured to slidably support the transmission pinion gear 70 at the drive shaft 4 are installed on both sides in the axial direction of the inner circumferential surface of the cylindrical section 70*a*.

(Idle Gear Unit)

The idle gear unit 100 includes the idle shaft 102 disposed in parallel with the drive shaft 4, the idle gear 101 integrally formed with an intermediate section in the axial direction of the idle shaft 102 and meshed with the transmission pinion gear 70, and the driving pinion gear 110 formed on the first end section 102*a* of the idle shaft 102 and configured to mesh with the ring gear 23.

Further, in FIG. 26, a state in which the ring gear 23 and the driving pinion gear 110 are meshed is shown at the upper side of the dotted line along the centerline of the idle shaft 102 and a state in which the starter 1 is stopped is shown at the lower side the dotted line along the centerline of the idle shaft 102.

The idle gear 101 has a diameter increased from the idle shaft 102 toward the outer circumferential side, and the external tooth section 101*b* is formed on the outer circumferential surface.

Here, a speed reduction ratio between the external tooth section 101*b* of the idle gear 101 and the external tooth section 70*b* of the transmission pinion gear 70 is set such that the rotational speed of the idle gear 101 is reduced with respect to the rotational speed of the transmission pinion gear 70. Accordingly, the rotational torque of the idle shaft 102 can be increased to be larger than that of the drive shaft 4.

In addition, the idle gear 101 and the transmission pinion gear 70 are configured of helical gears. A skew direction of the teeth of the idle gear 101 is set to the same direction as that of the teeth of the driving pinion gear 110 (to be described below). Meanwhile, a skew direction of the teeth of the transmission pinion gear 70 is set to the same direction as that of teeth of the ring gear 23.

The first end section 102*a* (the end section 102*a* of the left side of FIG. 26) of the idle shaft 102 passes through the shaft insertion hole 179 of the gear cover 172 and protrudes to the outside of the gear cover 172. That is, a side of the idle shaft 102 in front of the first end section 102*a* is rotatably supported by the ball bearing 180 installed on the gear cover 172.

In addition, the second end section 102*b* of the idle shaft 102 is rotatably supported via the slide bearing 103 and slidably supported in the axial direction (the thrust direction) at the shaft hole 174 formed in the bracket section 171.

Here, grease serving as a lubricant used to increase slidability of the idle shaft 102 with respect to the slide bearing 103 is filled in an aperture section formed between the second end section 102*b* of the idle shaft 102 and the shaft hole 174 of the bracket section 171. Meanwhile, the grease gathering section 99 is recessed in the second end section 102*b* of the idle shaft 102.

The grease gathering section 99 is configured to prevent the grease from leaking from the aperture section due to a pumping action when the second end section 102*b* of the idle shaft 102 is inserted into the slide bearing 103 of the bracket section 171.

In addition, the idle washer 104 having a disk shape is fitted onto the outer circumferential section of the idle shaft 102 closer to the clutch mechanism 5 with respect to the idle gear 101. Movement of the idle washer 104 toward the clutch mechanism 5 in the escape direction is restricted by the retaining ring 105 attached to the idle shaft 102. In addition, an outer diameter of the idle washer 104 is set to be substantially the same as the outer diameter of the external tooth section 101*b*. Further, the outer circumferential section of the idle washer 104 is inserted into the annular gap between the external tooth section 70*b* of the transmission pinion gear 70 and the outer flange section 73.

Accordingly, the idle shaft 102 having the idle gear 101 is movable with the transmission pinion gear 70 via the idle washer 104 in the axial direction.

Further, the idle washer 104 has a function of improving slidability between the transmission pinion gear 70 and the idle gear 101. For this reason, grease or the like is also applied to the idle washer 104 as a lubricant.

In addition, the step difference section 102*d* is formed to have an outer diameter increased at the idle shaft 102 closer to the idle gear 101 than a portion thereof into which the ball bearing 180 is inserted. As the step difference section 102*d* collides with the ball bearing 180, movement of the idle shaft 102 toward the driving pinion gear 110 is restricted.

In addition, the spline 108 is formed on the outer circumferential surface of the first end section 102*a* of the idle shaft 102. The spline 110*a* configured to be spline-fitted to the spline 108 is formed on the distal end side of the inner circumferential surface of the driving pinion gear 110 installed on the first end section 102*a* of the idle shaft 102. The length of the spline 108 near the idle shaft 102 is set to be larger in the axial direction than that of the spline 110*a* of the driving pinion gear 110. Accordingly, the idle shaft 102 and the driving pinion gear 110 cannot be relatively rotated but are slidable in the axial direction.

In addition, the step difference section 102*c* having a diameter increased to be larger than that of the spline 108 side is formed on the idle shaft 102 closer to the second side (the right side of FIG. 26) than the spline 108.

Meanwhile, the extended cylindrical section 110*d* extends from the end surface of the second side (the right side of FIG. 26) of the driving pinion gear 110.

The extended cylindrical section 110*d* is formed concentrically with the idle shaft 102. The extended cylindrical section 110*d* can abut the step difference section 102*c* when the driving pinion gear 110 slides to the second side (the right side in FIG. 26) in the axial direction. That is, when the driving pinion gear 110 slides in the axial direction with respect to the idle shaft 102, as the extended cylindrical section 110*d* collides with the step difference section 102*c*, movement of the driving pinion gear 110 toward the second side is restricted.

In addition, the retaining ring 106 press-fitted and fixed onto the idle shaft 102 is installed on the first end section 102*a* of the idle shaft 102. Accordingly, the driving pinion gear 110 restricts escape of the idle shaft 102 to the first side with respect to the idle shaft 102.

Here, the driving pinion gear 110 may have the pitch diameter D1 of the external tooth section 110*g* with respect to the pitch diameter D2 of the external tooth section 101*b* of the idle gear 101 to satisfy the following relation:

$$D1 \leq D2.$$

Further, the diameters may satisfy the following relation:

$$D1 < D2.$$

When the pitch diameter D2 of the external tooth section 101*b* of the idle gear 101 is larger than the pitch diameter D1 of the external tooth section 110*g*, a torque obtained by the external tooth section 101*b* is larger than that output from the driving pinion gear 110. That is, torque transmission from the idle gear 101 side, i.e., the drive shaft 4 side, toward the driving pinion gear 110 can be efficiently performed.

Figure 31:
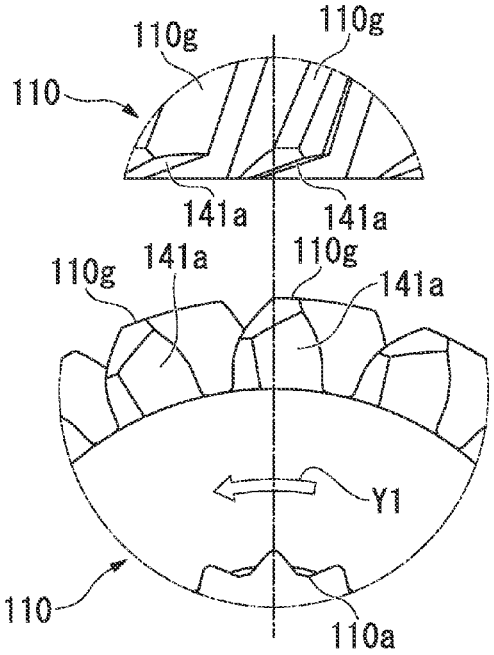
FIG. 31 is a partially enlarged view of a driving pinion gear according to the eighth embodiment of the present invention.
Figure 32:
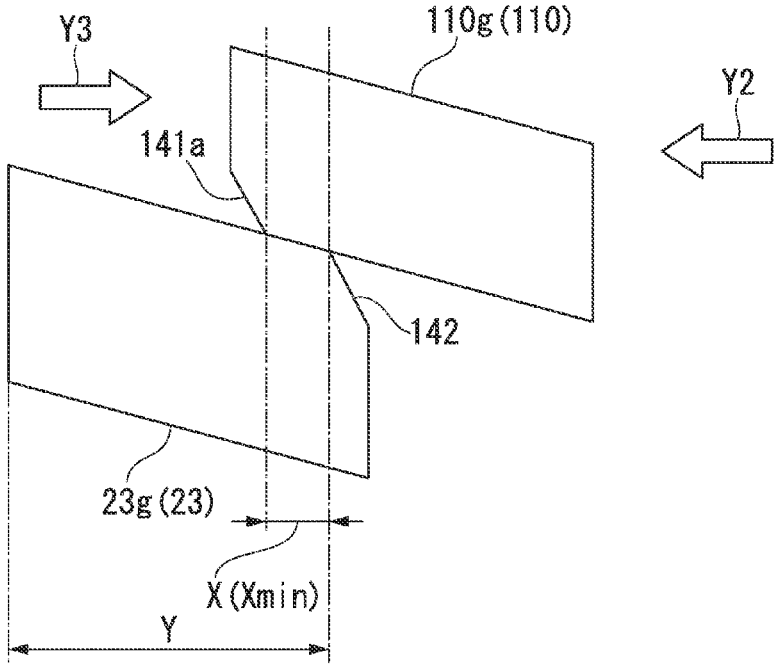
FIG. 32 is a schematic view showing a meshed state of the driving pinion gear and the ring gear according to the eighth embodiment of the present invention.

FIG. 31 is a partially enlarged view of the driving pinion gear, and FIG. 32 is a schematic view showing a meshing of the driving pinion gear and the ring gear.

As shown in FIGS. 31 and 32, the external tooth section 110*g* of the driving pinion gear 110 and the ring gear 23 are configured of helical gears.

A first tooth chamfered section 141*a* is formed on the external tooth section 110*g* of the driving pinion gear 110 at a front side in the rotational direction (an arrow Y1 of FIG. 31) and an edge section near the ring gear 23.

Meanwhile, a tooth chamfered section 142 is formed on an edge section of an external tooth section 23*g* of the ring gear 23, into which the external tooth section 110*g* of the driving pinion gear 110 is received.

Further, the edge section of the external tooth section 23*g* of the ring gear 23, into which the external tooth section 110*g* of the driving pinion gear 110 is received, is an edge section of the external tooth section 110*g* of driving pinion gear 110 abutting the first tooth chamfered section 141*a* when the driving pinion gear 110 plunges toward the ring gear 23.

Here, as shown in FIG. 32 in detail, when the external tooth section 23*g* of the ring gear 23 is meshed with the external tooth section 110*g* of the driving pinion gear 110 (as described below, such that the rotational speed of the ring gear 23 is faster than that of the driving pinion gear 110), a place at which the external tooth sections 23*g* and 110*g* come in contact with each other (a portion X of FIG. 32) becomes a guaranteed minimum value of meshing (a guaranteed minimum length of meshing) Xmin at which meshing between the ring gear 23 and the driving pinion gear 110 is guaranteed. That is, the place of the external tooth section 110*g* of the driving pinion gear 110 and the external tooth section 23*g* of the ring gear 23 except for the first tooth chamfered section 141*a* and the tooth chamfered section 142 becomes the minimum guaranteed length of meshing Xmin between the ring gear 23 and the driving pinion gear 110.

Further, in FIG. 32, a length of meshing when the driving pinion gear 110 is maximally pushed to the ring gear 23 is referred to as a maximum mesh length, which is represented by Y.

In addition, the skew direction of the teeth of the external tooth section 110*g* of the driving pinion gear 110 and the external tooth section 23*g* of the ring gear 23 is set such that a thrust load in a plunge direction (an arrow Y2 of FIG. 32) with respect to the ring gear 23 is generated at the driving pinion gear 110 such that the driving pinion gear 110 drives the ring gear 23.

In addition, upon cranking when the engine is started, the rotational speed of the ring gear 23 is likely to be varied. Here, when a rotational speed difference between the driving pinion gear 110 and the ring gear 23, which are helically meshed, is generated, a direction of the thrust load applied to the driving pinion gear 110 is varied.

That is, when the rotational speed of the ring gear 23 is lower than that of the driving pinion gear 110, a thrust load is generated at the driving pinion gear 110 in a direction approaching the ring gear 23 (the arrow Y2 of FIG. 32). In addition, when the rotational speed of the ring gear 23 is higher than that of the driving pinion gear 110, a thrust load is generated at the driving pinion gear 110 in a direction away from the ring gear 23 (an arrow Y3 of FIG. 32).

However, in this case, since the rotational speed of the idle gear 101 is higher than that of the transmission pinion gear 70, a thrust load is applied to the idle gear 101 from the transmission pinion gear 70 in a direction opposite to the thrust load applied to the driving pinion gear 110 from the ring gear 23. For this reason, the thrust load applied to the driving pinion gear 110 in the direction away from the ring gear 23 is offset.

That is, while the skew direction of the teeth of the idle gear 101 is set to the same direction as the skew direction of the teeth of the driving pinion gear 110, the skew direction of the teeth of the transmission pinion gear 70 is set to the same direction as the skew direction of the teeth of the ring gear 23. For this reason, the direction of the thrust load generated at the driving pinion gear 110 is opposite to the direction of the thrust load generated at the idle gear 101, and the thrust loads are offset with respect to each other.

Here, the thrust load in the separating direction of the driving pinion gear 110 may be set to be larger than the thrust load in a direction opposite to application to the idle gear 101. Further, the thrust load in the separating direction of the driving pinion gear 110 may be smaller than an attractive force by the electromagnetic device 9.

The expansion diameter section 111 having a diameter increased via the step difference section 110*b* is formed on a rear end side of the spline 110*a* of the inner circumferential surface of the driving pinion gear 110. In addition, the receiving section 112 is formed between the idle shaft 102 and the driving pinion gear 110.

In the receiving section 112, an opening section formed on the idle gear 101 side is closed by the step difference section 102*e* formed by increasing a diameter at an end section of the spline 108 of the idle shaft 102 near the idle gear 101.

The pinion spring 113 formed to surround the outer circumferential surface of the idle shaft 102 is received in the receiving section 112. The pinion spring 113 is formed of, for example, a coil spring.

The pinion spring 113, which is received in the receiving section 112, is compressed and deformed by the step difference section 110*b* of the expansion diameter section 111 of the driving pinion gear 110 and the step difference section 102*e* of the idle shaft 102. Accordingly, the driving pinion gear 110 is biased toward the ring gear 23 with respect to the idle shaft 102.

In addition, the pinion spring 113 functions as a so-called damper mechanism configured to be elastically deformed in the axial direction and absorb a shock when the driving pinion gear 110 abuts the ring gear 23 as will be described below. Accordingly, abrasion between the driving pinion gear 110 and the ring gear 23 is suppressed, and durability of the starter 1 is improved.

(Electromagnetic Device)

In addition, the yoke 25 that configures the electromagnetic device 9 is fitted and fixed into the inner circumferential surface of the housing 17 (the bracket section 171) closer to the motor unit 3 than the clutch mechanism 5. The yoke 25 is formed of a magnetic material in a bottomed cylindrical shape, and most of a center in the radial direction of the bottom section 25*a* is largely opened.

Further, the annular plunger holder 26 formed of a magnetic material is formed on an end of the yoke 25 opposite to the bottom section 25*a*. The plunger holder 26 has the annular holder main body 26*a* and the plunger-holder-side cylindrical section 26*b* that is bent and extends toward the second side in the axial direction from the inside in the radial direction of the holder main body 26*a*, which are integrally formed with each other. Accordingly, since a spacing distance of the gear plunger 80 from the iron core 88 (to be described below) is reduced, an attractive force of the iron core 88 by the plunger holder 26 (hereinafter, simply referred to as an "attractive force") can be increased.

The exciting coil 24 formed in a substantially cylindrical shape is received in the receiving concave section 25*b* formed inside in the radial direction by the yoke 25 and the plunger holder 26. That is, the holder main body 26*a* of the plunger holder 26 is formed to cover a first side surface of the exciting coil 24, and the plunger-holder-side cylindrical section 26*b* is bent and extends to face the inside in the radial direction of the exciting coil 24.

The exciting coil 24 is electrically connected to an ignition switch (not shown) via the connector 150 installed on the outer circumferential surface of the bracket section 171.

The plunger mechanism 37 is slidably installed in the aperture between the inner circumferential surface of the exciting coil 24 and the outer circumferential surface of the drive shaft 4 so as to be slidable in the axial direction with respect to the exciting coil 24.

The plunger mechanism 37 has the switch plunger 27 formed of a magnetic material in a substantially cylindrical shape, and the gear plunger 80 disposed in the aperture between the switch plunger 27 and the outer circumferential surface of the drive shaft 4.

The switch plunger 27 is formed by pressing a metal plate member formed of a magnetic material. The switch plunger 27 is formed in a substantially cylindrical shape to close the inside in the radial direction of the receiving concave section 25*b* formed by the yoke 25 and the plunger holder 26.

In addition, the outer flange section 29 overhanging toward the outer circumferential side is integrally formed with the opening section (the opening section of the right side of FIG. 26, the opening section of the motor unit 3 side) 123 of the second side of the switch plunger 27. Further, the shaft holder 29*a* extends from a first side of the outer flange section 29.

The shaft holder 29*a* is a member configured to hold the switch shaft 30 (to be described below), and is formed in a U shape into which the end section of the switch shaft 30 is received.

In addition, the ring member 27*r* abutting or away from the gear plunger 80 (to be described below) is integrally formed with the inner circumferential surface of the switch plunger 27. The ring member 27*r* is a member configured to initially press the gear plunger 80 toward the ring gear 23 when the switch plunger 27 is moved toward the first side (the ring gear 23 side).

Further, the switch return spring 27*a* formed of a leaf spring material and configured to bias the end section of the switch plunger 27 near the first opening section 122 and the plunger holder 26 in the separating direction is installed therebetween.

Figure 33:
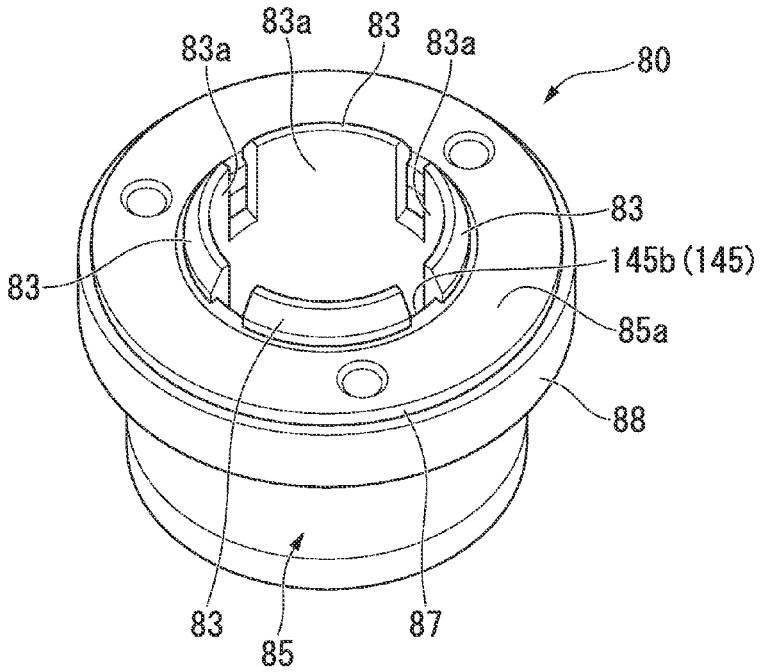
FIG. 33 is a perspective view of a gear plunger according to the eighth embodiment of the present invention.
Figure 34:
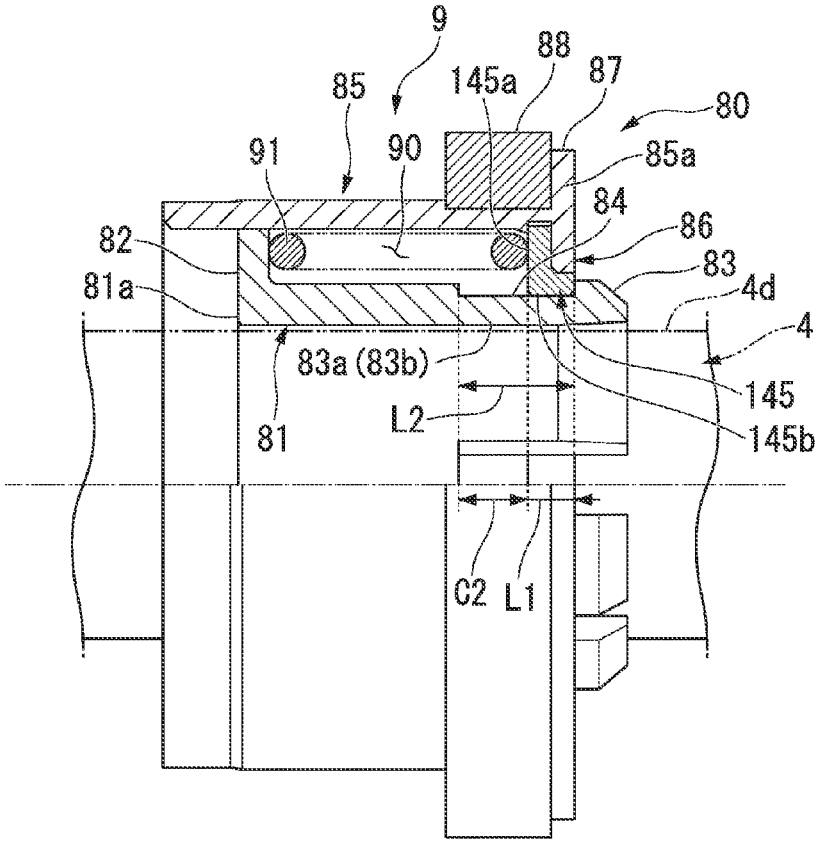
FIG. 34 is a cross-sectional view of the gear plunger according to the eighth embodiment of the present invention.
Figure 35:
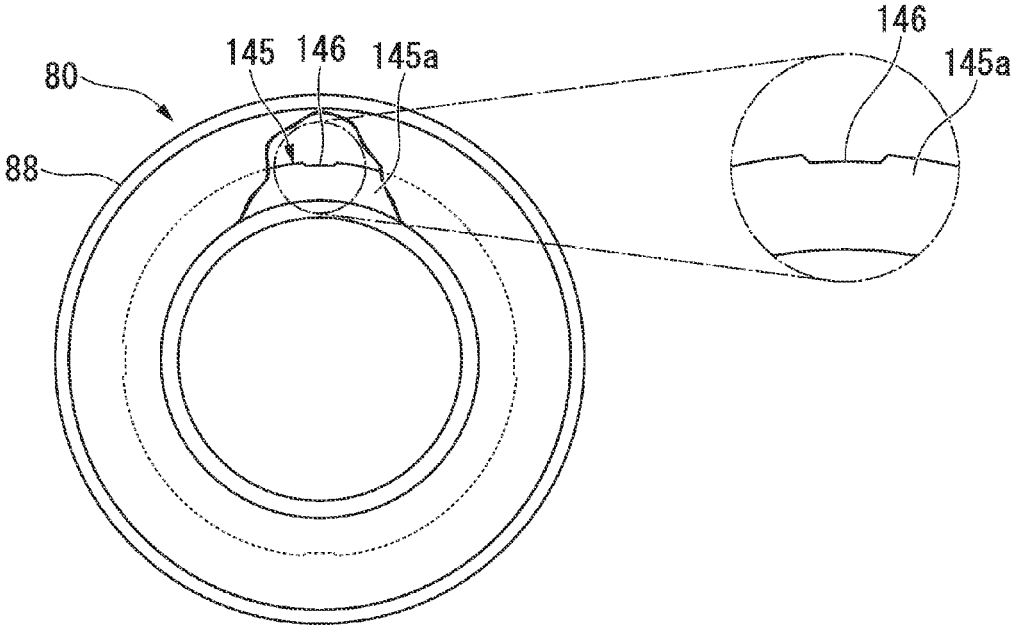
FIG. 35 is a plan view showing the gear plunger, a portion of which is partially cut out, according to the eighth embodiment of the present invention.

FIG. 33 is a perspective view of the gear plunger, FIG. 34 is a cross-sectional view of the gear plunger, and FIG. 35 is a plan view of the gear plunger, a portion of which is cut out.

As shown in FIGS. 26 and 33 to 35, the gear plunger 80 is installed on the inside in the radial direction of the switch-plunger-side cylindrical section 121 and is concentric with the switch-plunger-side cylindrical section 121. The gear plunger 80 includes the inner plunger 81 disposed at the inside in the radial direction, and the outer plunger 85 disposed at the outside in the radial direction, and the plunger spring 91 disposed between the inner plunger 81 and the outer plunger 85.

The inner plunger 81 is formed of a resin or the like in a substantially cylindrical shape. The inner diameter of the inner plunger 81 is set to be slightly larger than the outer diameter of the drive shaft 4 such that the inner plunger 81 is fitted onto the drive shaft 4. Accordingly, the inner plunger 81 is installed so as to be slidable in the axial direction with respect to the drive shaft 4.

The outer flange section 82 overhanging toward the outside in the radial direction is integrally formed with the first side end 81*a* (the left side end of FIGS. 26 and 34) of the inner plunger 81. As described above, when the inner plunger 81 slides to the first side, the first side end 81*a* of the inner plunger 81 abuts the second side end of the outer clutch 18 to slide the clutch mechanism 5 and the transmission pinion gear 70 toward the first side. That is, the first side end 81*a* of the inner plunger 81 is set as a point of action (see FIG. 26) configured to bias a pressing force to the clutch mechanism 5. Further, while this will be described below in detail, as the inner plunger 81 biases the pressing force to the clutch mechanism 5 and the transmission pinion gear 70, eventually, the pressing force is biased to the driving pinion gear 110.

A plurality of (in this embodiment, four) tongue sections 83*a* are formed on the second side end 81*b* (the right side end of FIGS. 26 and 33) of the inner plunger 81 at equal intervals in the circumferential direction. The tongue section 83*a* has elasticity, and the claw section 83 having an outer diameter gradually increased from the second side toward the first side is integrally formed with a distal end of the tongue section 83*a* (the right side end of FIGS. 26 and 33). The claw section 83 can be engaged with the inner flange section 86 of the outer plunger 85 (to be described below) through snap fitting by inserting the inner flange section 86 of the outer plunger 85 (to be described below) from the second side toward the first side.

A diameter of an inner circumferential surface 83*b* of the tongue section 83*a* is set to be slightly larger than that of an outer circumferential surface 4*d* of the drive shaft 4, and the tongue section 83*a* can be fitted into the drive shaft 4 with a main body section 81*c*. Specifically, a gap between the inner circumferential surface 83*b* of the tongue section 83*a* and the outer circumferential surface 4*d* of the drive shaft 4 is set to be smaller than a height of the claw section 83.

In addition, the groove section 84 is formed on the tongue section 83*a* in the circumferential direction. The inner flange section 86 of the outer plunger 85 is disposed in the groove section 84.

The outer plunger 85 is formed of a resin or the like in a substantially cylindrical shape like the inner plunger 81. The inner diameter of the outer plunger 85 is set to be slightly larger than that of the outer flange section 82 of the inner plunger 81, and the outer plunger 85 is fitted onto the inner plunger 81.

The inner flange section 86 overhanging toward the inside in the radial direction is integrally formed with the second side end 85*a* of the outer plunger 85 (the right side end of FIGS. 26 and 34).

The inner flange section 86 has a metal cover 145 formed through insert molding. The metal cover 145 is formed by pressing a plate member formed of brass, which is a non-magnetic material.

Further, the metal cover 145 may be formed of non-magnetic material, and may be formed of, for example, SUS.

The metal cover 145 is configured of a ring-shaped main body section 145*a* and a build-up section 145*b* that is bent from an inner circumferential edge of the main body section 145*a* toward the outside in the axial direction (the right side of FIG. 34). The main body section 145*a* configures an inner side surface of the inner flange section 86. The build-up section 145*b* configures an inner circumferential surface of the inner flange section 86.

In addition, as shown in FIG. 35 in detail, four concave sections 146 are formed on an outer circumferential edge of the main body section 145*a* of the metal cover 145 at equal intervals in the circumferential direction. The concave sections 146 are simultaneously formed through punching when the pressing is performed. The concave section 146 functions as a detent of the metal cover 145 configured to increase an adhesion property when the metal cover 145 is formed through insert molding.

Further, the inner diameter of the inner flange section 86 is set to be smaller than the outer diameter of the claw section 83 of the inner plunger 81 and larger than the outer diameter of the bottom section of the groove section 84 of the inner plunger 81. Then, as the inner flange section 86 (the metal cover 145) of the outer plunger 85 is disposed in the groove section 84 of the inner plunger 81, the inner plunger 81 and the outer plunger 85 are integrated to configure the plunger mechanism 37.

The thickness of the inner flange section 86 of the outer plunger 85, i.e., the length L1 of the build-up section 145*b* of the metal cover 145, is set to be shorter than the length L2 in the axial direction of the groove section 84 of the inner plunger 81. Accordingly, a clearance C2 is formed between the inner flange section 86 of the outer plunger 85 and the groove section 84 of the inner plunger 81.

Accordingly, the inner plunger 81 and the outer plunger 85 can relatively slide in the axial direction to an extent of the clearance C2 between the inner flange section 86 of the outer plunger 85 and the groove section 84 of the inner plunger 81.

Here, a dimension of the clearance C2, i.e., a length of a relative movement of the inner plunger 81 with respect to the outer plunger 85, is set to be smaller than the minimum guaranteed length of meshing Xmin (see FIG. 32) between the ring gear 23 and the driving pinion gear 110.

In addition, as described above, the diameter of the inner circumferential surface 83*b* of the tongue section 83*a* is slightly larger than that of the outer circumferential surface 4*d* of the drive shaft 4. The gap between the inner circumferential surface 83*b* of the tongue section 83*a* and the outer circumferential surface 4*d* of the drive shaft 4 is set to be smaller than the height of the claw section 83.

For this reason, after the claw section 83 of the inner plunger 81 is engaged with the inner flange section 86 of the outer plunger 85 through snap fitting, as the inner plunger 81 is fitted onto the drive shaft 4, displacement of the claw section 83 toward the inside in the radial direction to an extent larger than the height of the claw section 83 is restricted by the outer circumferential surface 4*d* of the drive shaft 4. Accordingly, deviation of the engagement between the inner plunger 81 and the outer plunger 85 through snap fitting is prevented.

In addition, the outer flange section 87 overhanging toward the outside in the radial direction is integrally formed with the second side end 85*a* (the right side end of FIGS. 26 and 34) of the outer plunger 85. The outer flange section 87 functions as the abutting section configured to abut the ring member 27*r* of the switch plunger 27.

Further, the ring-shaped iron core 88 is formed on the outer circumferential surface of the outer plunger 85 at the first side (the left side of FIGS. 26 and 34) of the outer flange section 87. The iron core 88 is also integrated with the outer plunger 85 through insert molding. The iron core 88 is attracted to the electromagnetic device 9 with a predetermined attractive force by a magnetic flux generated when current is supplied to the exciting coil 24.

The receiving section 90 is formed between the outer flange section 82 of the inner plunger 81 and the inner flange section 86 of the outer plunger 85. The plunger spring 91 formed to surround the outer circumferential surface of the inner plunger 81 is received in the receiving section 90.

The plunger spring 91, which is received in the receiving section 90, is compressed and deformed by the outer flange section 82 of the inner plunger 81 and the inner flange section 86 of the outer plunger 85. Then, the inner plunger 81 is biased toward the first side (the left side of FIGS. 26 and 34) and the outer plunger 85 is biased toward the second side (the right side of FIGS. 26 and 34). In other words, the inner plunger 81 and the outer plunger 85 are biased away from each other by the plunger spring 91.

Here, as shown in FIG. 26, since the first side end 81*a* of the inner plunger 81 and the second side end of the outer clutch 18 abut each other when the starter 1 is stopped, the outer clutch 18 is attached to the stopper 94 by a spring load of the return spring 21. Accordingly, when the starter 1 is stopped, the spring load of the plunger spring 91 can prevent the clutch mechanism 5 from being pushed out, i.e., can prevent the transmission pinion gear 70 from being unintentionally pushed out.

Meanwhile, when electricity is supplied to the starter 1, when the gear plunger 80 is maximally displaced to the first side (the left side of FIG. 26), the first side end 81*a* of the inner plunger 81 constantly abuts the second side end of the outer clutch 18 of the clutch mechanism 5. That is, the plunger spring 91 functions as a backlash absorption mechanism configured to prevent generation of the aperture in the axial direction between the clutch mechanism 5 and the gear plunger 80 and absorb backlash of the clutch mechanism 5.

In addition, the switch shaft 30 is vertically installed on the shaft holder 29*a* of the switch plunger 27 in the axial direction via the holder member 30*a*. The switch shaft 30 passes through the top plate 12 of the motor unit 3 and the brush holder 33 (to be described below). The movable contact plate 8 of the switch unit 7 disposed in the vicinity of the commutator 61 of the brushed direct current motor 51 is connected to an end section of the switch shaft 30 protruding from the top plate 12.

The movable contact plate 8 is slidably attached with respect to the switch shaft 30 in the axial direction and floatingly supported by the switch spring 32. Then, the movable contact plate 8 can approach or be separated from the fixed contact plate 34 of the switch unit 7 fixed to the brush holder 33 (to be described below).

The fixed contact plate 34 is divided into the first fixed contact plate 34*a* disposed at the inside in the radial direction near the commutator 61 with the switch shaft 30 sandwiched therebetween, and the second fixed contact plate 34*b* disposed at the outside in the radial direction opposite to the commutator 61. The movable contact plate 8 abuts and straddles the first fixed contact plate 34*a* and the second fixed contact plate 34*b*. As the movable contact plate 8 strokes along the drive shaft 4 and abuts the first fixed contact plate 34*a* and the second fixed contact plate 34*b*, the first fixed contact plate 34*a* and the second fixed contact plate 34*b* become electrically connected in the ON state.

Here, the outer clutch 18 of the clutch mechanism 5 is biased toward the inner plunger 81 by the return spring 21. Accordingly, when the starter 1 is stopped, the clutch mechanism 5 presses the switch plunger 27 toward the second side (the right side of FIG. 26) via the gear plunger 80 and the ring member 27*r*. Accordingly, the movable contact plate 8 is pressed toward the second side to become separated from the fixed contact plate 34 in the OFF state.

Meanwhile, when the electromagnetic device 9 slides the transmission pinion gear 70 and the movable contact plate 8 to the first side (the left side of FIG. 26), the movable contact plate 8 enters the ON state and the transmission pinion gear 70 abuts the ring gear 23.

The brush holder 33 is formed closer to the second side (the right side of FIG. 26) than the electromagnetic device 9 and the planetary gear mechanism 2. Here, the cut and raised section 34*c* that is bent and integrally formed in the axial direction is formed on the outer circumferential side of the second fixed contact plate 34*b*. The axial terminal 44*a* passes through the outer wall 33*a* of the brush holder 33 via an insertion hole of the cut and raised section 34*c* to protrude to the outside in the radial direction of the starter 1. Further, the terminal nut 44*b* to which the positive electrode of the battery is electrically connected is installed on a distal end of a protrusion side of the axial terminal 44*a*.

Further, the cover 45 configured to protect peripheries of the fixed contact plate 34 and the switch shaft 30 is mounted on the brush holder 33. The brush holder 33 and the cover 45 are sandwiched between the motor yoke 53 and the bracket section 171 and fixed thereto.

The four brushes 41 are disposed at the brush holder 33 around the commutator 61 to advance and retreat in the radial direction. The brush spring 42 is installed on a base end side of each of the brushes 41. The brush 41 is biased toward the commutator 61 by the brush spring 42, and the distal end of the brush 41 comes in sliding contact with the segment 62 of the commutator 61.

The four brushes 41 are configured of the two positive-electrode-side brushes and the two negative-electrode-side brushes, and the two positive-electrode-side brushes are connected to the first fixed contact plate 34*a* of the fixed contact plate 34 via a pigtail (not shown). Meanwhile, the positive electrode of the battery (not shown) is electrically connected to the second fixed contact plate 34*b* of the fixed contact plate 34 via the terminal nut 44*b*.

That is, when the movable contact plate 8 abuts the fixed contact plate 34, a voltage is applied to the two positive-electrode-side brushes among the four brushes 41 via the terminal nut 44*b*, the fixed contact plate 34 and the pigtail (not shown), and current is supplied to the coil 59.

In addition, the two negative-electrode-side brushes among the four brushes 41 are connected to a ring-shaped center plate via a pigtail (not shown). Then, the two negative-electrode-side brushes among the four brushes 41 are connected to the negative electrode of the battery via the center plate, the housing 17 and the vehicle body (not shown).

(Method of Manufacturing Gear Cover)

Next, a method of manufacturing the gear cover 172 will be described in brief based on FIG. 36.

Figure 36:
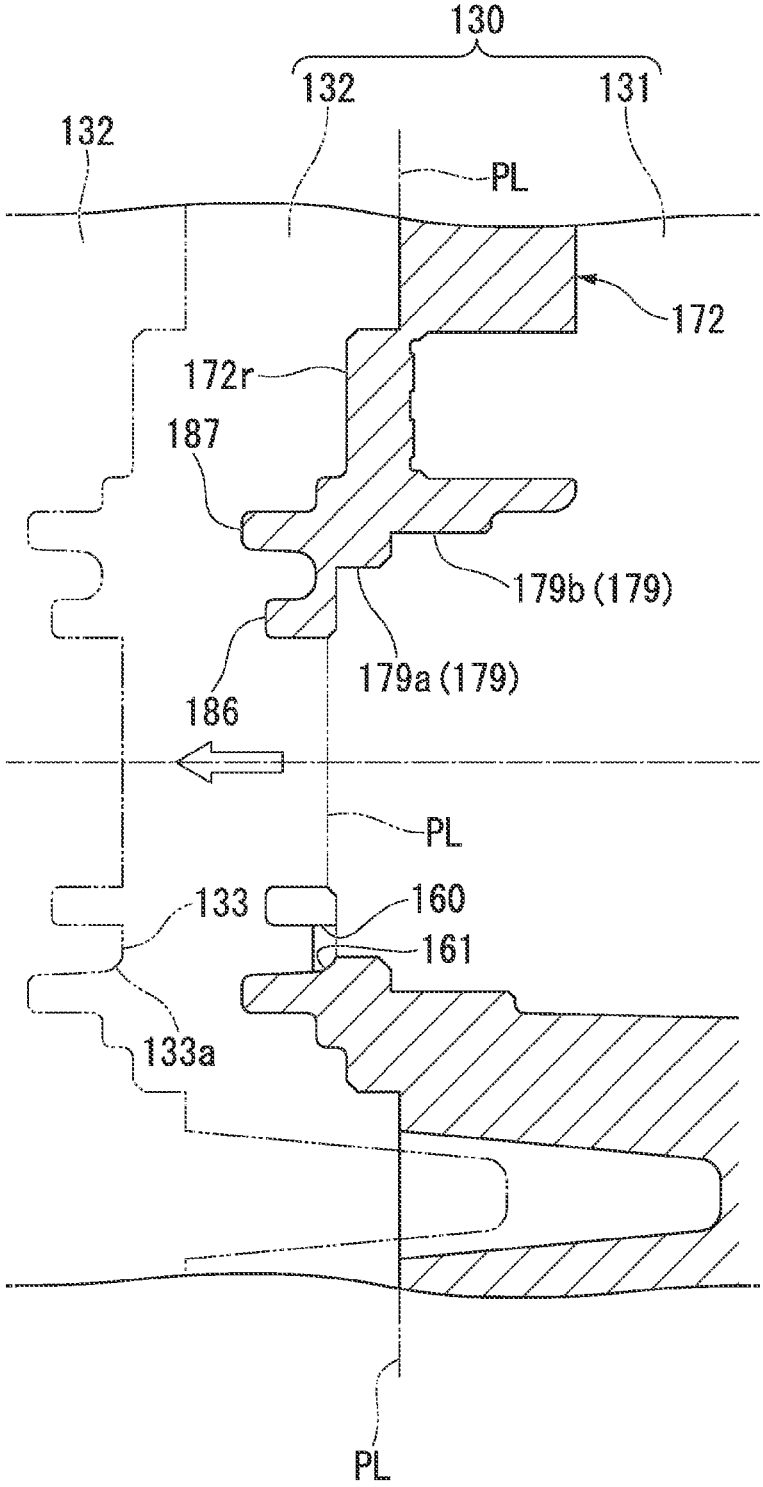
FIG. 36 is a view showing a method of manufacturing a gear cover according to the eighth embodiment of the present invention.

FIG. 36 is a view showing the method of manufacturing the gear cover.

Here, as described above, the gear cover 172 is formed of aluminum through die casting.

As shown in FIG. 36, a dividing surface (a parting line) PL of a cavity 131 and a core 132 that constitute an aluminum die-casting mold 130 is set to a surface of the first side end surface 172*r* of the gear cover 172. Then, the draining-off hole 160 formed in the impermeable wall 185 installed on the first side end surface 172*r* of the gear cover 172 is formed by a cylinder bush 133 installed on the core 132. That is, the draining-off hole 160 is formed through casting.

Here, a rounded chamfered section 133*a* configured to form the drainage gradient 161 of the draining-off hole 160 is formed on the cylinder bush 133. For this reason, when the gear cover 172 is formed through die casting, the draining-off hole 160 and the drainage gradient 161 can be formed without machining during a post-process.

(Operation of Starter)

Next, an operation of the starter 1 will be described.

As shown in FIG. 26, when the starter 1 is stopped before the current is supplied to the exciting coil 24, the outer clutch 18 biased to the return spring 21 is fully biased toward the motor unit 3 (the right side of FIG. 26) such that the inner clutch 22 integrated with the transmission pinion gear 70 is pulled. Then, the outer clutch 18 of the clutch mechanism 5 is stopped at a position at which it abuts the stopper 94. Accordingly, the idle gear unit 100 having the idle gear 101 meshed with the transmission pinion gear 70 is disengaged such that the driving pinion gear 110 and the ring gear 23 are separated.

Here, when the starter 1 is stopped, the inner plunger 81 is biased toward the first side (the left side of FIG. 26) and the outer plunger 85 is biased toward the second side (the right side of FIG. 26) to be alternately biased by the plunger spring 91 that constitutes the backlash absorption mechanism. For this reason, the clearance C2 of the gear plunger 80 (a spacing distance between the first side end 81*a* of the inner plunger 81 and the second side end 85*a* of the outer plunger 85, see FIG. 34) becomes a maximum value.

Here, the first side end 81*a* of the inner plunger 81 and the second side end of the outer clutch 18 have a slight clearance therebetween, and thus the outer clutch 18 is pushed toward the stopper 94 by the spring load of the return spring 21.

In addition, the switch plunger 27 is pushed back by the switch return spring 27*a* to be fully moved toward the motor unit 3 (the right side of FIG. 26). Then, the outer flange section 29 of the switch plunger 27 is stopped while abutting the top plate 12. Further, the movable contact plate 8 of the switch shaft 30 vertically installed on the outer flange section 29 is separated from the fixed contact plate 34 to be electrically cut.

When the ignition switch (not shown) of the vehicle is turned ON from the state, the current is supplied to excite the exciting coil 24, and a magnetic path through which magnetic flux passes the switch plunger 27 and the gear plunger 80 is formed. Accordingly, the switch plunger 27 and the gear plunger 80 slides toward the ring gear 23.

Here, since the ring member 27*r* is integrally installed on the inner circumferential surface of the switch plunger 27, as the ring member 27*r* presses the gear plunger 80 and the gear plunger 80 is initially pressed toward the ring gear 23, the switch plunger 27 and the gear plunger 80 are integrated to slide toward the ring gear 23.

In addition, the outer clutch 18 is meshed with the drive shaft 4 by a helical spline, and the sleeve 18*a* abuts the inner plunger 81 of the gear plunger 80. Accordingly, the outer clutch 18 is pushed out toward the ring gear 23 while being slightly relatively rotated to an extent of an inclination angle of the helical spline 18*b* with respect to the drive shaft 4 when the switch plunger 27 and the gear plunger 80 slide. Further, the transmission pinion gear 70 and the idle gear unit 100 are also pushed toward the ring gear 23 interlocking with the gear plunger 80 via the clutch mechanism 5.

Here, the gear plunger 80 is attracted against the biasing force of the plunger spring 91 and slides to the first side (the left side of FIG. 26). Accordingly, the first side end 81*a* of the inner plunger 81, which is a point of action of the electromagnetic device 9, constantly elastically abuts the second side end of the outer clutch 18 upon slide movement of the gear plunger 80.

Further, when the switch plunger 27 is moved toward the ring gear 23, the movable contact plate 8 is moved toward the fixed contact plate 34 via the outer flange section 29 and the switch shaft 30 to come in contact with the fixed contact plate 34. Since the movable contact plate 8 is floatingly supported to be displaced in the axial direction with respect to the switch shaft 30, the pressing force of the switch spring 32 is applied to the movable contact plate 8 and the fixed contact plate 34.

When the movable contact plate 8 comes in contact with the fixed contact plate 34, a voltage of the battery (not shown) is applied to the two positive-electrode-side brushes among the four brushes 41, and the coil 59 is supplied with electricity via the segment 62 of the commutator 61.

Then, a magnetic field is generated at the armature core 58, and a magnetic attractive force or repulsive force is generated between the magnetic field and the permanent magnet 57 installed on the motor yoke 53. Accordingly, the armature 54 starts to rotate. Then, as the armature 54 is rotated, the rotational force of the rotary shaft 52 of the armature 54 (the rotational force of the motor unit 3) is transmitted to the drive shaft 4 via the planetary gear mechanism 2, and the drive shaft 4 starts to rotate.

As the drive shaft 4 is rotated, the outer clutch 18 meshed with the helical spline 19 of the drive shaft 4 is turned around, and an inertial force is applied to the clutch mechanism 5. Then, the clutch mechanism 5 is pushed out toward the ring gear 23 along the helical spline 19 by the inertial force. Here, since a force is applied to the gear plunger 28 toward the ring gear 23, the gear plunger 28 is also moved toward the ring gear 23 based on movement of the clutch mechanism 5.

As the clutch mechanism 5 is pushed out toward the ring gear 23, the idle gear 101 is interlocked with the transmission pinion gear 70 integrated with the clutch mechanism 5 so as to be pushed out toward the ring gear 23 while being rotated. Then, the driving pinion gear 110 installed on the end section 102*b* of the idle shaft 102 is also pushed out with the idle gear 101 while being rotated toward the ring gear 23.

When the driving pinion gear 110 starts to rotate while the first side end surface 110*f* of the driving pinion gear 110 abuts the second side end surface 23*a* of the ring gear 23, the abutting state is released and the gears are meshed. Then, as the driving pinion gear 110 is pushed out toward the ring gear 23 by the biasing force of the pinion spring 113, the driving pinion gear 110 and the ring gear 23 start to mesh with each other.

Here, the first tooth chamfered section 141*a* is formed on the external tooth section 110*g* of the driving pinion gear 110 at a front side in the rotational direction (an arrow Y1 of FIG. 31) and an edge section near the ring gear 23. Meanwhile, the tooth chamfered section 142 is formed on an edge section of the external tooth section 23*g* of the ring gear 23, into which the external tooth section 110*g* of the driving pinion gear 110 is received. For this reason, the driving pinion gear 110 and the ring gear 23 are smoothly meshed.

In addition, when the driving pinion gear 110 and the ring gear 23 start to mesh with each other while the first side end surface 110*f* of the driving pinion gear 110 and the second side end surface 23*a* of the ring gear 23 abut each other, a dimensional distance in the axial direction therebetween becomes a zero. For this reason, in the case in which the first side end surface 110*f* of the driving pinion gear 110 and the second side end surface 23*a* of the ring gear 23 abut each other, when the driving pinion gear 110 is further pushed out, the pinion spring 113 is shrunk. Accordingly, the first side end surface 110*f* of the driving pinion gear 110 is biased toward the second side end surface 23*a* of the ring gear 23.

That is, the pinion spring 113 constitutes a damper mechanism configured to absorb a thrust load when the driving pinion gear 110 and the ring gear 23 abut each other. Accordingly, even when the first side end surface 110*f* of the driving pinion gear 110 and the second side end surface 23*a* of the ring gear 23 abut each other, the switch plunger 27 can be pushed out to a predetermined position. In addition, abrasion between the first side end surface 110*f* of the driving pinion gear 110 and the second side end surface 23*a* of the ring gear 23 can be suppressed and durability of the starter 1 can be improved.

Here, as described above, since the driving pinion gear 110 and the ring gear 23 are helically meshed, a thrust load in a direction of the ring gear 23 (a plunge direction) is generated at the driving pinion gear 110. Then, the driving pinion gear 110 is moved toward the ring gear 23 by the thrust load. In addition, the outer clutch 18 is also pushed out toward the ring gear 23 against the biasing force of the return spring 21 along the helical spline 19 by the inertial force.

Here, a predetermined attractive force toward the ring gear 23 is applied to the gear plunger 80. Accordingly, the gear plunger 80 slides toward the ring gear 23 while pressing the outer clutch 18 to be interlocked with the outer clutch 18. As a result, the driving pinion gear 110 is pushed out toward the ring gear 23, and the ring gear 23 is meshed at a predetermined meshing position.

As the ring gear 23 and the driving pinion gear 110 are meshed in this way and the rotational force of the drive shaft 4 is transmitted to the ring gear 23, the engine is started.

Here, since the driving pinion gear 110 and the ring gear 23 are helically meshed, when the rotational force of the drive shaft 4 is transmitted from the driving pinion gear 110 to the ring gear 23, a thrust load toward the first side (the left side of FIG. 26) is generated at the driving pinion gear 110. The thrust load generated at the driving pinion gear 110 is transmitted to the retaining ring 106 installed on the first side of the driving pinion gear 110, and then transmitted to the drive shaft 4 via the idle shaft 102, the idle gear 101, the transmission pinion gear 70, the inner clutch 22, the outer clutch 18, the movement restriction section 20 and the circlip 20*a*. For this reason, the thrust load is generated at the drive shaft 4 toward the first side, and the drive shaft 4 slides toward the first side.

However, the load receiving member 50 is installed on the gear cover 172 of the housing 17. Accordingly, the first side end surface 4*c* of the drive shaft 4 abuts the load receiving member 50, and slide movement of the drive shaft 4 toward the first side is restricted. In this way, the thrust load applied to the drive shaft 4 can be effectively received by the load receiving member 50.

Meanwhile, after the driving pinion gear 110 and the ring gear 23 are meshed, upon cranking when the engine is started, the rotational speed of the ring gear 23 is varied by behavior of the engine. Accordingly, a thrust load toward the first side (the left side of FIG. 26) and the second side (the right side of FIG. 26) is generated at the driving pinion gear 110.

Specifically, when the rotational speed of the ring gear 23 is lower than that of the driving pinion gear 110, a thrust load in a direction approaching the ring gear 23 (the left side of FIG. 26) is generated at the driving pinion gear 110.

Meanwhile, when the rotational speed of the ring gear 23 is higher than that of the driving pinion gear 110, a thrust load in a direction away from the ring gear 23 (the right side of FIG. 29) is generated at the driving pinion gear 110.

In particular, in the vehicle including the idle stop function, since stop/start of the engine is frequently performed and use frequency of the starter is increased in comparison with a conventional starter, the above-described thrust load is frequently generated.

However, when the rotational speed of the ring gear 23 is higher than that of the driving pinion gear 110, while the thrust load in the direction away from the ring gear 23 (the right side of FIG. 29) is generated at the driving pinion gear 110, in this case, a thrust load in an opposite direction of the thrust load applied from the ring gear 23 to the driving pinion gear 110 is applied from the helical mesh section between the idle gear 101 and the transmission pinion gear 70.

That is, while the skew direction of the teeth of the idle gear 101 is set to the same direction as the skew direction of the teeth of the driving pinion gear 110, the skew direction of the teeth of the transmission pinion gear 70 is set to the same direction as the skew direction of the teeth of the ring gear 23. In this state, while the rotational speed of the ring gear 23 is higher than that of the driving pinion gear 110, the rotational speed of the idle gear 101 is higher than that of the transmission pinion gear 70. For this reason, the thrust load applied to the driving pinion gear 110 in the direction away from the ring gear 23 can be offset.

Accordingly, even when the thrust load in the direction away from the ring gear 23 is generated at the driving pinion gear 110, an appropriately stable helical meshing can be maintained without separation of the driving pinion gear 110 from the ring gear 23.

In addition, the thrust load generated at the driving pinion gear 110 is transmitted to the retaining ring 106 installed on the first side of the driving pinion gear 110, and then transmitted to the bottom wall 66 of the clutch cover 6 via the idle shaft 102, the inner clutch 22 and the clutch washer 64. However, since the cylindrical reinforcement section 67 is integrally formed with the bottom wall 66, deformation in the axial direction of the clutch cover 6 is suppressed.

Here, when the rotational speed of the ring gear 23 is lower than that of the pinion gear 74 and the driving pinion gear 110 is rotated at the rotational force of the armature 54, if the inertia of the idle shaft 102 or the idle gear 101 is large, the thrust load applied to the driving pinion gear 110 by the idle gear 101 and the transmission pinion gear 70 in the direction away from the ring gear 23 may not be offset. In this case, the inertia of the idle shaft 102 or the idle gear 101 is applied to the clutch mechanism 5, and is further applied to the inner plunger 81 of the gear plunger 80 via the clutch mechanism 5.

Here, when backlash is formed between the gear plunger 80 and the clutch mechanism 5, the clutch mechanism 5 is displaced in the axial direction to an extent of the backlash, and transmission of the rotational force of the armature 54 to the driving pinion gear 110 is slightly delayed to that extent. Further, since the load applied to rotation of the armature 54 is also reduced while the clutch mechanism 5 is moved to the extent of the backlash, while the rotation of the armature 54 acceralates, when the backlash is blocked, the load is added to the rotation of the armature 54 so that the armature shifts from accelerating and to maintaining a constant speed. Depending on the variation in the rotation speed, irregularities may occur from the rotation of the armature 54, and a meshing sound of the teeth of the planetary gear mechanism 2 may occur due to the rotational irregularities.

However, the gear plunger 80 includes the plunger spring 91 that constitutes the backlash absorption mechanism. Accordingly, even when the clutch mechanism 5 is displaced in the axial direction upon start of the engine, since the plunger spring 91 is elastically deformed such that the first side end 81*a* of the inner plunger 81 abuts the second side end (see FIG. 26) of the outer clutch 18, backlash in the axial direction of the clutch mechanism 5 can be suppressed.

In addition, a relative length of movement of the inner plunger 81 with respect to the outer plunger 85 (the clearance C2 between the inner flange section 86 of the outer plunger 85 and the groove section 84 of the inner plunger 81, see FIG. 34) is set to be shorter than the minimum guaranteed length of meshing Xmin (see FIG. 32) between the ring gear 23 and the driving pinion gear 110. For this reason, even when the thrust load is generated at the driving pinion gear 110 in the direction away from the ring gear 23 and the inner plunger 81 is pressed against the biasing force of the plunger spring 91, the inner plunger 81 is not displaced to be separated from the ring gear 23. For this reason, an appropriately stable helical meshing can be maintained without releasing the helical meshing between the driving pinion gear 110 and the ring gear 23.

Further, the inner flange section 86 integrally formed with the second side end 85*a* of the outer plunger 85 has the metal cover 145 formed through insert molding. Then, the build-up section 145*b* of the metal cover 145 constitutes an inner circumferential surface of the inner flange section 86 and comes in sliding contact with the groove section 84 of the inner plunger 81. That is, sliding contact points between the outer plunger 85 and the inner plunger 81 are formed of different materials. For this reason, as a direction of the thrust load applied to the driving pinion gear 110 is frequently varied, even when the inner plunger 81 repeatedly slides with respect to the outer plunger 85, adhesive abrasion is prevented.

When the engine is completely started and the rotational speed of the driving pinion gear 110 exceeds the rotational speed of the drive shaft 4, the one-way clutch function of the clutch mechanism 5 is applied and the driving pinion gear 110 idles. In addition, when the electrical connection to the exciting coil 24 is stopped by the start of the engine, the driving pinion gear 110 is separated from the ring gear 23 by the biasing force of the return spring 21 with respect to the outer clutch 18, and the movable contact plate 8 is separated from the fixed contact plate 34 to stop the brushed direct current motor 51.

Here, while the electrical connection to the exciting coil 24 is stopped after the rotational speed of the driving pinion gear 110 exceeds the rotational speed of the drive shaft 4, even in this case, as described above, the helical meshing between the driving pinion gear 110 and the ring gear 23 is not released. That is, after the current supplied to the exciting coil 24 is stopped, the driving pinion gear 110 is separated from the ring gear 23.

(Actions of Inner Cylindrical Section, Outer Cylindrical Section and Draining-Off Hole of Gear Cover)

Next, actions of the inner cylindrical section 186, the outer cylindrical section 187 and the draining-off hole 160 formed on the impermeable wall 185 of the gear cover 172 will be described based on FIG. 37.

Figure 37:
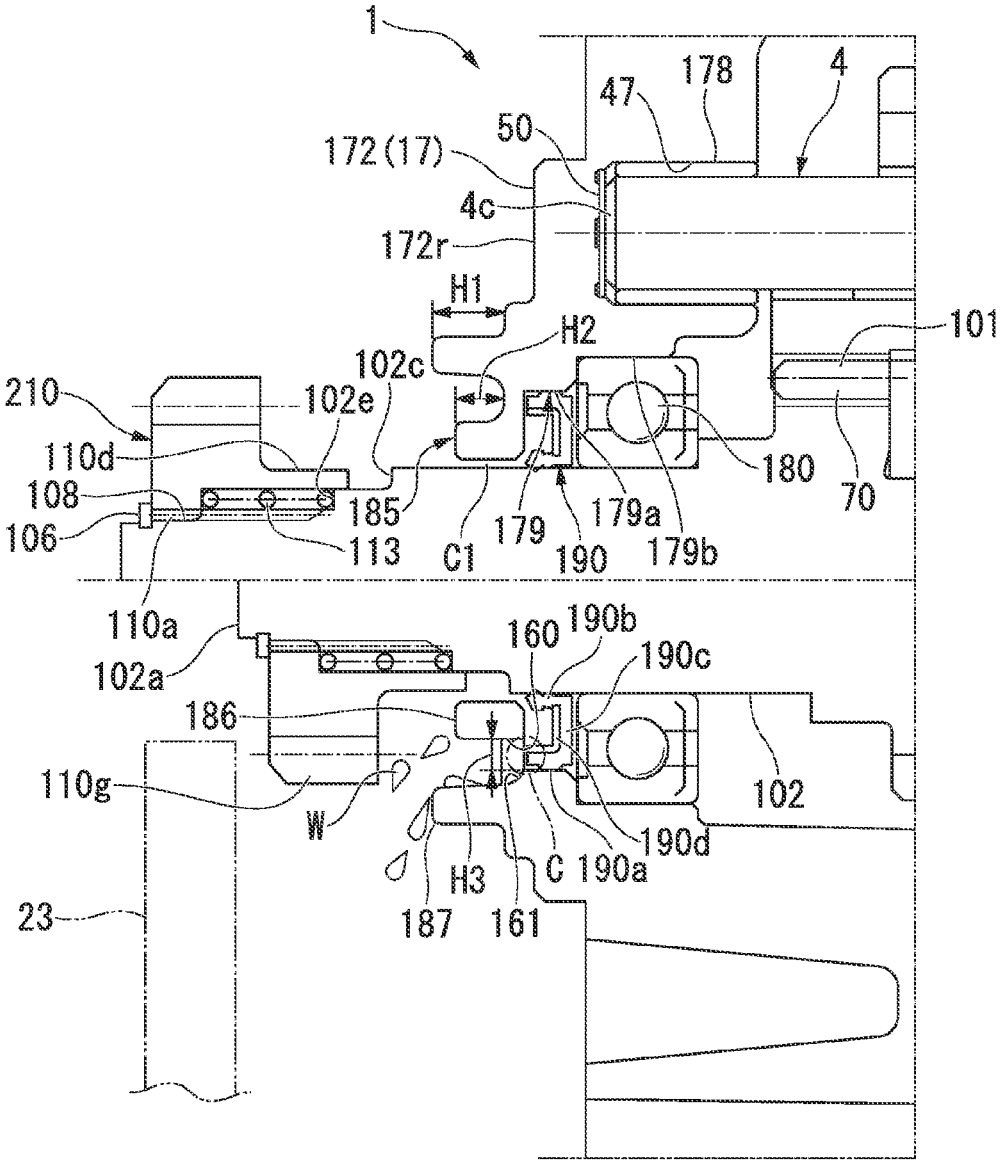
FIG. 37 is a view showing an action of an inner cylindrical section, an outer cylindrical section and a draining-off hole of the gear cover according to the eighth embodiment of the present invention.

FIG. 37 is a view showing actions of the inner cylindrical section, the outer cylindrical section and the draining-off hole of the gear cover.

As shown in FIG. 37, as the inner cylindrical section 186 configured to surround a periphery of the idle shaft 102 is formed at the impermeable wall 185 installed on the first side end surface 172*r* of the gear cover 172 and the clearance C1 between the inner cylindrical section 186 and the idle shaft 102 is set to be as small as possible, the intrusion path of a foreign substance W such as water or the like between the shaft insertion hole 179 of the gear cover 172 and the idle shaft 102 is elongated and narrowed. Accordingly, easy intrusion of the foreign substance W such as water or the like from a space between the shaft insertion hole 179 and the idle shaft 102 can be prevented.

However, the foreign substance W such as water or the like may intrude through the space between the impermeable wall 185 and the idle shaft 102. In this case, the foreign substance W such as water or the like intruding into a lower side of the space (a portion C of FIG. 37) between the gear cover 172 near the inner surface side of the impermeable wall 185 and the oil seal 190 may remain.

Further, an amount of water remaining at the lower side of the space between the gear cover 172 near the inner surface side of the impermeable wall 185 and the oil seal 190 depends on an attachment state of the oil seal 190. That is, while the amount of water is minimized when the inner surface of the impermeable wall 185 of the gear cover 172 and the outer circumferential wall 190*a* of the oil seal 190 are completely adhered, the amount of water is increased to an extent of the separation when the inner surface of the impermeable wall 185 of the gear cover 172 and the outer circumferential wall 190*a* of the oil seal 190 are slightly separated.

Here, since the draining-off hole 160 is formed in the impermeable wall 185 of the gear cover 172, the foreign substance W such as water or the like remaining in the lower side of the space between the gear cover 172 near the inner surface of the impermeable wall 185 and the oil seal 190 is discharged via the draining-off hole 160.

Further, since the opening width H3 in the vertical direction at the inside (the right side of FIG. 29) of the draining-off hole 160 is set to be larger than a thickness of the outer circumferential wall 190*a* of the oil seal 190 and the draining-off hole 160 is not closed by the outer circumferential wall 190*a* of the oil seal 190, the foreign substance W such as water or the like is discharged via the draining-off hole 160.

In addition, since the drainage gradient 161 having an arc-shaped cross-section is formed on a lower edge of the draining-off hole 160, the foreign substance W such as water or the like is rapidly discharged.

Further, since the draining-off hole 160 is formed in an arc shape along the outer circumferential surface of the inner cylindrical section 186 and the inner circumferential surface of the outer cylindrical section 187, the foreign substance W such as the discharged water or the like is discharged to the outside of the gear cover 172 along the outer cylindrical section 187.

Here, the outer cylindrical section 187 has a function as a guide configured to guide the foreign substance W such as the discharged water or the like to the outside, and a function as a waterproof wall configured to prevent the foreign substance W such as water or the like from being poured into the draining-off hole 160 from the gear cover 172.

Accordingly, according to the above-described eighth embodiment, regardless of the assembly state of the oil seal 190, the water remaining between the gear cover 172 near the inner surface of the impermeable wall 185 and the oil seal 190 can be rapidly discharged to the outside via the draining-off hole 160 of the impermeable wall 185. In addition, intrusion of the foreign substance W such as water or the like into the gear cover 172 can be effectively prevented by the inner cylindrical section 186 and the outer cylindrical section 187 formed on the impermeable wall 185 of the gear cover 172. For this reason, corrosion of the idle shaft 102 or inferior sliding between the idle shaft 102 and the oil seal 190 can be effectively prevented while effectively preventing intrusion of water into the gear cover 172.

In addition, since the draining-off hole 160 is formed between the inner cylindrical section 186 and the outer cylindrical section 187 of the impermeable wall 185 in the first side end surface 172*r* of the gear cover 172 and at a lower side such that the starter 1 is attached to the engine (not shown), water can be efficiently discharged from the draining-off hole 160 using gravity.

Further, when the gear cover 172 is formed using the aluminum die-casting mold 130, since the draining-off hole 160 is simultaneously formed using the cylinder bush 133 (through casting), there is no need to perform machining when forming the draining-off hole 160. For this reason, the manufacturing cost of the gear cover 172 can be reduced.

In addition, since a size of the draining-off hole 160 is set to a size that is not closed by the outer circumferential wall 190*a* of the oil seal 190, the inside and the outside of the gear cover 172 can securely come in communication with each other via the draining-off hole 160. For this reason, the water remaining between the gear cover 172 near the inner surface of the impermeable wall 185 and the oil seal 190 can be discharged.

Further, since the drainage gradient 161 having an arc-shaped cross-section is formed on the lower edge of the draining-off hole 160, the foreign substance W such as water or the like can be rapidly discharged.

Then, since the draining-off hole 160 is formed in an arc shape along the outer circumferential surface of the inner cylindrical section 186 and the inner circumferential surface of the outer cylindrical section 187 of the impermeable wall 185, the foreign substance W such as the discharged water or the like can be discharged to the outside of the gear cover 172 along the outer cylindrical section 187.

(Operation of Gear Plunger)

In addition, in this embodiment, in the case in which the gear plunger 80 of the electromagnetic device 9 includes the inner plunger 81, the outer plunger 85, and the plunger spring 91 disposed between the inner plunger 81 and the outer plunger 85, the clearance C2 between the inner flange section 86 of the outer plunger 85 and the groove section 84 of the inner plunger 81 (a relative length of movement of the inner plunger 81 with respect to the outer plunger 85) is set to be smaller than the minimum guaranteed length of meshing Xmin (see FIG. 32) between the ring gear 23 and the driving pinion gear 110. For this reason, before electricity supplied to the exciting coil 24 is blocked, separation of the driving pinion gear 110 from the ring gear 23 can be prevented. Accordingly, generation of abnormal noises of the starter 1 upon start of the engine can be suppressed.

In addition, in order to restrict the relative length of movement of the inner plunger 81 with respect to the outer plunger 85, the groove section 84 is formed in the inner plunger 81, the inner flange section 86 is formed in the outer plunger 85, and the inner flange section 86 is disposed in the groove section 84. According to the above-described configuration, the relative length of movement of the inner plunger 81 with respect to the outer plunger 85 can be restricted with a simple structure without increasing an occupying area of the gear plunger 80.

Further, the first tooth chamfered section 141*a* is formed on the external tooth section 110*g* of the driving pinion gear 110 at a front side in the rotational direction (the arrow Y1 of FIG. 31) and an edge section near the ring gear 23. Meanwhile, the tooth chamfered section 142 is formed on an edge section of the external tooth section 23*g* of the ring gear 23, into which the external tooth section 110*g* of the driving pinion gear 110 is received. For this reason, the driving pinion gear 110 and the ring gear 23 can be smoothly meshed. Accordingly, collision noises when the driving pinion gear 110 plunges into the ring gear 23 can be reduced, and generation of abnormal noises of the starter 1 upon start of the engine can be further suppressed.

In addition, the inner flange section 86 integrally formed with the second side end 85*a* of the outer plunger 85 has the metal cover 145 formed through insert molding. Then, the build-up section 145*b* of the metal cover 145 constitutes the inner circumferential surface of the inner flange section 86, and comes in sliding contact with the groove section 84 of the inner plunger 81. That is, sliding contact points between the outer plunger 85 and the inner plunger 81 are formed of different materials. For this reason, as a direction of the thrust load applied to the driving pinion gear 110 is frequently varied, even when the inner plunger 81 repeatedly slides with respect to the outer plunger 85, adhesive abrasion can be prevented.

In addition, in this embodiment, the case in which the starter 1 is a so-called 2-shaft type starter having two shafts, i.e., the drive shaft 4 and the idle shaft 102, has been described. However, this embodiment of the present invention is not limited thereto but the above-described electromagnetic device 9 can also be applied to the so-called single shaft type starter in which the driving pinion gear 110 is installed on the drive shaft 4.

Further, the above-described electromagnetic device 9 can also be applied to the starter in which the electromagnetic device 9 is not installed concentrically with the drive shaft 4. In this case, for example, the gear plunger 80 of the electromagnetic device 9 and the driving pinion gear 110 are connected via a separate lever or the like, and a pressing force is biased to the driving pinion gear 110 toward the ring gear 23.

Further, in this embodiment, in order to restrict the relative length of movement of the inner plunger 81 with respect to the outer plunger 85, the case in which the groove section 84 is formed on the inner plunger 81, the inner flange section 86 is formed on the outer plunger 85 and the inner flange section 86 is disposed in the groove section 84 has been described. However, this embodiment of the present invention is not limited thereto but may be a structure in which the relative length of movement of the inner plunger 81 with respect to the outer plunger 85 can be restricted.

For example, a convex section may be formed in the outer plunger 85 at a place corresponding to the groove section 84 by forming the groove section 84 at only a portion of the inner plunger 81 rather than forming the groove section 84 at the inner plunger 81 throughout the circumferential direction.

In addition, a stopper configured to restrict the relative movement of the inner plunger 81 may be installed on the outside of the outer plunger 85, or a stopper configured to restrict the relative movement of the inner plunger 81 with respect to the outer plunger 85 may be installed on the inner wall of the bracket section 171 into which the electromagnetic device 9 is received.

In addition, in this embodiment, the case in which the plunger spring 91 configured to bias the inner plunger 81 and the outer plunger 85 away from each other is installed has been described. However, this embodiment is not limited thereto but an elastic member configured to bias the inner plunger 81 and the outer plunger 85 away from each other may be installed.

Ninth Embodiment

Next, a ninth embodiment of the present invention will be described based on FIG. 38. Further, the same elements as the eighth embodiment are designated by the same reference numerals and description thereof will be omitted (this also applies to a variant of the ninth embodiment and a tenth embodiment).

Figure 38:
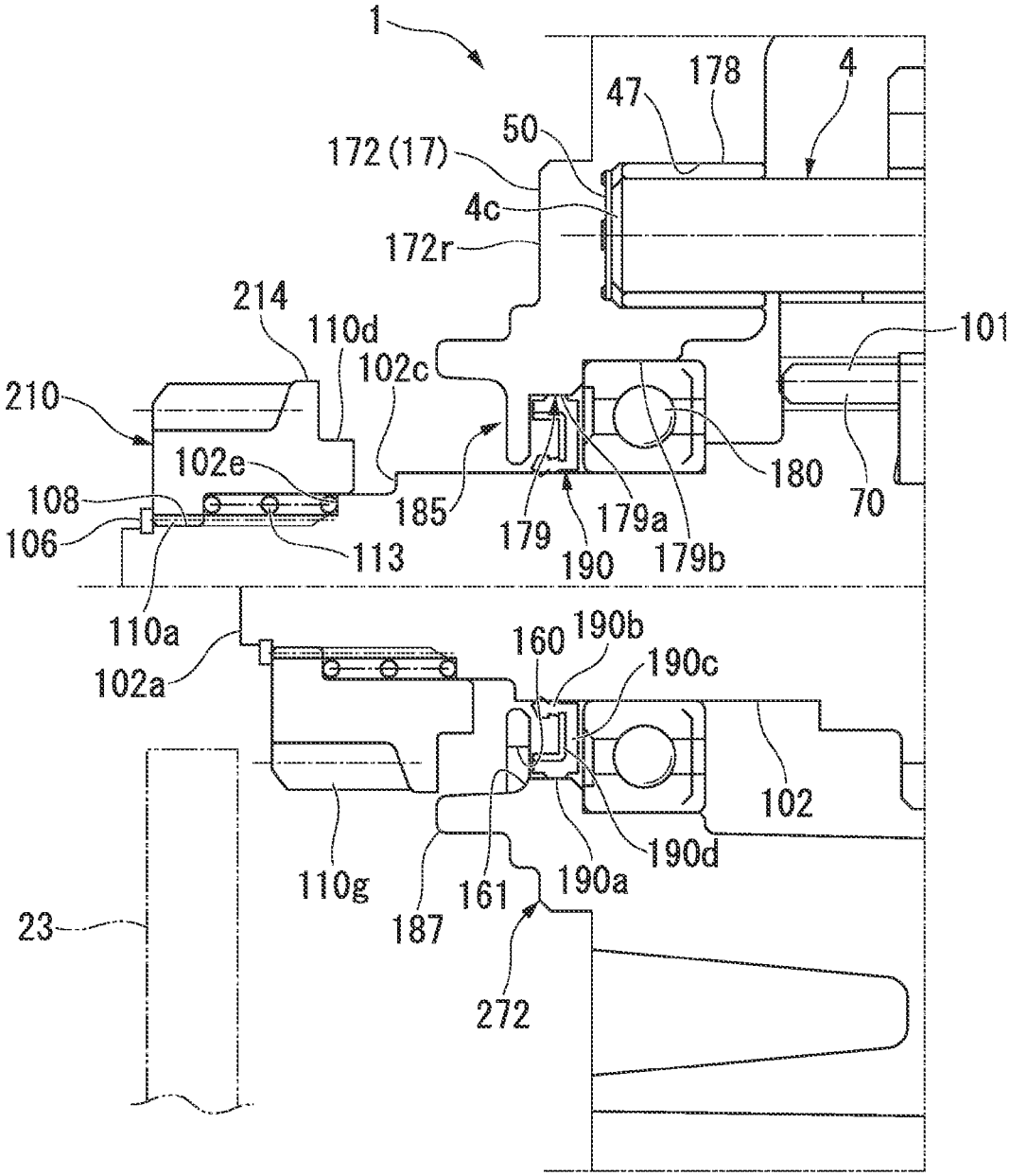
FIG. 38 is a cross-sectional view of a shaft insertion hole and a vicinity thereof in a gear cover according to a ninth embodiment of the present invention.

FIG. 38 is a cross-sectional view of a shaft insertion hole of a gear cover according to the ninth embodiment and a periphery thereof, corresponding to FIG. 29 of the above-described eighth embodiment.

As shown in FIG. 38, the ninth embodiment is distinguished from the above-described eighth embodiment in that only the outer cylindrical section 187 is formed on an impermeable wall 185 of a first side end surface 172*r* of a gear cover 272 around the shaft insertion hole 179, and the inner cylindrical section 186 of the above-described eighth embodiment is not formed.

In addition, an outer flange section 214 is integrally formed with a driving pinion gear 210 according to the ninth embodiment at a base end side (a right end side of FIG. 38) of the external tooth section 110*g*. An outer diameter of the outer flange section 214 is set to be larger than the outer diameter of the external tooth section 110*g* and set to a size not to come in contact with the outer cylindrical section 187 such that the driving pinion gear 210 is retracted (in a state in which the starter is stopped, in a state of a lower side of a centerline of the idle shaft 102 of FIG. 38).

In this way, as the outer flange section 214 is formed on the driving pinion gear 210, when the driving pinion gear 210 is retracted, a gap between the driving pinion gear 210 and the outer cylindrical section 187 of the gear cover 272 can be reduced. For this reason, intrusion of the foreign substance such as water or the like closer to the base end side than the driving pinion gear 210 (the inside in the radial direction of the outer cylindrical section 187) can be suppressed by the outer flange section 214 and the outer cylindrical section 187.

Accordingly, according to the above-described ninth embodiment, in addition to the same effect as the above-described eighth embodiment, manufacturing cost of the gear cover 272 can be reduced to an extent to which the inner cylindrical section 186 is not formed.

Variant of Ninth Embodiment

Next, a variant of the ninth embodiment will be described based on FIG. 39.

Figure 39:
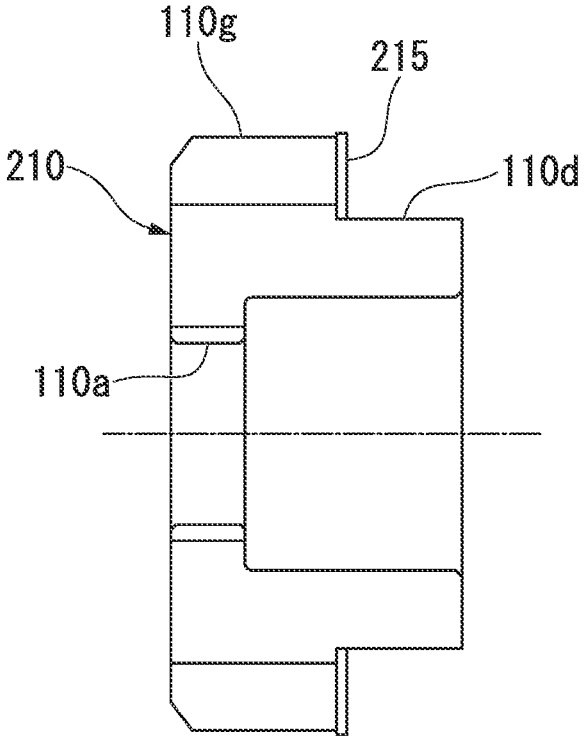
FIG. 39 is a cross-sectional view of a driving pinion gear according to a variant of the ninth embodiment of the present invention.

FIG. 39 is a cross-sectional view of a driving pinion gear according to the variant of the ninth embodiment.

In the above-described ninth embodiment, while the case in which the outer flange section 214 is integrally formed with the base end side of the external tooth section 110*g* of the driving pinion gear 210 has been described, as shown in FIG. 39, a flat washer 215 may be installed instead of the outer flange section 214.

The flat washer 215 is fitted onto the extended cylindrical section 110*d* of the driving pinion gear 210, and fixed thereto while one side thereof abuts a base end of the external tooth section 110*g*. As a fixing method, for example, there is a method of retaining the flat washer 215 so as not to separate from the extended cylindrical section 110*d* using a C type retaining ring (not shown). In addition, the flat washer 215 may be simply fitted into the extended cylindrical section 110*d*.

Further, an outer diameter of the flat washer 215 is set to be larger than the outer diameter of the external tooth section 110*g* and set to a size not to come in contact with the outer cylindrical section 187 when the driving pinion gear 210 is retracted.

In the above-described configuration, the same effects as the above-described ninth embodiment can be exhibited.

Tenth Embodiment

Next, a tenth embodiment of the present invention will be described based on FIGS. 40 and 41.

Figure 40:
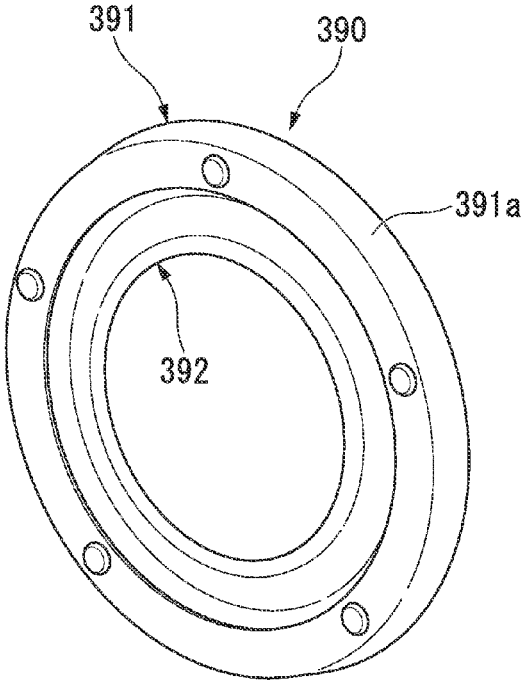
FIG. 40 is a perspective view of an oil seal according to a tenth embodiment of the present invention.
Figure 41:
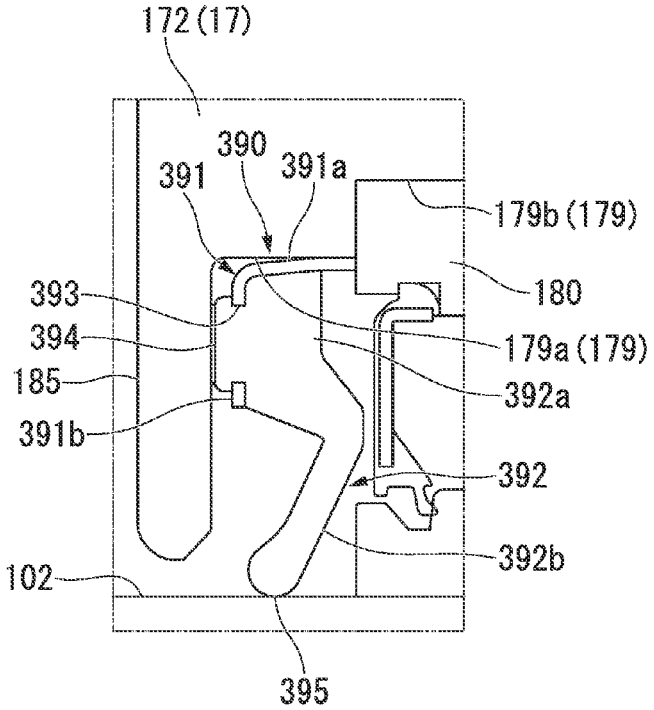
FIG. 41 is a cross-sectional view of a switch plunger according to the tenth embodiment of the present invention.
Figure 42:
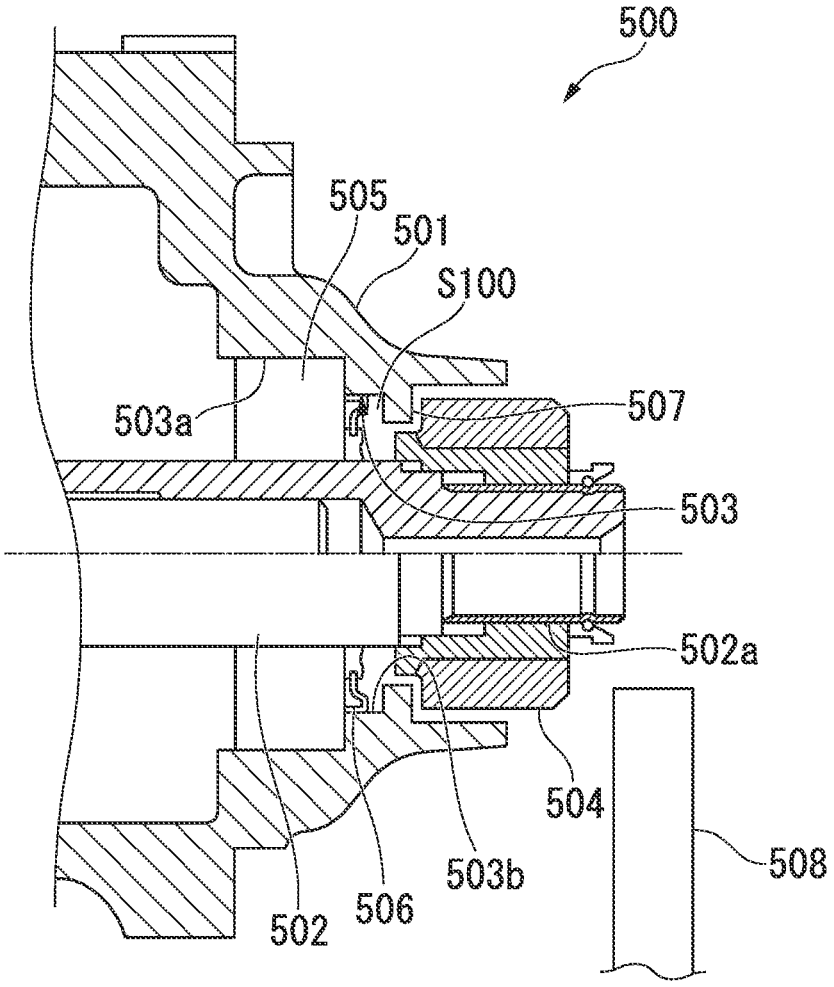
FIG. 42 is a view showing a seal member installed in a housing of a starter of the related art.

FIG. 40 is a perspective view of an oil seal according to the tenth embodiment, and FIG. 41 is a cross-sectional view showing the oil seal according to the tenth embodiment attached to the gear cover.

As shown in FIGS. 40 and 41, the tenth embodiment is distinguished from the eighth embodiment in that the oil seal 190 of the eighth embodiment has a different shape from an oil seal 390 of the tenth embodiment.

That is, the oil seal 390 according to the tenth embodiment is formed by insert-molding a seal section 392 formed of rubber at a seal cover 391 formed of metal.

The seal cover 391 is formed by pressing a metal plate, and configured of a cylindrical section 391*a* that constitutes an outer circumference of the oil seal 390 and an inner flange section 391*b* that is bent and extends from a first end of the cylindrical section 391*a* toward the inside in the radial direction.

The cylindrical section 391*a* is formed to have a diameter gradually increased toward an opposite side of the inner flange section 391*b*. Then, a diameter of a circumferential edge section of the cylindrical section 391*a* (hereinafter, simply referred to as a circumferential edge section of the seal cover 391) opposite to the inner flange section 391*b* is set to be slightly larger than the inner diameter of the seal mounting section 179*a* of the gear cover 172.

A plurality of (in the tenth embodiment, five) through-holes 393 are formed on the inner flange section 391*b* at equal intervals in the circumferential direction. The seal section 392 enters the through-hole 393 upon insert molding of the seal section 392. Accordingly, the seal section 392 and the inner flange section 391*b* are securely integrated.

The seal section 392 is configured of a ring section 392*a* in contact with the seal cover 391, and a lip section 392*b* integrally formed with an inner circumferential edge of the ring section 392*a*. The inner diameter of the ring section 392*a* is set to be substantially the same as the inner diameter of the inner flange section 391*b* of the seal cover 391. In addition, a convex section 394 fitted into the through-hole 393 is formed in the ring section 392*a* at a position corresponding to the through-hole 393 of the inner flange section 391*b*.

The lip section 392*b* extends from the inner circumferential edge of the ring section 392*a* toward the inside in the radial direction and is gradually inclined toward the inner flange section 391*b*.

A small ring section 395 having a substantially arc-shaped cross-section is integrally formed with an inner circumferential edge of the lip section 392*b*. The inner diameter of the small ring section 395 is set to be slightly smaller than the shaft diameter of the idle shaft 102. In addition, the small ring section 395 comes in sliding contact with the outer circumferential surface of the idle shaft 102 such that the oil seal 390 is attached to the gear cover 172.

In the above-described configuration, when the oil seal 390 is attached to the gear cover 172, the oil seal 390 is pushed from the inside in the axial direction (the right side of FIG. 41) of the seal mounting section 179*a* of the gear cover 172 to the seal mounting section 179*a* toward the impermeable wall 185 while being directed toward the inner flange section 391*b*.

Here, since the cylindrical section 391*a* of the seal cover 391 is formed to have a diameter gradually increased toward an opposite side of the inner flange section 391*b*, the circumferential edge section of the seal cover 391 is not hooked to the seal mounting section 179*a*. In addition, since the diameter of the circumferential edge section of the seal cover 391 is set to be slightly larger than the inner diameter of the seal mounting section 179*a* of the gear cover 172, the seal cover 391 is press-fitted into the seal mounting section 179*a*, and the oil seal 390 is not separated from the seal mounting section 179*a*.

Accordingly, in the above-described tenth embodiment, the same effects as the above-described eighth embodiment can be exhibited. In addition, since the oil seal 390 attached as the seal cover 391 formed of a metal material is press-fitted into the seal mounting section 179*a* of the gear cover 172, in comparison with the case in which a portion of the rubber is directly lightly press-fitted into the seal mounting section 179*a*, a fixing force of the oil seal 390 into the seal mounting section 179*a* can be increased.

In this embodiment, the case in which the starter 1 is a so-called 2-shaft type starter having two shafts, i.e., the drive shaft 4 and the idle shaft 102, has been described. However, this embodiment is not limited thereto but the draining-off hole 160 or the oil seals 190 and 390 may also be applied to a so-called single shaft type starter in which the driving pinion gear 110 is installed on the drive shaft 4.

That is, the draining-off hole 160 or the oil seals 190 and 390 may be applied to various so-called overhang type starters in which the driving pinion gears 110 and 210 are attached to the end section of the shaft protruding from the gear cover 172 (the housing 17) toward the outside in the axial direction.

Further, this embodiment is not limited to the starter but the draining-off hole 160 or the oil seals 190 and 390 may be applied to various power transmission mechanisms in which the shaft protrudes to the outside in the axial direction via the oil seal installed on the housing.

In addition, in this embodiment, the case in which the draining-off hole 160 is formed in an arc shape has been described. However, this embodiment is not limited thereto but the draining-off hole 160 may have a shape such that the water remaining in the gear covers 172 and 272 can be discharged to the outside. For example, the draining-off hole 160 may have a circular shape.

Example embodiments of the present invention have been described above, but the present invention is not limited thereto. Additions, omissions, substitutions and other modifications may be made without departing from the spirit of the present invention.

For example, while the present invention has been exemplarily described using an example of the starter 1 used to start the automobile, the starter 1 is not limited to the automobile but may be applied to, for example, a motorcycle, an engine type generator, and so on.

Further, in the starter 1 of this embodiment, as described above, the driving pinion gear 110 and the ring gear 23 can be stably helically meshed. Accordingly, even in the automobile to which the starter 1 is applied, in particular, the present invention may be applied to the automobile including an idling stop function, in which a use frequency of the starter 1 is high.

While preferred embodiments of the invention have been described and shown above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A starter comprising:

a motor unit configured to generate a rotational force by supplying electricity;

a subassembly comprising:

a drive shaft configured to receive the rotational force of the motor unit and rotate, wherein the drive shaft includes an externally splined component which is received by the motor unit; and wherein the motor unit includes an internally splined receiving component which is received by the externally splined component of the drive shaft;

a transmission gear slidably installed on the drive shaft; and a clutch mechanism installed between the transmission gear and the motor unit and configured to transmit or block a rotational force of the drive shaft to the transmission gear;

an idle shaft extending in a direction parallel to the drive shaft, rotatable around a central axis of the idle shaft, and configured to be slidable in an axial direction of the central axial interlocking with the transmission gear;

an idle gear installed on a first end side in the axial direction of the idle shaft and configured to mesh with the transmission gear;

a driving gear installed on the second end side in the axial direction of the idle shaft and configured to mesh with a ring gear of an engine;

a gear cover section configured to rotatably support one end of the drive shaft and a portion of the idle shaft and accommodate the transmission gear and the idle gear; and a bracket section installed between the motor unit and the gear cover section and configured to rotatably support a first end in the axial direction of the idle shaft, the bracket section including a through hole and a first opening section configured to accommodate at least a portion of the subassembly;

wherein the through hole of the bracket section allows the other end of the drive shaft to be rotatably supported by the motor unit.

2. The starter according to claim 1, wherein the gear cover section has an accommodating concave section configured to accommodate the idle gear, and a positioning unit installed on at least one out of an abutting surface of the gear cover section configured to abut the bracket section and an abutting surface of the bracket section configured to abut the gear cover section, wherein the abutting surface of the gear cover section and the abutting surface of the bracket section are configured to positionally align with each other.

3. The starter according to claim 2, wherein the positioning unit comprises:

a spigot joint section formed on a circumferential edge of an opening section of the accommodating concave section; and an opening section formed on the bracket section and configured to be fitted into the spigot joint section.

4. The starter according to claim 2, wherein the positioning unit comprises:

a positioning pin protruding from any one of the abutting surface of the gear cover section configured to abut the bracket section and the abutting surface of the bracket section configured to abut the gear cover section; and a pin insertion hole formed on the other of the abutting surface of the gear cover section configured to abut the bracket section and the abutting surface of the bracket section configured to abut the gear cover section and through which the positioning pin is capable of being inserted.

5. The starter according to claim 1, wherein the second end side in the axial direction of the idle shaft protrudes outside from the gear cover section in the axial direction, and the driving gear is installed on the protruding portion.

6. The starter according to claim 1, wherein the idle shaft and the idle gear are integrally formed with each other.

7. The starter according to claim 1, further comprising:

an electromagnetic device installed in the bracket section and configured to perform or stop supplying electricity to the motor unit, and generate a pressing force at the driving gear toward the ring gear via the clutch mechanism.

8. The starter according to claim 7, wherein the electromagnetic device comprises:

an exciting coil; and a gear plunger configured to slide along the drive shaft by supplying electricity to the exciting coil and configured to generate a pressing force at the clutch mechanism, and the electromagnetic device is installed concentrically with the drive shaft.

9. The starter according to claim 8, wherein the bracket section forms a sub-unit in which the electromagnetic device and the motor unit are assembled, and the bracket section includes a retainer section configured to prevent the electromagnetic device from slipping off from the bracket section toward the gear cover section.

10. The starter according to claim 1, wherein a draining-off section is formed on the abutting surface of the gear cover section configured to abut to the bracket section.

11. The starter according to claim 10, wherein a draining-off groove is formed on the abutting surface of the bracket section, and the draining-off section is configured of the draining-off groove and the abutting surface of the gear cover section.

* * * * *